United States Patent [19]

Takalo

[11] 4,285,644

[45] Aug. 25, 1981

[54] EXPANSION OR COMPRESSION MACHINE WITH INTERENGAGING MEMBERS ROTATING ON PERPENDICULAR AXES

[76] Inventor: Kauko A. Takalo, Kilontie 27 A 1, SF-02610 Espoo 61, Finland

[21] Appl. No.: 12,462

[22] Filed: Feb. 15, 1979

[51] Int. Cl.[3] ..... F01C 3/02; F01C 21/12

[52] U.S. Cl. ..... 418/195; 418/196; 62/402

[58] Field of Search ..... 418/9, 10, 141, 195, 418/196, 200, 227; 62/238 E, 324 B, 402; 123/233

[56] References Cited

U.S. PATENT DOCUMENTS

| | | | |
|---|---|---|---|
| 990,665 | 4/1911 | Norin | 418/195 |
| 1,989,552 | 1/1935 | Good | 418/10 |
| 4,003,348 | 1/1977 | Suzuki et al. | 418/195 |
| 4,013,046 | 3/1977 | Kemp | 418/195 |
| 4,017,285 | 4/1977 | Edwards | 62/402 |
| 4,239,469 | 12/1980 | Kemp | 418/195 |

FOREIGN PATENT DOCUMENTS

| | | | |
|---|---|---|---|
| 721481 | 2/1943 | Fed. Rep. of Germany | 418/195 |

*Primary Examiner*—John J. Vrablik

*Attorney, Agent, or Firm*—Cushman, Darby & Cushman

[57] ABSTRACT

A machine of positive displacement type for the expansion or compression of elastic fluids, wherein torque created or applied effects directly the power shaft, bearings of the power shaft are loaded only by weights of corresponding rotary masses, sealing lubrication is not used and the structure of the machine should accountably facilitate achieving of low losses.

The machine includes working spaces (5) defined by a rotary working member (1) and a surrounding body structure (4), and moving circumferentially with the working member, their main direction joining with said circumferential direction. The working spaces (5) are divided into a process space (6) and a transferring space (7) by a partition wall (15) belonging to rotary non-working reacting members (8) which are perpendicular to the working member and synchronized therewith and of so firm structure that they can transmit to the outside of the working member great forces due to a pressure difference between said spaces (6, 7). Said forces can be compensated by a programmed pressure effect onto a counter-surface (11) of the reacting member. Depending on the direction of rotation of the working member either expansion or compression of elastic fluid circulating through the machine is performed. Rotary valves (23) are preferably used for achieving a cyclic closing of the process space (6). A momentary area of the valve opening can essentially correspond to a momentary area of the partition wall (15). A partition wall forming part (10) of the reacting member is preferably provided with only one transition sector (77) for changing the process cycle, where requirements as to synchronization are low. Light sealing members (110) are preferably used to reduce remaining loss effects due to error in synchronization. Clearances not depending on synchronization may be maintained small by using temperature control of respective parts. A major part of the clearances can be provided with a labyrinth seal (61, 103, 104) for reducing the speed of gas leak.

8 Claims, 73 Drawing Figures

182
2
179
10
17
24
183
184
77
46
23
51
106
49
47
106
4
177
180
181
48
44
15
13
1
45
178
D/2
14
176
76
2
2

5
315°
22
50
21
27c
27b
26
27a
0°
20
38
27c
3
104
78
30°
27b
26
3
6
27a
15
104
60°
5
12

FIG.5
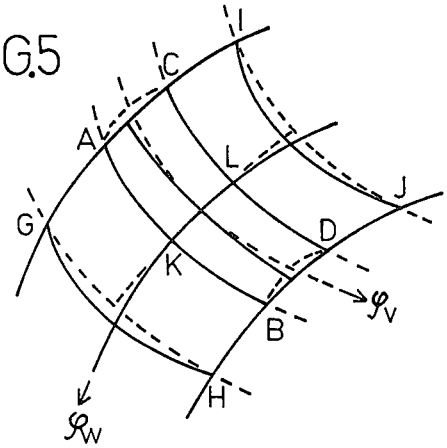
FIG.6
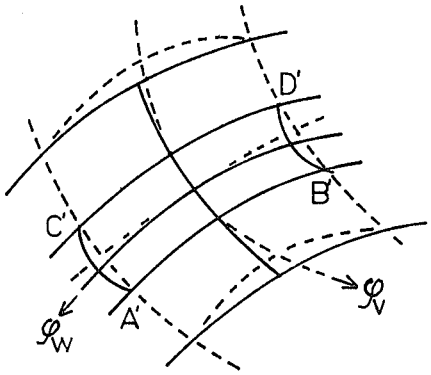
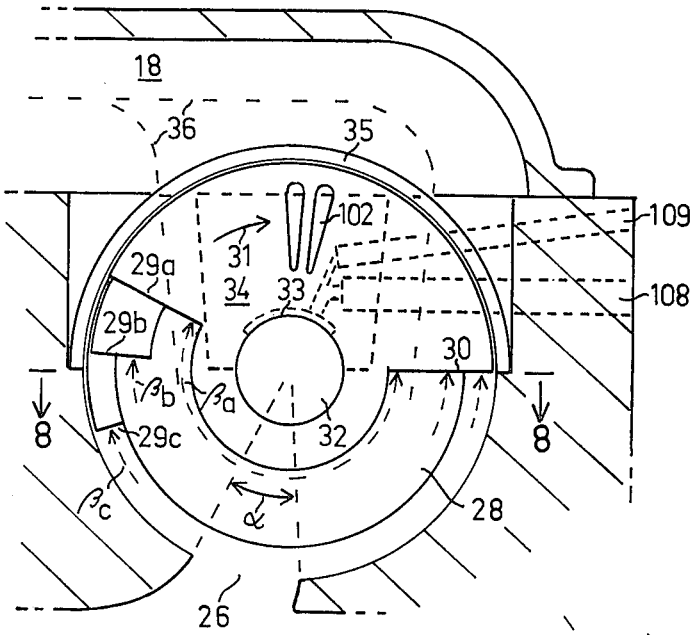
FIG.7
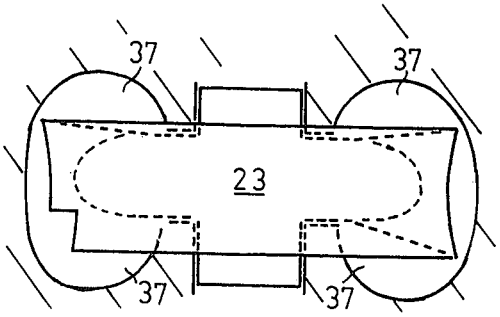
FIG.8

FIG.19
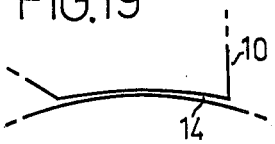
FIG.20
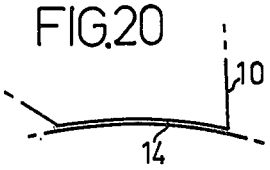
FIG.21
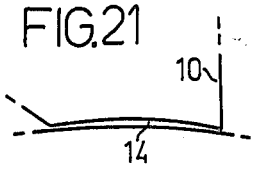
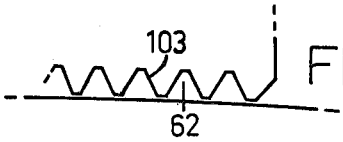
FIG.22
FIG.23
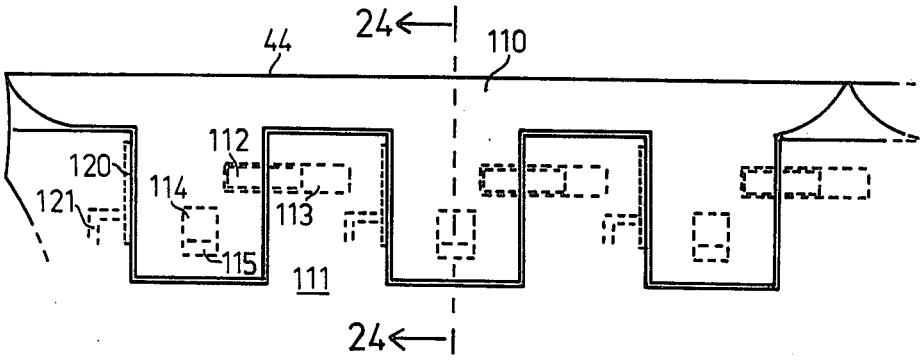
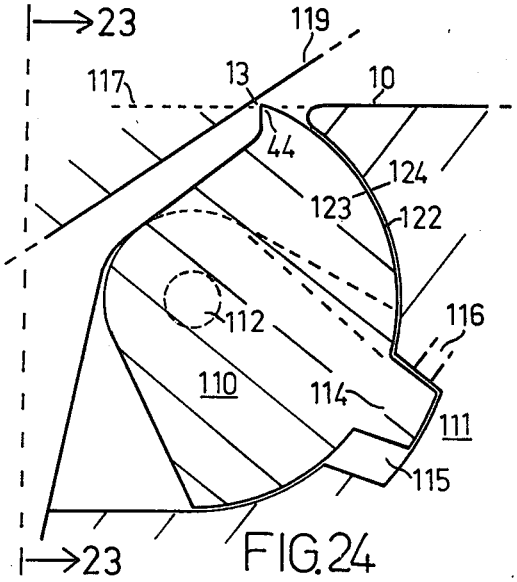
FIG.24
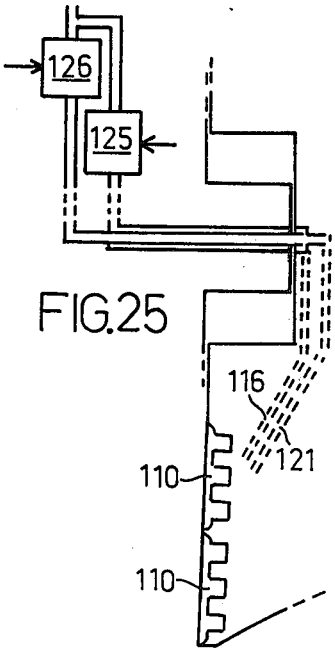
FIG.25

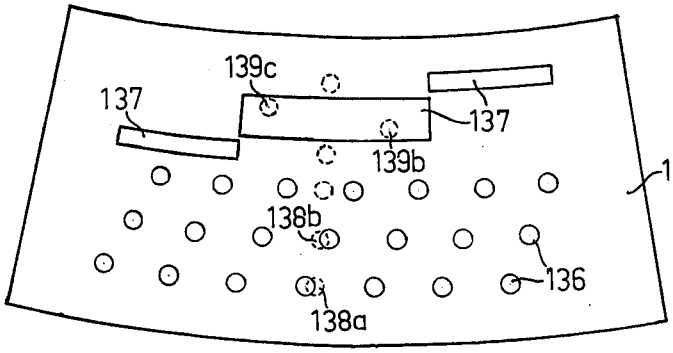
FIG.29
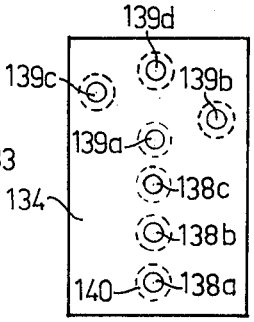
FIG.30
FIG.31
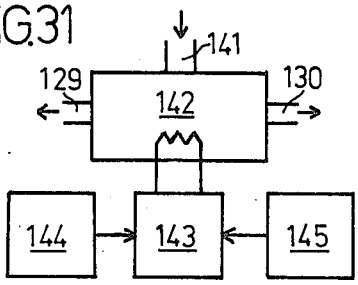
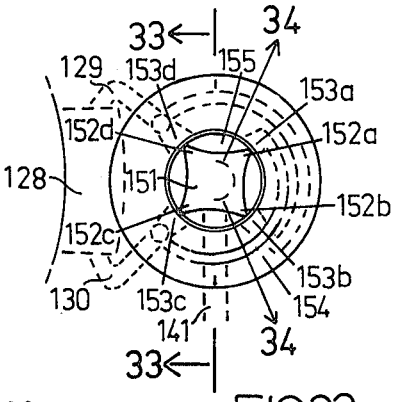
FIG.32
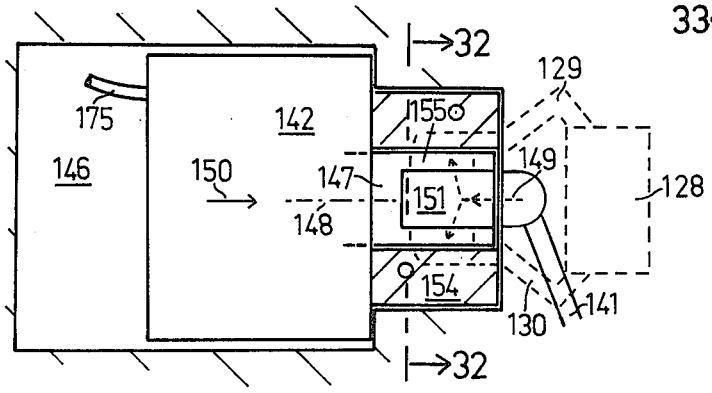
FIG.33
FIG.34
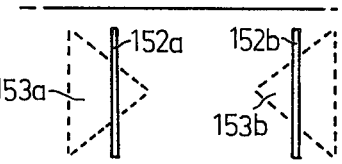

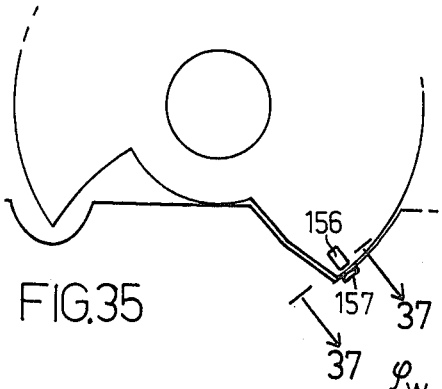
FIG.35
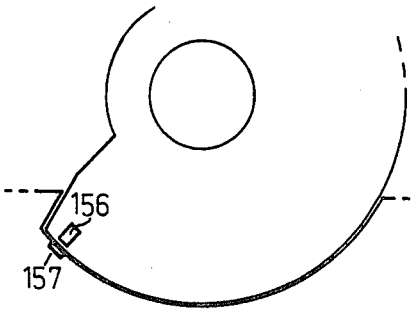
FIG.36
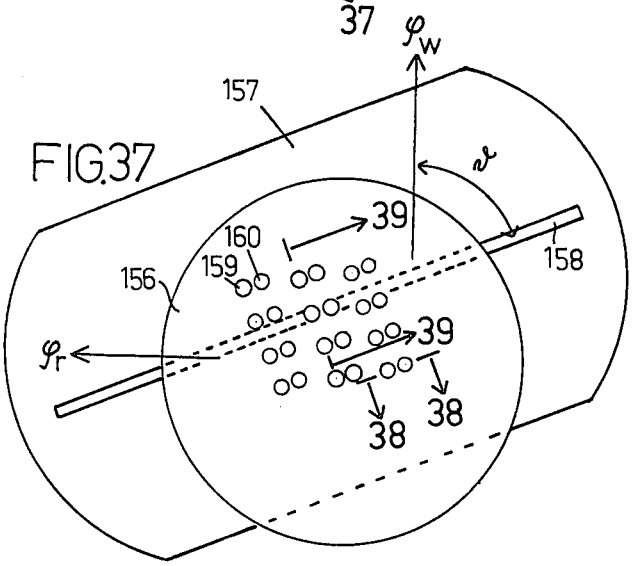
FIG.37
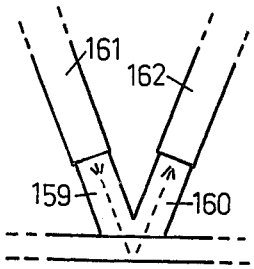
FIG.38
FIG.39
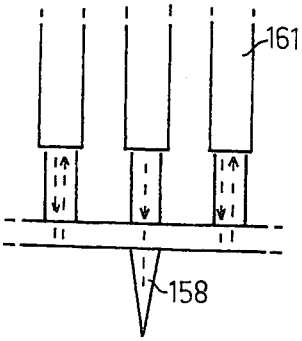
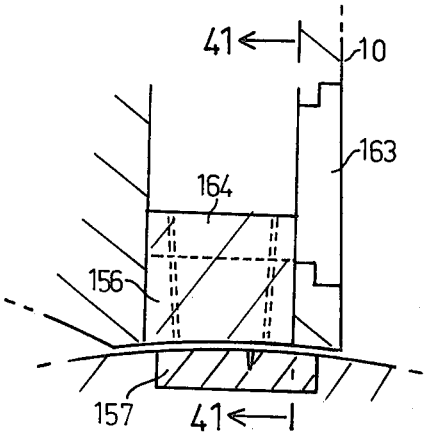
FIG.40

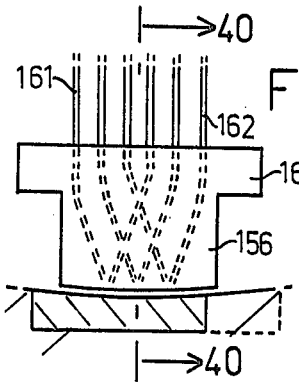
FIG.41
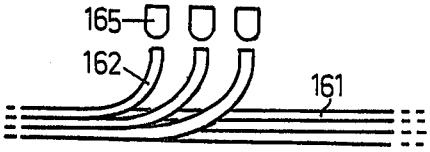
FIG.42
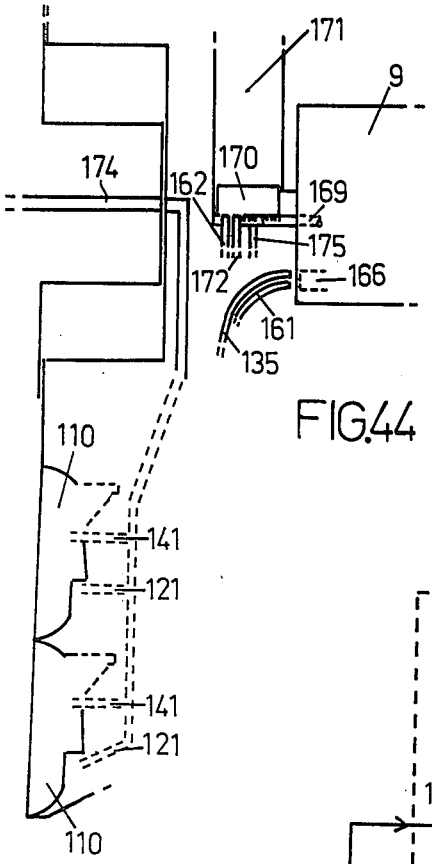
FIG.44
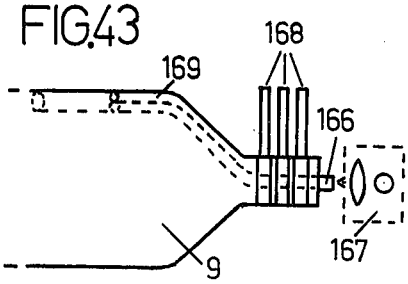
FIG.43
FIG.45
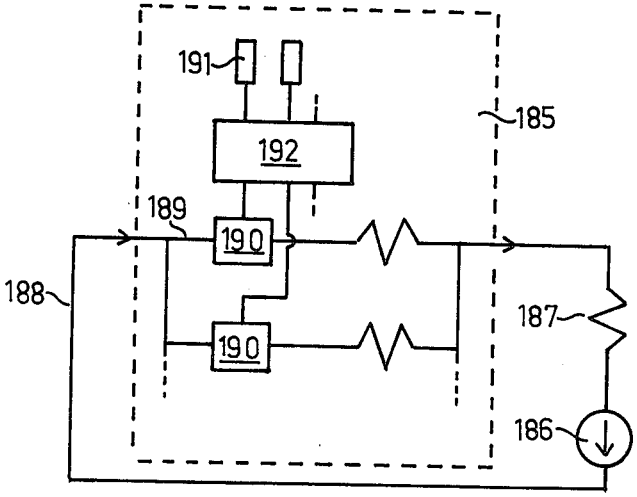

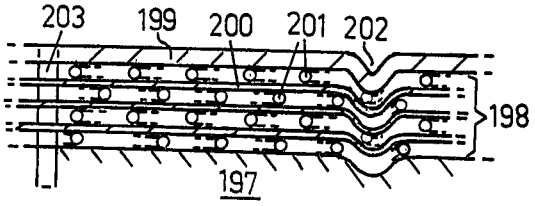
FIG.49
FIG.50
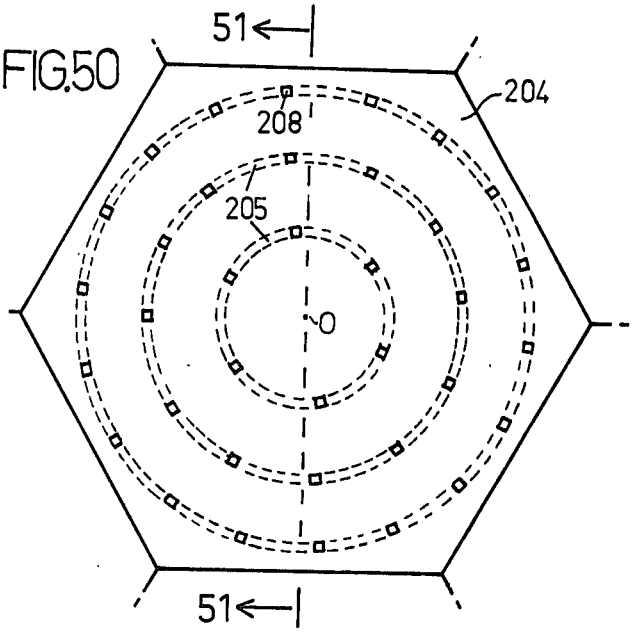
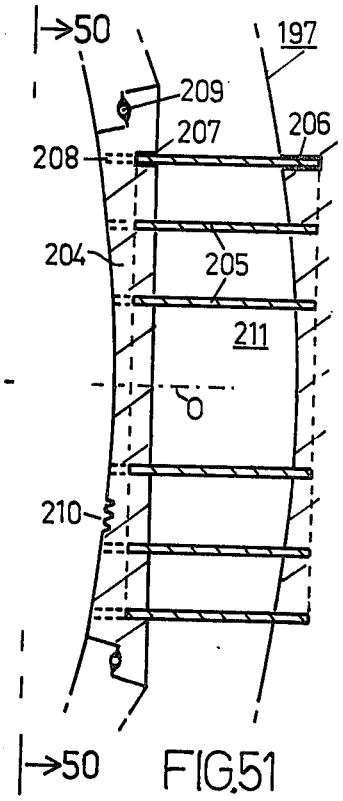
FIG.51
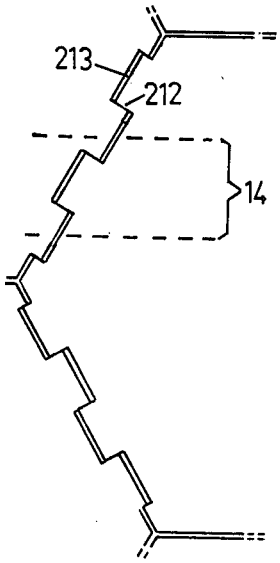
FIG.52
FIG.53
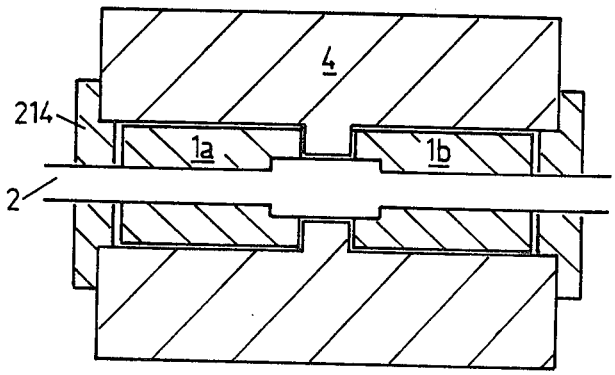

$v_{gv}$
300m/s
200
100
$\varphi_w$
180°
150°
120°
90°
60°
30°
M
$v_{gvc}$
$v_{gve}$
$A_v$
$v_{gv}$
$A_{pr}$
$A_{pr}, A_v$
0,15 D²
0,1
0,05

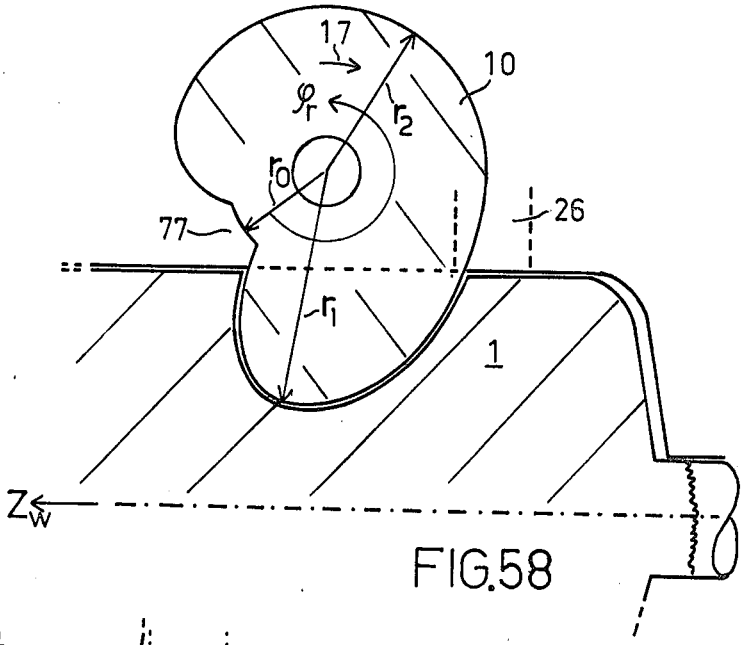
FIG.58
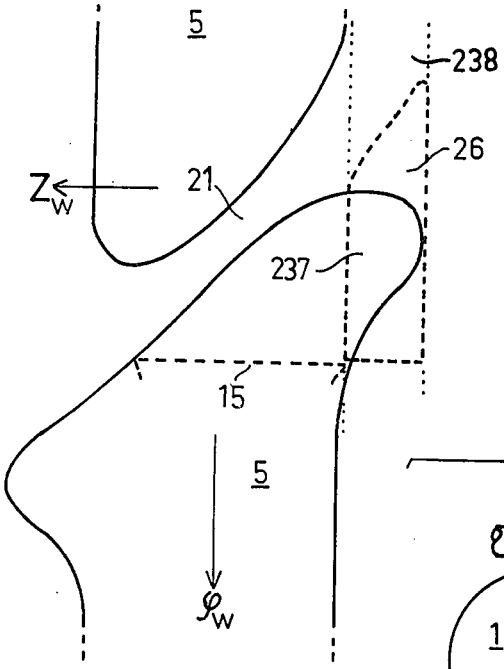
FIG.59
FIG.60
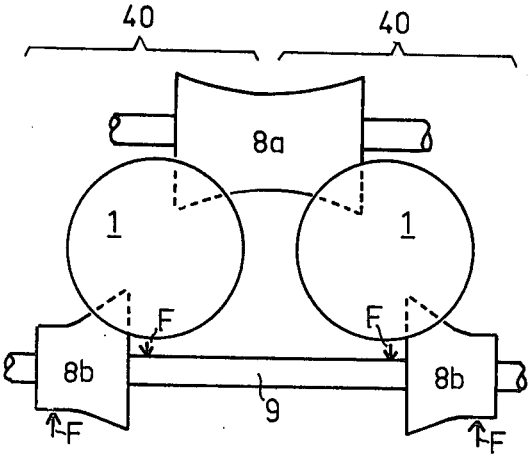

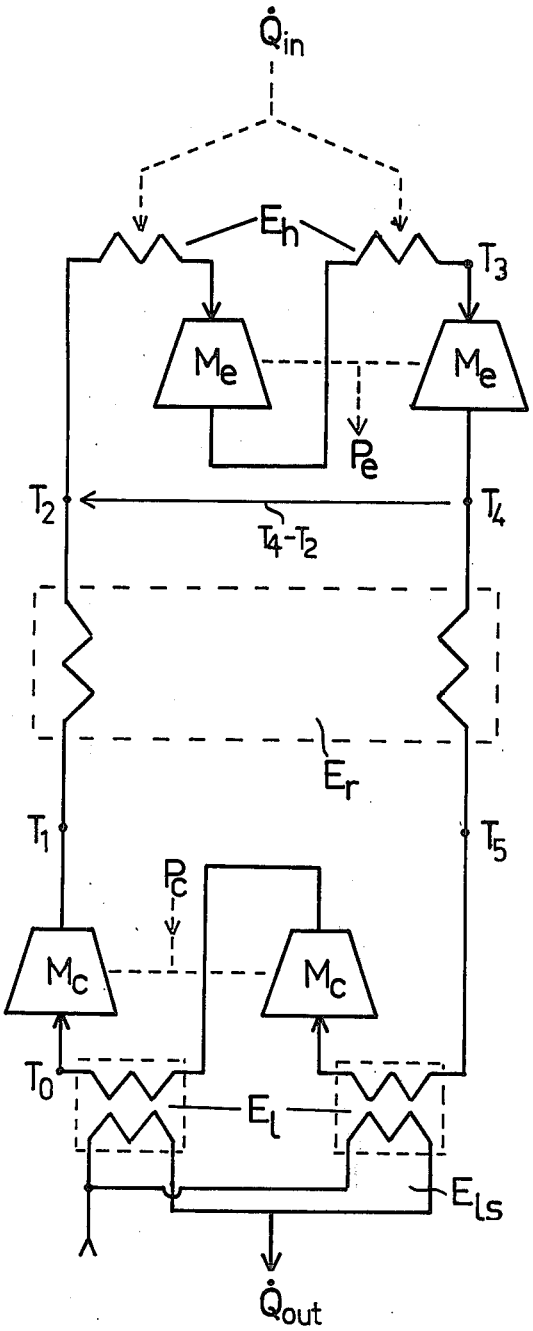
FIG.61
FIG.62
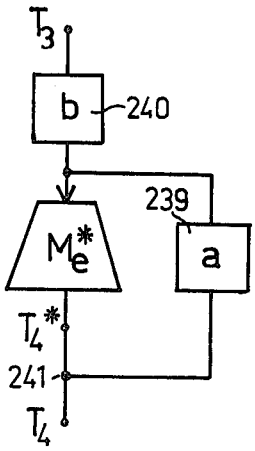
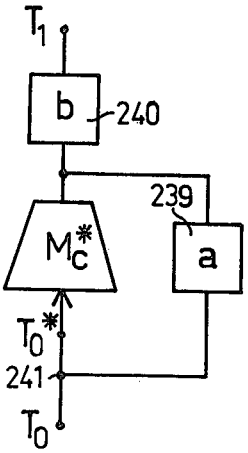
FIG.63

EXPANSION OR COMPRESSION MACHINE WITH INTERENGAGING MEMBERS ROTATING ON PERPENDICULAR AXES

TECHNICAL FIELD

The present invention relates to a machine for expansion or compression of gases or vapours and to a use of the machine for storing and recovering energy. The machine may also be used more generally as an engine or a compressor or in some other machinery involving volume alterations of gases or vapours.

The present invention also relates to perhaps the most important use of the invented machine, namely for storing electric or mechanical energy.

BACKGROUND ART

Machines performing expansion or compression of gases or vapours may be classified into turbo-machines and positive displacement machines. Advantages associated with turbo-machines include great specific power, no need of power transmitting mechanisms, small wear and suitability for use of relatively cheap fuels in connection with a heat power process. Disadvantages include losses of 10–20% in consequence of kinetic way of action, poor suitability for light gases as helium or hydrogen and a necessity to have the first part of a turbine at the maximum temperature of gas or steam in connection with a heat power process.

Typical drawbacks associated with known positive displacement machines include the need of power transmitting mechanisms, low specific power and disadvantages associated with sealing lubrication, namely power losses, temperature limitations as well as rapid wear. On the other hand, types not using sealing lubrication are generally characterized by a great gas leak due to structures where sizes of leaking clearances depend on mutual synchronization between moving members, said synchronization being imperfect e.g. because of free play in gears. The necessity of transmitting power through those mechanisms makes it further more difficult to avoid said play. The lack of possibilities to reduce the speed of gas leak to a value lower than the velocity of sound is another main reason for great losses. Moreover, structures of some machines are suitable for low pressure levels only.

Also, the state of the art does not offer a profitable method for storing electric energy on a large scale, particularly for longer periods. Known possibilities include storing as potential energy by pumping water into a reservoir situating on a higher level, a production of hydrogen, compressed air storage in caves, superconducting magnetic energy storage, flywheel storage and electrochemical accumulators. The drawback of the first mentioned alternative is that a size of a reservoir is so enormous that even diurnal storing would encounter difficulties, not to mention an annual storing. The situtation is quite similar in the case of compressed air storage, which might be fitted for short term storage in some special sites. The only known method suitable for a long term storage would be a production of hydrogen, but its drawback is a poor efficiency due to losses in production of hydrogen, in storing as well as in a heat power process after storing. Also a danger of an explosion and diffuculties in storing in consequence of a low boiling point of hydrogen may be considered serious disadvantages. The other alternatives mentioned are far from profitable, particularly for long term storage.

DISCLOSURE OF INVENTION

All drawbacks mentioned above may be avoided by utilizing the machine in accordance with the present invention. The present machine is characterized by small losses, no need of power transmitting mechanisms, in certain applications even a very great specific power, good suitability for light gases, small wear, no need of sealing lubrication and good suitability for high pressure levels as well as for various temperature levels.

One possible and at the same time important application of the invented machine is the use of a component in heat power processes. By now, a steam power plant with turbines as engines is dominantly used for accomplishing an elctricity producing heat power process having a high annual degree of use, because in said case it is important to achieve good efficiency and to use as cheap heat energy as possible. To maximize electric efficiency a condensing turbine must be used having an outlet pressure of about 0.04 bars only. Due to a low medium pressure the specific power of a turbomachine in the application mentioned is not so good despite a great volume flow. A closed gas process, e.g. Brayton-cycle, may include three important advantages as compared with a steam process called Rankine cycle. Firstly, in a closed gas process the pressure level may be chosen freely, resulting in a great specific power even with a moderate volume flow, if the pressure level used is high enough. Secondly, a gas process has no limitations of steam as for temperature scale usable. Thirdly, if a Brayton-cycle is used, the waste heat of the process is released in a form usable for low or medium temperature purposes, as heating or water distillation, without any need for compromizing between electric efficiency. The reason why a gas process is not widely used in this field lies in the fact that the only machine suitable for the process known heretofore has been a turbo-machine having so great losses that the efficiency of the gas process would remain essentially lower than that attainable with a Rankine cycle. If alternatively the invented machine were used as engines and compressors in a gas process using Brayton-cycle, provided with a heat exchanger between hot and cold sides, the efficiency attainable would be comparable with that of the steam process. Additionally, if the temperature range utilized were extended over that used in connection with a water steam process, an even considerably higher electric or mechanical efficiency than earlier could be achieved. Furthermore, the waste heat would be in a suitable form for various purposes. Heat energy used in a closed process may naturally be originated from any source. Thus, besides fuels, also solar or nuclear energy might be utilized.

One reason that would facilitate the use of a higher maximum temperature than earlier at least in some applications is the advantage offered by the invented machine, namely that in contrast to turbine, essential structures of the invented machine need not be at the maximum temperature of the working gas, but in the case of a Brayton-cycle with a heat exchanger between hot and cold sides, said structures may be at the temperature of the working gas after expansion or remarkably lower, even near ambient temperature.

The invented machine might be very advantageous in solar energy applications, because it can be manufactured as a smaller unit than a turbine and still have a good efficiency as well as good specific power. The weight of the machine per unit power is remarkably lower than that of a condensing turbine. As by using Brayton-cycle also a waste heat of the process is released in a useful form, all heat energy focused onto an absorbator by using mirrors could be utilized, partly as electicity, partly as heat. Thus there would be better changes than earlier to make profitably heliostats reflecting radiation onto an absorbator.

The invented machine with low losses may be valuable also in certain heat pump applications, e.g. for utilizing some low temperature waste heat or for air conditioning.

The invented machine fits particularly well to the purpose of storing energy, first of all due to minimum losses involved with the machine, and also due to good suitability for light working gases such as helium. Without the invented machine it would not be possible to carry out the storing process in a profitable form.

The storing process in accordance with the invention would be particularly advantageous in connection with use of solar, wind or wave energy. The drawback associated with these alternative energy sources is a temporal variation of production. If the storing of energy is not arranged, the role of the alternatives mentioned is restricted to a partial saving of fuels, because then a full capacity of other types of power stations must exist.

By using the process in accordance with the invention a considerably higher efficiency of storing may be achieved than in the hydrogen alternative. Additionally, the invented method may be regarded harmless due to very simple materials used. The process is suitable also for annual storing, which is an important aspect especially when solar energy is used. With the aid of the invention it is possible to base energy production even totally on solar energy. For supplying needs of vehicles the stored energy can be converted into some fuel, e.g. hydrogen. Even in this relation the invented process would be advantageous in eliminating the need for large hydrogen reserves, because a conversion into hydrogen may be done fairly well in time with consumption.

The invented machine is of positive displacement type having rotating moving parts. Expansion or compression is performed within the machine in periodically closing spaces, the volumes of which are varying periodically. No power transmitting mechanisms are necessary, but a torque caused by gas forces can effect directly a rotating working member and thus also a power shaft firmly connected to said member, the aspect mentioned being extremely important especially in the case of a high-power machine. Gas forces loading the rotor are symmetric in such a way that the only forces effecting the corresponding bearings are orginiated from the weight of the rotor, whence friction losses in the bearings remain unessential, particularly in connection with a closed process with a high pressure level. No sealing lubrication is used, but clearances are kept so small and the speed of rotation so high that gas leak remains relatively small. The speed of rotation can be selected so that relative importance of kinetic energy of the gas remains unessential.

The invented machine includes a body structure defining at least one rotation space therein, a working member rotatably mounted within said rotation space, one portion of the working member facing the surrounding body forming, together with the surrounding body, at least one working space moving with the working memeber circumferentially, and another portion of the working member being provided with at least one separating wall extending close to the wall of the rotation space. One functional basic unit of the machine includes n rotating reacting members equally distributed around the periphery of the rotation space in such a way that each reacting member is rotatable around its own axis, which is essentially perpendicular to the rotation axis of the working member and preferably situated totally outside the rotation space of the working member. Within each functional basic unit the number of aforesaid working spaces situated one after another in circumferential direction is equal to the number of said reacting members or to an integral multiple thereof.

Each reacting member extends partially into the rotation space of the working member and has a part, which forms a transversal partition wall dividing the working space in question into two parts, a process space and a transferring space, respectively, the volumes of which vary periodically according to rotation of the working member. Said partition wall forming part is shaped to have one, at the most two rotation sectors, called in the following transition sectors, in which the distance of the outer edge line to the rotation axis of the reacting member has a minimum value. The machine also includes flow conduits in the body structure for the inlet and outlet of gas or vapour and at least one first opening in the body part surrounding the rotation space on the process space side of the partition wall for providing connection between the process space and the corresponding flow conduit, and at least one second opening positioned in the body structure on the transferring space side of the partition wall for providing connection between the transferring space and the corresponding flow conduit.

The machine further includes means for closing periodically the said first opening and synchronizing means interconnecting said working member, reacting members and closing means so that the connection between the process space and the corresponding flow conduit is established during such a part of the process cycle, during which the working space moves circumferentially over a certain distance, at one end of which the partition wall is in the process space end of the working space and that once for each process cycle a passage of one separating wall of the working member through one transition sector in the partition wall forming part of the reacting member is established.

The working member rotating around its middle axis may be firmly connected to a power shaft or they may be originally made of one single body. In an alternative embodiment an electric machine may directly load the working member, in which case the role of the shaft, if any, is only to support and position the working member.

Reacting members of one functional basic unit are situated at equal positions in the direction of the rotation axis of the working member and in the direction of the circumference thereof at intervals of an angle of 360°/n, in other words the whole circle divided by the number of reacting members. In the foregoing definition n is a positive integer, one or greater. In a preferred embodiment n=2, which is already resulting in a symmetric construction and avoiding of transversal reaction forces on the power shaft. The partition wall forming part of the reacting member is in practice a surface, which joins a fictive surface of revolution in relation to the rotation axis of the reacting member. A transition gap permitting a passage of the separating wall in the working member there through in connection with change of the process cycle is situated at a certain rotation sector of the partition wall forming surface.

Working spaces of one functional basic unit are situated one after another in the circumferential direction of the working member and, in contrast to a screw-compressor, so that their main direction joins with said circumferential direction. The working spaces are situated at equal positions in the direction of the rotation axis of the working member and in the circumferential direction at intervals of an angle, which is the whole angle divided by the number of reacting members or by an integral multiple of it.

Within one functional basic unit subsequent process cycles form a continuous train, since all reacting members of said unit preferably operate in the same phase.

If the reacting member is provided with one transition sector, one revolution of the said member corresponds to one process cycle, whereas one revolution of the working member corresponds to the number of cycles equal to the number of working spaces one after another.

The process space being closed, an expansion or compression process takes place inside it depending on the direction of the rotation of the working member. During one process cycle the volume of the process space in expansion use increases from zero to a maximum value, and correspondingly in compression use decreases from a maximum value to zero. When changing from one process cycle to the following a sudden change occurs, because the reacting member is then passing to the following space over a separating wall in the working member. Due to rotating members used, a relative circumferential movement of the partition wall in the working space takes place always in the same direction as far as a certain process is concerned. In expansion use an increase of volume in the process space is accompanied by a corresponding diminishing of volume in the transferring space. Accordingly, during each cycle gas expanded during the previous cycle is forced away from the transferring space into the corresponding flow conduit. Correspondingly, when the machine is used as a compressor, during each cycle new gas is sucked into the transferring space from the corresponding flow conduit. During the next cycle the same gas amount is exposed to a compression process, being then pushed over the valve point into the flow conduit corresponding to the process space.

The flow between the transferring space and the corresponding flow conduit may in practice occur through that opening in the body surrounding the rotation space of the working member, through which also the corresponding reacting member is extending into the working space in question.

One main advantage associated with the invented machine is that the reacting member does not require work for its rotation, but is rotating freely. To obtain this, the rotation of the reacting member is transversal in relation to the movement of the working member and working spaces moving therewith, and a higher pressure of the process space has effect only on a surface of the reacting member, which is a surface of revolution in relation to the rotation axis of the reacting member. The former aspect means that the movement of the reacting member does not positively alter the volume of the process space. The latter aspect in turn means that a gas pressure difference cannot cause tangential forces upon the reacting member and thus no torque is created.

In a preferred embodiment of the invented machine the rotation space of the working member has a cylinder-like general form. Working spaces are then circumferentially situating channels in the working member. One functional basic unit of a preferred embodiment is consisting of two working spaces one after another around the circumference of the working member, whence the said spaces are situating on the opposite sides of the working member symmetrically in relation to the middle axis. As the both side edges of the channel are at equal distances from the rotation axis of the working member, axial forces to the working member are avoided. One functional unit of the embodiment mentioned is provided correspondingly with two reacting members situating on the opposite sides of the rotation space symmetrically in relation to the rotation axis of the working member.

It is essential that in the invented machine it is possible to form the reacting member so strong that it is able to transmit outside the rotation space of the working member concrete forces caused by a pressure difference between process and transferring spaces. Consequently, the machine may be used at high pressure level. It is possible to compensate reacting forces with a pressure effect programmed to be properly temporally variable during the process cycle. The compensating force can be directed to an opposite surface of the reacting member, said surface being situated outside the rotation space of the working member. One object of this invention is to provide a programmed compensation, in which in principle no energy is consumed. In one alternative embodiment there may be used several parallel working members with reacting members situated between them so that reacting forces compensate each other.

In one preferred embodiment the reacting members can have end surfaces, which are surfaces of revolution in relation to the rotation axis of the reacting member, one end surface serving as a surface to form a partition wall and the other serving as a surface for pressure compensation. The reacting members would then be continuous strong bodies, only somewhat thinner between said end surfaces and thus they could transmit reaction forces nearly in the direction of the rotation axis of the reacting member.

The partition wall forming part of the reacting member may be a plane surface, the normal of which is parallel to the rotation axis of the reacting member, or it may be a somewhat conical surface of revolution in relation to said axis. In a preferred embodiment of the invented machine the partition wall forming surface is provided with one transition sector with a minimum distance of edge line to the rotation axis of the reacting member. This transition sector may cover about $\frac{1}{4}$ of the whole angle. In the remaining sector, covering about $\frac{3}{4}$ of the whole angle, the distance of the edge line to the rotation axis of the reacting member has a constant maximum value. The shape mentioned is advantageous in several respects. Firstly, the distance of the edge line from the rotation axis being constant, the corresponding clearance between the working member and the reacting member does not alter in consequence of errors in synchronization between movements of said members. Thus, there are ideal conditions for maintaining the clearance small. In addition it is possible to form the clearance so long in a direction of leak that reduction of a velocity of leaking gas is possible. A small clearance and a reduced velocity together result in low gas leak through this leakage path. The only part of the mentioned edge line, the corresponding clearance of which depends on the synchronization of rotating members, is a short path situated quite radially in relation to the rotation axis of the reacting member and having as its countersurface in the working member the end surface of the process space. The direction of the edge mentioned is advantageous for providing said edge with a relatively light sealing member capable to move slightly in relation to the body of the reacting member. Thus, one object of the present invention is to provide a sealing member, which by a slight turning movement in relation to the reacting member can compensate errors in synchronization between the working and reacting members. The movement of the sealing edge thus effected is practically identical with that caused by the rotation of the whole reacting member, whence theoretical possibilities even to an ideal sealing do exist.

The sealing member can also be constructed so that centrifugal forces do not influence its movement. Accordingly, required movements can be effected with an insignificant power consumption taking also in consideration the lightness of the member as well as a low absolute speed due to a small distance of movement needed. In the specification is also presented a method for measuring precisely a momentary error in synchronization between the working and reacting members. The possibility mentioned can be utilized when controlling movements of the sealing member in order to compensate errors in the said synchronization.

One essential demand, which this type of machine performing compression or expansion with minimal losses must fulfill, is that valve function must be carried out so that a dead space in front of a valve must be small enough. In the invented machine the dead space may be negligible. Moreover, in the preferred embodiment of the invented machine the total area of the valve opening is of the same order as the maximal area of the partition wall corresponding to the area of a piston in a conventional piston machine. The invented machine might be characterized by saying that a speed of the "piston" is constant but the area of the piston is different in different phases of process cycle. In the preferred embodiment the momentary areas of valve openings and the paritition wall increase during the expansion cycle quite synchroneously beginning from value zero to certain maximal values of the same order. Acccordingly, the velocity of gas in the valve opening need not rise essentially higher than the effective speed of the piston, thus resulting in small losses in the valve opening. Also during the closing period of the valve in expansion use only small losses result in the valve, since the closing action is rapid and the relative change of volume of the process space during said period is small.

In a preferred embodiment of the invented machine periodical closing of openings belonging to the process space is provided by means of rotating valve members mounted into the body structure so that a rotation axis of the valve is situated in a normal plane of the rotation axis of the working member, the plane of rotation being directed at least approximately towards the said axis of the working member. In the case of the preferred embodiment there are two openings situated one after another in circumferential direction of the working member. Each of them is provided with a valve member, so constructed that it functionally corresponds to three true valve members one after another. In the preferred embodiment the total opening of the valves may be as large as on the whole is reasonable for diminishing pressure losses in said opening. Consequently, a circumferential speed of the working member is possible to keep as great as possible resulting in a minimum time of one process cycle and consequently in minimum leakage during one cycle.

In another embodiment of the invented machine a use of actual valves may be avoided by basing the valve function upon the rotational movement of the working member. In that case the working member itself closes the opening, which is situated in the body of the machine. For this purpose that part of the reacting member which forms the partition wall has been shaped so that the edge line of the surface extends at one rotation sector farther off from the rotation axis of the reacting member, while the part of the working space corresponding to the mentioned sector extends so far in the direction of the rotation axis of the working member that only that portion extends to the position of the opening in the body of the machine. When said portion of the working space is turned to the position of the opening, a connection between the process space and the corresponding flow channel is created. The pressure ratio attainable by this embodiment is small but it might be adequate just for the most important purposes.

One embodiment of the invention may result in even a very great pressure ratio. In this embodiment the rotation space of the working member is provided with a projection portion surrounding the main portion of cylinderic form. The partition wall part of the reacting member is then formed to extend only into said projection part during those periods when the valves are open. On the other hand, when the valves are closed, the reacting member extends also into the main portion resulting in a large effective piston area and consequently in a great working volume.

A further object of the invention is to present how heat losses into the walls of the machine may be reduced to a small value. Inner walls of the machine may be classified into two main categories. One group is characterized in that no precise dimensioning of walls is necessary and that gas passing by the said surfaces has not temperature variation during a process cycle. In the invented machine the surfaces mentioned may be provided with a heat insulation structure, the extreme surface of which is practically taking the temperature of the gas, whence heat exchange between gas and walls is small. The walls participating in the formation of the process space are characterized in that precise dimensioning is required and also the temperature of gas varies during the process cycle. Certainly, in the preferred embodiment quite a low pressure ratio is used, resulting consequently in quite a moderate temperature variation only. If the temperature of gas is not high in the application in question, those surfaces may be kept e.g. at the mean temperature of gas, thus resulting in a net heat exchange between gas and walls to be zero. During each process cycle some amount of heat exchange to and fro then takes place, the phenomenon being quantitatively unessential, however. If the temperature of the gas is high, walls of the process space may be cooled beneath the mean temperature of the gas, e.g. to the temperature of the gas after expansion, or to a remarkably lower value, even near ambient temperature without an excessive rise in heat losses.

One object of the invention is to present how also surfaces of the process space may be provided with an internal heat insulation layer and how even iron material may serve as an insulator. This kind of solution may become into question specially if very high gas temperatures were used. The surface of the insulation layer would then take some temperature between the mean temperature of gas and the internal temperature of structures surrounding the process space. The same construction may also be used if the temperature of working gas is considerably under ambient temperature.

Because sealing lubrication is not used in the invented machine, corresponding friction losses occuring in conventional piston machines can be avoided. Losses in bearings may be kept negligible, especially if a high pressure level is used in a closed process and at the most weights of rotating members are loading the bearings. Forces loading reacting members as well as valve members may be compensated by means of a pressure effect, which may be arranged in a way which in principle does not consume energy at all. Possible mechanisms synchronizing the rotations of the working and reacting members cannot involve great power losses, because reacting members do not require work for their rotation. Also heat exchange between working gas and surfaces can be maintained small or negligible. The remaining loss factors are gas leak and pressure losses involved with the flow of working gas. These two loss factors are most essential also in the sense that the machine being connected as a component of a process, effects of losses of these types are reflected to operating circumstances of other machines of the process.

If principal loss factors are a gas leak and pressure losses, then relative losses in one machine can be expressed by an equation $\delta = A/v_R + B\ v_R^2$, where $v_R$ = circum speed of working member, to which also a speed of working gas is proportional. The first term denotes gas leak and the second pressure loss. The relative gas leak is proportional to the time of the process cycle and thus inversely proportional to circum speed. Derivation gives an optimal speed $v_{R,opt} = (A/2B)^{\frac{1}{3}}$. Consequently, the minimum of losses is $\delta_{min} = 2^{\frac{1}{3}}A^{\frac{2}{3}}B^{\frac{1}{3}} + 0.5 \times 2^{\frac{1}{3}}A^{\frac{2}{3}}B^{\frac{1}{3}} = 1.5 \times 2^{\frac{1}{3}}A^{\frac{2}{3}}B^{\frac{1}{3}}$. As the absolute pressure loss is proportional to density or in case of ideal gas to the factor Mp/T, and the capacity of a machine is proportional to pressure p, factor B may be presented in a form $B = k_2M/T$, where M = molecular weight and T = absolute temperature.

If a dominating gas leak takes place through a clearance having a great conductance, the velocity of leaking gas will be determined principally by characteristics of the gas, its temperature and the pressure ratio over the clearance. If factors taken explicitely into consideration are absolute temperature T, molecular weight M, absolute size s of the clearance and diameter D of the working member as a characteristic measure of the machine, then by using proportionalities $A_1 \sim sD$, $V_p \sim D^3$, $t \sim D$ and $v_{gl} \sim (T/M)^{\frac{1}{2}}$, where $A_1$ = cross-section area of the leaking path, $V_p$ = volume of working space, t = time of one process cycle and $v_{gl}$ = velocity of leaking gas, factor A may be presented in the form $A = k_1(s/D)\ (T/M)^{\frac{1}{2}}$. Insertion of formulae for A and B gives the optimum circum speed $$v_{R,opt} = |(k_1/k_2)(s/D)|^{\frac{1}{3}}(T/M)^{\frac{1}{2}}$$

and a proportionality for the minimum of losses $\delta_{min} \sim k_1^{\frac{2}{3}}k_2^{\frac{1}{3}}(s/D)^{\frac{2}{3}}$. Consequently, the minimum of losses would be independent of pressure, temperature and molecular weight. However, use of light gases would result in a higher optimum speed and consequently in greater specific power. The minimum of losses would be proportional to power $\frac{2}{3}$ of the size of the relative clearance.

If the total length of the sealing point in the direction of gas leak is great enough compared with the clearance, the leaking speed may be reduced by a labyrinth sealing including numerous throttling points one after another, because then the pressure ratio over each throttling point would become small. If L = total length of the sealing point in the direction of gas leak, for the number of throttling points would be valid a proportionality $n \sim L/s$, where s = an absolute size of the clearance. If the number of throttling points is great, a proportionality $v_{gl} \sim n^{-\frac{1}{2}}$ is valid, resulting in a proportionality $v_{gl} \sim L^{-\frac{1}{2}}s^{\frac{1}{2}}(T/M)^{\frac{1}{2}}$, which may be applied to the equations presented earlier thus resulting in a proportionality $\delta_{min} \sim L^{-\frac{1}{3}}D^{-\frac{2}{3}}s$ for the minimum of losses. The minimum value would then be proportional to the clearance. Even now the minimum would be independent of pressure, temperature and molecular weight. If, on the other, hand the machine includes continuous clearances having a considerable length in the direction of gas leak, a friction in the clearance may reduce the speed of leaking gas, if the clearance is narrow enough and the absolute pressure difference over the clearance small enough. If friction is a reducing factor, the proportionality $v_{gl} \sim s^2\Delta p/\mu L$ is valid, where $\Delta p$ = the absolute pressure difference and $\mu$ = dynamic viscosity of gas. If a leak through this kind of clearance were dominant, a proportionality $\delta_{min} \sim (\Delta p)^{\frac{2}{3}}(\mu LD)^{-\frac{2}{3}}(M/T)^{\frac{1}{3}}s^2$ would be valid. Then the minimum of losses would be proportional to the square of the clearance.

In the foregoing there are presented three relationships for the minimum of losses. The relationships may be interpreted so that the power $\frac{2}{3}$, 1 or 2 of the size of the clearance is a measure for the merit of the machine. However, several factors effecting losses are implicitely involved in the coefficients of the relationships presented and values of these factors may be different in different machines. These factors include aspects influencing quantitative pressure losses, such as shape of working space, relative size of valve opening and closing or opening time of valves. Factors effecting gas leak include in addition to size of clearance and speed of gas leak, also a relative length of the leaking line and time of process cycle, which is a function of the shape of the working space. The $\frac{2}{3}$-power relationship derived may be applied also to some known machines, as to a screw-compressor not using sealing lubrication. Theoretical calculation as well as experience prove that losses are at least as great as in the best turbomachines. The structure of the invented machine is so advantageous that there are reasons for using also the second or the third relationship presented for the minimum of losses for evaluating the merit of the machine. To maximize the advantage mentioned, one purpose of this invention is to set forth a machine, the clearances of which can be controlled during running for maintaining them at minimum values. As to the merit of the machine, most essential is the clearance which exists through the dominant part of time during operation, short term deviations having no significance from an energetic point of view. Thus, a machine having a possibility to control clearances is superior as compared with machines with fixed clearances, the dimensioning of which must be made by considering a possibility of jamming in the most unfavourable combination of circumstances.

If it is desired to accomplish an expansion machine or a compressor having losses of at most some percents, turbo-machines using a kinetic way of action are excluded, because then a very high gas velocity as well as narrow flow channels must be used. Losses depend on forming the channels and on a friction factor which can be influenced only by the smoothness of surfaces. Compression and expansion efficiencies in the best turbo-machines are 0.85–0.90 and possibilities for raising the efficiency are insignificant. Also positive displacement machines using sealing lubrication are excluded, because friction of oil is of significant order, in particular if speeds used correspond at least to a tolerable specific power.

In order to obtain minimum losses a machine of positive displacement type not using sealing lubrication should fulfill the following conditions: (1) the size of clearances should not depend on a mutual synchronization of moving members, (2) the structure of the machine should be of the kind that members having effect on clearances do not bend in consequence of unsymmetrical gas forces, (3) lengths of sealing points in the direction of gas leak should be so great that the speed of leakage can be reduced, (4) clearances of the machine should be controlled during operation for keeping them at minimum values, (5) a cross-section area of the flow channel in the point of a value function should be of the same order as in other parts of the working space, (6) opening and closing operations of the valve function should be rapid enough and (7) geometry of the working space should be advantageous so as to have a great cross-section area and a relatively short length in the direction of gas flow.

Condition 1 should be fulfilled before condition 4 could be applied because accomplishing a stable control system for regulating mutual movements of massive fast moving bodies with an extremely high precision is not possible.

Known machines do not fulfill the conditions presented. For example, a screw-compressor does not fulfill conditions 1–3, neither conditions 6–7. Consequently, both theoretical calculations and experience reveal that losses in a screw-compressor not using sealing lubrication are at least as great as in the best turbo-machines. Also various constructions of Wankel-type are characterized by a great gas leak at the corners of the piston, due to need of synchronizing the rotations of the piston and the shaft by using inside gears.

As a theoretical example of a machine, which would not fulfill condition 4, it may be mentioned a construction resembling a turbo-machine in the sense that if it were desirable to adjust the clearance between vanes and the body of the machine very narrow, the control action should be turned to each vane individually, which would be impossible already due to a large amount of vanes. In real turbo-machines a more dominant factor is that as the heat capacity of vanes is negligible as compared with that of the body, after starting the vanes are warming up rapidly, thus resulting in a temporary narrowing of clearances.

As in the known machines clearances are great, also possibilities to reduce speed of gas leak are poor, because a necessary length of the sealing point in the direction of gas leak in the case of a labyrinth seal is proportional to the clearance, and if a friction of leaking clearance is utilized, proportional to the square of the clearance.

The preferred embodiment of the invented machine is accomplishing the conditions presented as well as it is on the whole possible. The reacting member of the machine includes a short portion of the edge line of the partition wall forming surface, the size of the clearance corresponding to it is dependent on the synchronization of the working and reacting members, but the geometry of the machine is so advantageous that the edge mentioned can be provided with a light sealing member capable to move in some extent in relation to the body of the reacting member. Thus, the problem of synchronization can be divided into two successive phases. Then for the rotation of the reacting member is required only a rough synchronization, and the actual sealing is accomplished by means of the sealing member, which need to move perhaps only a fraction of a millimeter is relation to the body of the reacting member. Thus, the frequency of the movement may be high and nevertheless the speed of movement as well as kinetic energy needed may remain low. Also the relative precision required for the movement is not high. Consequently, one possibility is to base the movement of the member on a prediction made on the ground of a precise measurement of error in synchronization between working and reacting members. Alternatively, the movement of the sealing member might be limited to the counter-surface situating in the working member. To prevent wearing a real mechanical touch may be avoided by using small gas streams conducted through the sealing member to some points of the sealing line. As the reacting member does not need work for its rotation, it is easy to maintain the speed of rotation usually perfectly constant. A possible unidentity between torque curves of the invented machine and a machine connected to it, as an electric generator or motor, may cause a minute fluctuation of the rotation speed of the working member, but it can be taken into account beforehand in designing the shape of the counter surface situating in the working member. Thus, in order to prevent energetic losses, movements of the sealing member are needed only if additional disturbancies occur, the influence of which cover a considerable part of the total operating time.

In the invented machine the control of clearances, sizes of which do not depend on the mutual synchronization of moving parts, can be arranged to take place during operation, the machine being provided with temperature control systems for regulating temperatures of the members of the machine properly. Since the machine includes only a few members of quite unbroken masses, the temperature control can be accomplished by quite a small amount of control units. It is presented later in the specification, how the temperature control can be arranged even into the rotating members of the machine. As coefficients of thermal expansion in the case of metals are of the order of $10^{-5}$1/°C., a temperature change of 1° C. means for a distance of 0.5 m a change of 5 μm in the corresponding clearance. Thus there are theoretical conditions to control even remarkably smaller changes of distance than is necessary in this application, because temperatures may be measured and also controlled even remarkably more precisely than 1° C. As thermal expansion is a slow phenomenon, there is no fear of instability in the temperature control systems. The control of clearances may surely be based on measuring temperatures of respective parts, at least if slow changes are taken into account by checking measurements at times, and subsequent adjustment of the control system. Of course, it is also possible to use sensors measuring directly clearances as components of the control system. The control may be alternatively based on local control of a sealing construction proper at least for some clearances of the machine.

The precision of the bearings of the machine is partly determining, how small clearances may be used. In the invented machine possibilities for using precise bearings are very good. No forces in excess of those originating from the weight of a rotating member need to be directed to the corresponding bearing. If desired, even those forces may be compensated by a pressure force elsewhere than in the bearings determining the position of the rotating member. All rotating members are so firm that bending of the corresponding shaft at the point of the member is impossible and the bearings may be situated immediately on both sides of the member. A use of temperature control systems eliminates a formation of free play in bearings due to uncontrolled thermal expansion. In all applications the essential structures of the machine can be kept near ambient temperature, whence e.g. precise roller bearings can be applied. On the other hand, if aerostatic bearings were used, a free selection of temperature would be possible. A good temperature control would secure small clearances and thus also a low energy consumption in the bearings.

As for the preferred embodiment of the invented machine, it is justified to use the second or the third relationship presented for the minimum of losses, according to which losses are proportional to the clearance or to the square of it at least so far that gas leak through other clearances of the machine has become small as compared with a short part of clearance corresponding to the radial-like edge of the reacting member provided with the sealing member. An efficient reduction of leaking speed in the clearance in question is unconvenient, but it is not necessary, since if the size of the said clearance is maintained small, sufficiently small losses for all practical purposes are resulting.

A relative gas leak is proportional to the product of three factors namely clearance, speed of gas leak and time of process cycle. By maintaining clearances small, also leaking speed can be reduced efficiently. The time of the process cycle is determined in the first hand by pressure losses in the valve, and also in this respect the invented machine is advantageous, because the cross-section of the value opening is exceptionally large and opening as well as closing periods take place rapidly. Also the geometry of the working space is advantageous to result in a short time of process cycle. The valve opening being large, it is possible to use as great circum speed as the quality of gas and temperature allow without the kinetic energy of gas also in other parts of the channel becoming of relative significance.

To make clear the profitabliness of the invented machine it is taught to be made a comparison between the invented machine and some hypothetical machine, which are similar in other respects, but in the invented machine clearance, leaking speed as well as the time of one process cycle at a certain pressure loss are one third of the corresponding values in the reference machine. If now pressure losses were kept identical, the amount of gas leak would be 27-fold in the reference machine, whereas at the optimal working point both the gas leak and the pressure losses would be 9-fold. Because the final result is a product of several factors, a scale of variation may be very large. Consequently, by now losses in the known machines of positive displacement type without sealing lubrication have been at least of the same order as in turbo-machines, irrespective of the fact that there is no theoretical underlimit for losses.

As the invented machine is compared with other machines, the most important aspect would be a quantitative comparison of losses, because that kind of quantitative aspects are essentially determining the advantage offered by the invention over known machines. This is particularly true as far as an application to the invented process for storing electric energy is concerned, because in the said process the influence of losses of machines to the total efficiency of the process is cumulative in a particularly great extent. Also in a heat power process using Braytoncycle the influence of losses in significant, because in addition to an expansion machine, also a gas compressor is needed in the process.

To minimize losses the invented machine should be used at some optimum circum speed, to which also the speed of working gas is proportional. A numerical value of the optimum speed is dependent on gas, its temperature as well as clearancies of the machine, as presented earlier. As light gases such as helium or hydrogen are used, the optimum gas speed at the ambient temperature would be of the order of 50–100 m/s. Although the speed would be so low that the relative significance of the kinetic energy of gas would be small, especially in the case of light gases, an optimum speed would be high enough to ensure quite a high volume flow. As besides this in connection with a closed process a high pressure level is used, a high specific power results. In addition, in some applications a higher speed than an optimum one may be used, thus resulting in a still higher specific power.

In the invented use of the machine for storing electric or mechanical energy the machine is applied as a component in a reversible process, which is operating during charging period in such a direction that by means of the process mentioned heat is removed from a cold store material. For achieving this, mechanical work must be put into the process. During reversed operation, or discharging period, heat is delivered into the same cold store material and mechanical work is produced. Cold store material may be in solid or liquid form, or it may be air, which is liquefied during the charging period and correspondingly vaporized and released into atmosphere during the discharging period.

In connection with the storing process it is advantageous to use also warm store, in which water is serving as a heat storing material. During the charging period water is warmed up e.g. to 90°–100° C. and stored. During the discharging period water is taken from the store and cooled in the process e.g. near the ambient temperature.

It is characteristic to the process described that during the discharging period it is possible to deliver heat into cold store material at the most the amount, which has been removed therefrom during charging. Consequently, no heat can be accumulated into the cold store. Accordingly that portion of stored mechanical energy, which is not transformed back into mechanical energy, must remain as heat into the warm store or the surroundings. If the process is operating between two insulated heat stores, a net heat exchange with the surroundings is small. Consequently, there is a tendency that into the warm store is accumulating a heat amount, which is practically the difference between stored and recovered mechanical energy. Therefore, during a discharging period of the heat content of the warm store such a portion may be used for producing mechanical energy, which is necessary for discharging the capacity of the cold store. The remaining heat content of the warm store may be utilized as heat for certain low temperature purposes, as heating or water distillation.

Due to exceptionally small losses of the invented machine, the efficiency of energy storing is good, especially as also the heat energy component is taken into account. Due to the reversible character of the process, requirements concerning small losses of machines are so severe that by using machines known before the efficiency attainable would be far too low.

BRIEF DESCRIPTION OF THE DRAWINGS

FIGS. 5–6 are illustrating possibilities to arrange one true valve member to correspond to three virtual valves;

FIG. 7 is a cross-sectional view taken along the line and in the direction of the arrows 7—7 of FIG. 2 and describing a valve member;

FIG. 8 is a cross-sectional view describing a valve member taken along the line and in the direction of the arrows 8—8 of FIG. 7;

FIGS. 19–21 are illustrating a possibility to form the constant-radius-edge of the partition wall forming part of the reacting member so that the corresponding clearance has a considerable length in the direction of gas leak;

FIG. 22 is illustrating a possibility to use a labyrinth seal for reducing gas leak through the clearance in accordance with FIGS. 19–21;

FIG. 23 is a side view of a sealing member mounted to a radial-like edge of the partition wall forming surface of the reacting member taken along the line and in the direction of the arrows 23—23 of FIG. 24;

FIG. 24 is a cross-sectional view of the sealing member taken along the line and in the direction of the arrows 24—24 of FIG. 23;

FIG. 25 is a schematic view illustrating supplying high pressure gas into sealing members in the reacting member;

FIG. 29 is illustrating a structure of a programmed plate in connection with an optiocal position defining system of the sealing member;

FIG. 30 is illustrating a structure of a receiving device co-operating with the plate of FIG. 29;

FIG. 31 is a block diagram illustrating a control of the sealing member;

FIG. 32 is a cross-sectional view of a valve controlling a passage of high pressure gas for effecting turning of the sealing member taken along the line and in the direction of the arrows 32—32 of FIG. 33;

FIG. 33 is a sectional side view of the valve controlling the sealing member taken along the line and in the direction of the arrows 33—33 of FIG. 32;

FIG. 34 is a fragmentary circumferential view illustrating a control of an effective gas opening taken along the line and in the direction of the arrows 34—34 of FIG. 32;

FIGS. 35–36 are schematic views illustrating an optical measurement of error in synchronization between the working member and the reacting member;

FIG. 37 is an enlarged schematic view illustrating co-operating members of the measuring system taken along the line and in the direction of the arrows 37—37 of FIG. 35;

FIG. 38 is an enlarged fragmentary view illustrating positions of supplying and receiving optic cables taken along the line and in the direction of the arrows 38—38 of FIG. 37;

FIG. 39 is an enlarged fragmentary view illustrating the structure of the measuring system on the position of a light absorbing slit taken along the line and in the direction of the arrows 39—39 of FIG. 37;

FIG. 40 is a sectional view illustrating the location of the active part of the system defining an error in synchronization between the working member and the reacting member taken along the line and in the direction of the arrows 40—40 of FIG. 41;

FIG. 41 is a side view of the active member of an optical measurement system taken along the line and in the direction of the arrows 41—41 of FIG. 40;

FIG. 42 is illustrating schematically a possibility to use distant photo-detectors and light transmitting optic cables;

FIG. 43 is illustrating an arrangement, according to which light can be supplied into the reacting member from a stationary light source and electric contacts are arranged through the shaft;

FIG. 44 is a schematic view illustrating arrangements for the sealing members concerning supplying high pressure gas as well as electric and optic connections needed;

FIG. 45 is a block diagram illustrating a temperature system, in which the member in question has been divided into several parallel parts, which are individually controlled;

FIG. 49 is a sectional view illustrating a heat insulation structure suitable for surfaces of which precise dimensioning is not needed;

FIG. 50 is a top view of a heat insulation structure suitable for surfaces requiring a precise dimensioning taken along the line and in the direction of the arrows 50—50 of FIG. 51;

FIG. 51 is a sectional view of the heat insulation structure taken along the line and in the direction of the arrows 51—51 of FIG. 50;

FIG. 52 is a fragmentary top view of a heat insulation structure suitable for use in connection with working gas under the ambient temperature;

FIG. 53 is a schematic sectional side view of an alternative general structure of the invented machine;

FIG. 58 is a partial sectional side view of still another embodiment of the invented machine;

FIG. 59 is illustrating the circumference of the working member in the embodiment of FIG. 58 analogously to FIG. 4;

FIG. 60 is a schematic cross-sectional view of the machine in accordance with FIGS. 58–59 as to parallel functional units are used in order to compensate reacting forces;

FIG. 61 is a process diagram illustrating the use of the invented machine as a component in a heat power process using Brayton-cycle;

FIG. 62 is a block diagram of a substitute model corresponding to a real expansion machine;

FIG. 63 is a block diagram of a substitute model corresponding to a real compression machine;

DESCRIPTION OF THE PREFERRED EMBODIMENTS

Figure 1:
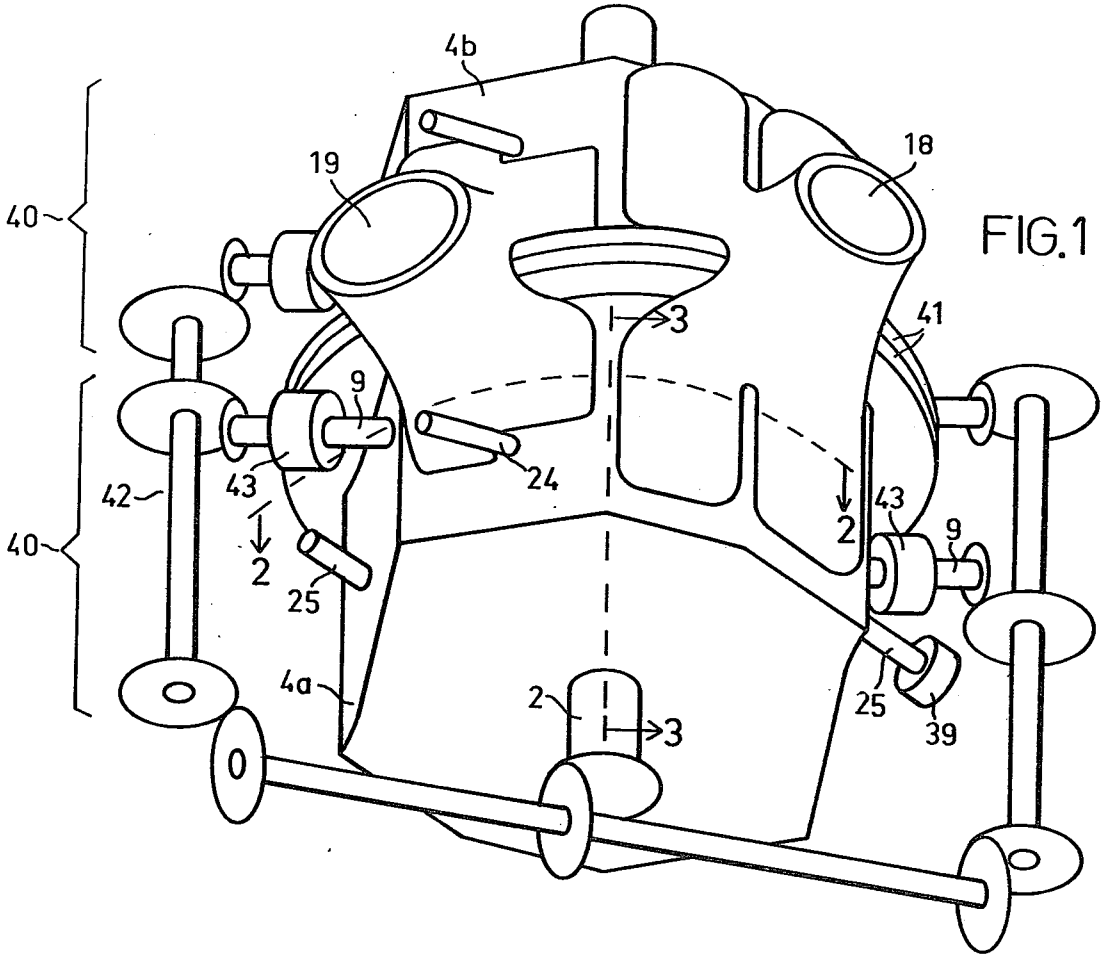
FIG. 1 is a perspective view illustrating a possible general structure of the invented machine.

FIG. 1 is illustrating a possible general structure of the invented machine. The machine includes a power shaft 2 connected to a working member situated inside the the body 4 of the machine. In this example it is thought that the machine includes two functional basic units 40 one after another in the direction of the shaft 2 on the positions of halves 4*a* and 4*b* of the body. As the units mentioned function in opposite phases, a torque of the whole machine may be fairly constant within each process cycle. Assembling of the machine may be carried out by pushing halves 4*a* and 4*b* of the body towards each other axially and by attaching them by means of projecting flanges 41. Each functional unit includes two reacting members situated at a transverse position in relation to the working member on opposite sides thereof. Shafts 9 of said members being shown in FIG. 1. To ensure synchronization of rotation of working and reacting members a synchronizing mechanism 42 may be used between corresponding shafts 2 and 9. The shafts 9 of the reacting members may be provided with small motors 43, whence a main energy exchange may occur between the motor and the reacting member, thus avoiding stresses and wear of the synchronizing mechanism. It might even be possible to manage without said mechanism, if an elctronic control of motors 43 were safe enough. Valve members belonging to the machine are rotated by means of shafts 24 and 25. The rotation may be arranged by using motors 39 attached to the corresponding shaft. Moreover, there are shown flow conduits 18 and 19, which have been branched for the both functional units 40. In expansion use gas enters the machine along conduit 18 leading to the valve members, and returns along conduit 19, the direction of circulation being reversed in compression use.

Figure 2:
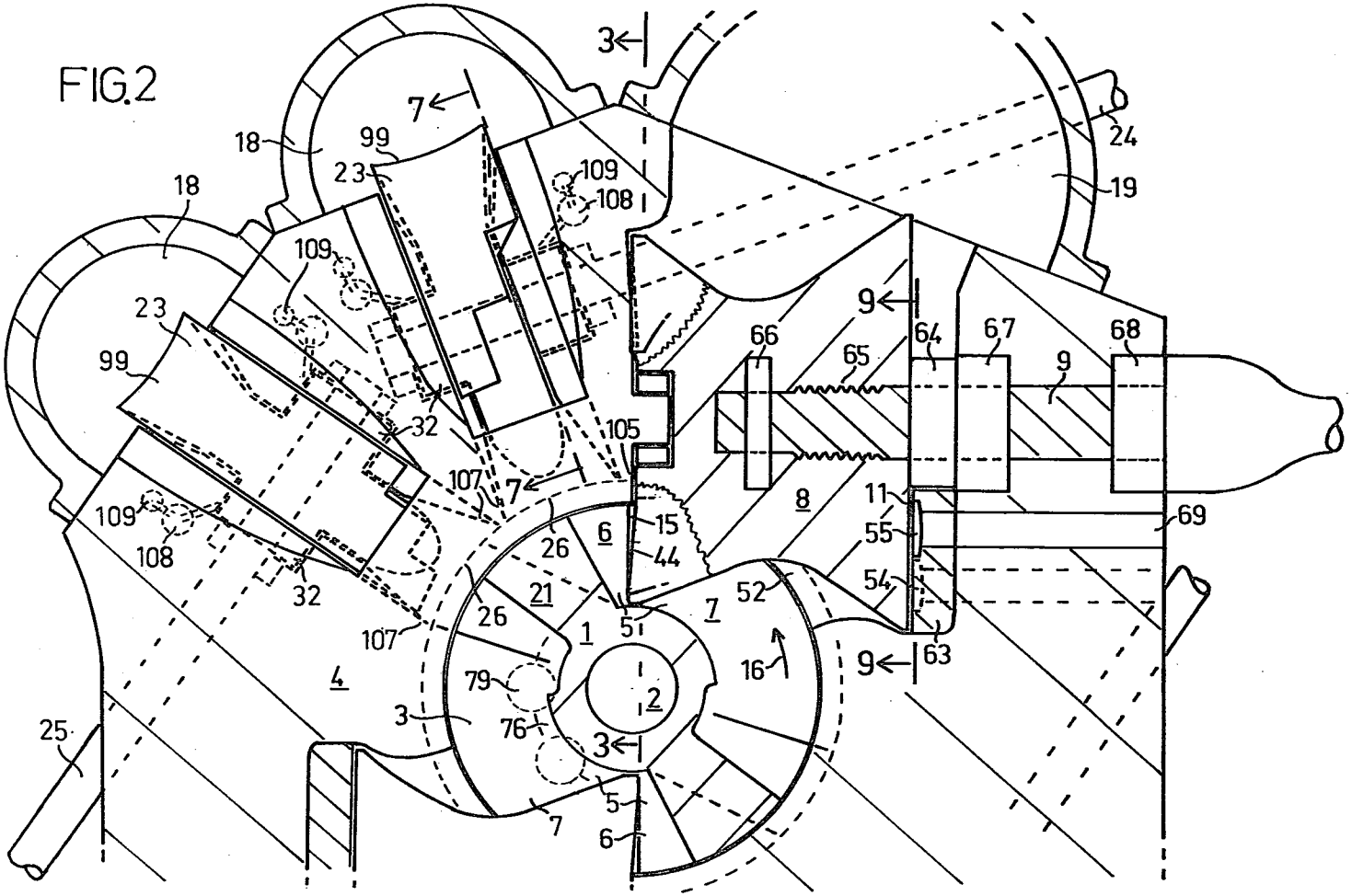
FIG. 2 is a cross-sectional view of the machine taken along the line and in the direction of the arrows 2—2 of FIGS. 1 and 3.
Figure 3:
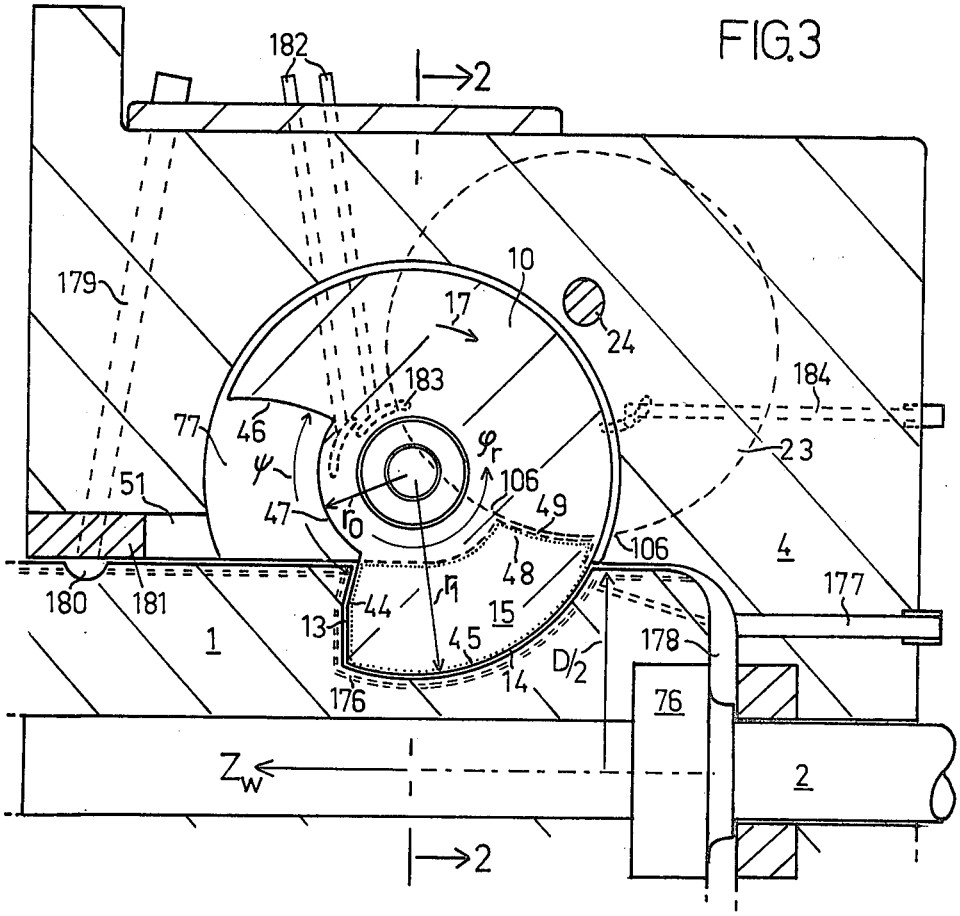
FIG. 3 is a partial sectional side view of the machine taken along the line and in the direction of the arrows 3—3 of FIGS. 1, 2 and 4.

An internal structure of the machine is illustrated in FIGS. 2–3. The rotation space 3 of the working member 1 situated inside the body 4 of the machine has in the example the general form of a cylinder, the working member being attached directly to the power shaft. The working member 1 is formed so that in the rotation space there are two working spaces 5 one after another in the direction of the circumference of the working member, said spaces being situated symmetrically on opposite sides of the working member. The functional unit described also includes two reacting members 8, which situate transverse in relation to the working member and on opposite sides of it. As an expansion or compression process takes place in the same phase in the both working spaces of the functional unit, no transverse reacting forces are effecting the shaft of the working member. As the working spaces are channels in a cylindric body, both side edges of the working space are at the same distance from the rotation axis of the working member, whence no axial forces originated from gas pressure are created. Accordingly, the corresponding bearings are loaded only by the weight of the working member and the power shaft.

The shafts 9 of the reacting members are located so that their rotation axes are situating outside the rotation space 3 of the working member. It would also be possible to use modifications where the shafts of the reacting members were mounted to deviate somewhat from the normal plane of the power shaft. In a general case one functional unit might include n reacting members, where n is any positive integer. In that case the unit might include correspondingly n working spaces one after another circumferentially at intervals of the angle 360°/n. In principle, the number of working spaces might be alternatively m-fold as compared with the number of reacting members. Then only a fraction of 1/m of all working spaces would be simultaneously on the points of reacting members and thus in active use.

A partition wall 15 (indicated by a dotted line) formed by the reacting member 8 divides the working space 5 into two parts, of which the process space 6 is connected to the corresponding flow conduit 18 through openings 26 in the body of the machine. The other partial space 7, named in the following a transferring space, is continuously in connection with the corresponding flow conduit 19 through an opening 52 in the body structure 4 surrounding the rotation space of the working member. Through the same opening also the reacting member 8 is extending into the working space 5 thus forming said partition wall 15. For sealing reasons the partition wall forming surface 10 of the reacting member must be a surface of revolution in relation to the rotation axis of the reacting member. Said surface may be a plane surface, the normal of which is parallel to the rotation axis of the reacting member or it may be a somewhat cone-like surface of revolution in relation to the said rotation axis for reasons explained later. The shape of the edge line of the partition wall forming surface 10 has been presented in FIG. 3, said line portions 44, 45, 46 and 47. The partition wall forming part is thus provided with one transition sector 77 having a sector angle $\Psi$ which in the example is about 90°. The partition wall 15 is formed by that changing part of the partition wall forming surface 10 which, in course of the rotation of the reacting member in turn is inside the rotation space 3 of the working member. If the axial co-ordinate z of cylinder coordinates is imagined to join the rotation axis of the reacting member, a general form of the edge line of the partition wall forming surface 10 may be defined by means of the radial co-ordinate r and the co-ordinate $\Psi_r$ so that as the angular co-ordinate is varying beginning from the sector 77, which is turned towards the working member the process cycle changes to a direction corresponding to the order of arrival of different points of the said edge line in expansion use into the rotation space of the working member, the radial co-ordinate is growing relatively steeply (segment 44) to a constant value $r_1$, remaining at that value for the most part of the angle change corresponding to the whole circle and returning finally (segment 46) to a low starting value $r_0$ near the completion of the whole circle.

The described general form may be superimposed by local deviations, as projections or grooves. Most essential from functional point of view is that the distance of the edge line from the rotation axis of the reacting member is constant for the long segment 45 of the edge line. As working and reacting members rotate synchroneously, the clearance 14 corresponding to the said segment 45 remains constant irrespective of errors in synchronization. Accordingly, it is possible to maintain said clearance 14 small. Faults in synchronization are harmful only as far as the segment 44 of the edge line is concerned. This segment 44 going quite radially is relatively short and is in the rotation space of the working member only for part of time, whence gas leak through the corresponding clearance 13 remains quite small. A radial-like direction of the last mentioned edge 44 is advantageous for providing said edge with a special sealing member, as presented later. The segment 46 of the edge line corresponding to the transferring space end of the working space is not essential as to leakage, because there is no pressure difference between process and transferring spaces when said segment is inside the rotation space.

Figure 4:
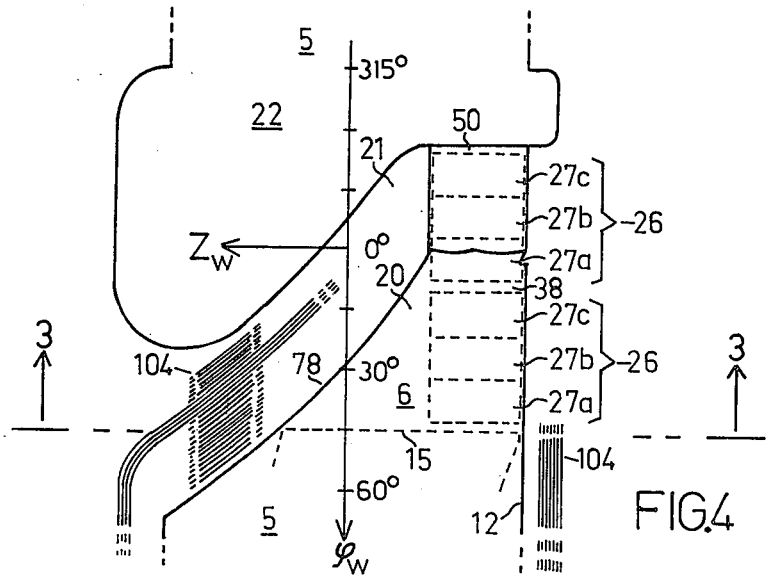
FIG. 4 is illustrating the circumference of the working member and the form of working spaces especially in the position of the separating wall and a location of valve openings in accordance with FIGS. 2 and 3.

In FIG. 3 also a location of valve members 23 is sketched. Shafts 24 and 25 of valve members are located in a certain normal plane of the rotation axis of the working member, this normal plane not being the same in which the shafts 9 of the reacting members are situated. The plane of rotation of each valve member may be directed at least approximately towards the rotation axis of the working member. To avoid dead space in front of the valves the rotation space of the working member may at the position of valve openings 26 deviate from a cylinderic general form in a way presented in FIG. 3. The rotation space includes a ring-shaped projection part 48 around the cylinderic main part, said part 48 being formed by a channel in the body of the machine. The bottom 49 of the channel is formed to correspond to the form of an unbroken circum surface 99 (FIG. 2) of the valve members as well as it is possible, as presented later in detail. In FIG. 4 is presented a part of the circum surface of the working member by using as co-ordinates the rotation angle $\phi_w$ of the working member and the axial distance $z_w$ in the direction of the rotation axis of the working member. The figure shows a separating wall 21 between two working spaces 5. One functional unit includes two separating walls 21 situated symmetrically on the opposite sides of the working member. When said wall is turned towards the corresponding reacting member, in said reacting member is correspondingly turned towards the working member a gap 77 formed in the position of the segment 47 of the edge line with a minimum radius $r_0$. In FIG. 4 are also presented locations of valve openings 26 at a moment when the partition wall 15 in relation to the working space is in the position shown in figure corresponding also to the situation in FIGS. 2–3. The separating wall 21 is acting as a sealing wall between two working spaces one after another. For this purpose said wall is provided with a projection part 50 corresponding to the form of the cross-section of the channel 48. It is possible to form the projection part 50 of the same continuous material as the main body of the working member, if the body 4 of the machine is provided with a groove 51 situated in the inner wall of the body in the direction of the rotation axis of the working member and at a sector corresponding to the opening 52 for the reacting member. When the working member is pushed axially inside the body during assembly, the projecting part 50 can be guided through said groove 51. Alternatively, it is possible to install a separate projection part through opening 52 after installing of the working member.

It might be favourable, although not absolutely necessary, to form the radial-like segments 44 and 46 of the edge line in the reacting member to correspond to the crosssection of the bottom 49 of the channel 48 so that all parts of said segments are entering or leaving simultaneously or nearly simultaneously the rotation space of the working member.

In expansion use the working member rotates in direction 16 and the reacting member in direction 17. In the beginning of a process cycle the front edge 44 of the reacting member starts to enter the rotation space of the working member on the point of the projection part 48. Consequently, the volume of the process space 6 starts to increase from value zero. When the gas openings 26 provided with valve members are just at the point of said projection part and one opening is extending close by the partition wall 15, access of gas from the conduit 18 into the process space is possible from the very first moment of the process cycle in time with increasing of volume of the process space. To accomplish this, the gas openings in the body of the machine have thus to be located, as seen in the direction of the rotation axis of the working member, at the point corresponding to that side of the working spaces running circumferentially, on which the extreme end 20 of the process space 6 is situating, and as seen circumferentially on the process space side, at least one opening extending beside the point where the partition wall is formed. The valve members 23 start to open at a moment when the corresponding opening has been fully shielded by the separating wall 21 thus preventing gas leak into the extreme end 22 of the transferring space of the adjacent working space. When the valves at a certain moment close and the working member continues its rotation, the volume of the process space further grows and consequently the gas in the closed space expands. When the rotation of the working member has proceeded to the point $\phi_w=135°$ (315°) in the case of the example, the rear edge 46 of the reacting member enters the rotation space, thus resulting in a loss of sealing of the process space. Accordingly, expansion ends at that point, and in order to avoid losses, the end part 22 of the working member has been broadened to allow gas to flow past the reacting member. For the same reason it might be profitable to form also the edge of the opening 52 for the reacting member to correspond to the edge 78 of the working space at the process space end, whereby sealing is lost synchroneously also at the end of the process space and, when the working member continues its rotation, the latter opening is steadily growing.

Increasing the volume of the process space during expansion cycle from zero to a certain maximum is accompanied by diminishing the volume of the transferring space, whence gas expanded during the previous cycle is pushed away from the working space into the conduit 19 through the opening 52. The process cycle ends and the next cycle begins as the separating wall 21 in the working member reaches the point of the partition wall 15. During one cycle the reacting members rotate one revolution and the working member half a revolution. In compression use the directions of rotation of working and reacting members are reversed, as well as the direction of gas flow. Then gas is sucked from the conduit 19 into the transferring space 7, the volume of which increases to the maximal value. When the process cycle changes said space becomes the process space in consequence of rotation of the working member, whence the gas amount sucked in is compressed and pushed through the valve openings 26 into the conduit 18 during the next cycle.

It is possible to achieve a large total area of a valve opening, if it is used several openings 26 one after another circumferentially, one of the openings extending close by the point of the partition wall, and each opening being provided with a real valve member, said valve members being located fan-like so that their planes of rotation are directed at least approximately towards the rotation axis of the working member. The shafts of the valve members may be interconnected by universal joints thus making it possible to rotate the whole chain of valves by means of one shaft connected to the last valve member. In the example it is succeeded to manage with two openings 26 and corresponding real valve members 23, which have been formed so that they effectively correspond to three distinct openings, the virtual openings *27a*, *27b* and *27c* thus formed being situated one after another circumferentially. During expansion process the opening of the valve in the case of each virtual opening may be started when the corresponding virtual opening has come into the shield of the separating wall 21. As the width of said virtual openings is small in the direction of the $\phi_w$-axis, it is possible to manage with a relatively narrow separating wall, whence more useful working space may be achieved. Opening of valves may take place in the shield of said separating wall so that when extreme end 20 of the process space comes to the position of the opening in question, it is already fully open. The use of virtual openings is advantageous, in addition to simplifying structures and increasing working volume, also because then it is possible to manage with only one wall 38 between the true openings 26. As it is seen from FIG. 54, which is explained later, such a wall has a tendency to delay increasing of the total area of value openings.

In order to illustrate accomplishing of virtual openings possibilities are presented with the aid of FIGS. 5–6 for selecting respective forms of an unbroken circum surface of a valve and on the other hand the bottom 49 of the channel 48 forming the projection part of the rotation space. Unbroken lines are presenting the form of the bottom of the channel and broken lines the form of the unbroken valve surface, the co-ordinates $\phi_w$ and $\phi_v$ presenting directions of circumferences of working and valve members, respectively. In FIG. 5 it is wanted to achieve indentical forms of surfaces along lines A-B and C-D. To achieve this, it is thought that from the valve body are determined two circles situating in the positions of the lines mentioned, said circles being identical and situated in parallel planes symmetrically at equal distances on opposite sides of that normal plane of the rotation axis of the valve member, which is going through the rotation axis of the working member. Said circles being situated symmetrically completely determine the form of the bottom 49 of the channel. The remaining degree of freedom is to determine forms of revolution of the unbroken circum surface of the valve in other planes so that said surface at some angle $\phi_v$ at the most extends nearly to touch the bottom 49. Touching would happen between lines A-B and C-D firstly along line K-L, which is situating in that normal plane of the rotation axis of the working member which goes through the rotation axis of the valve member. Outside said lines touching would happen firstly along the sides, in a symmetrical case at all lines A-G, B-H, C-I, and D-J. If the possibility offered by line K-L is not utlized, but said point is provided with a moderate clearance, then by utilizing lines A-B and C-D as sealing lines it is possible to divide the true opening 26 into three virtual openings 27*a*, 27*b* and 27*c* one after another in circumferential direction of the working member. Sealing along the outer sides G-H, H-J, I-J and I-G is achieved by forming the projection part 50 of the separating wall to correspond to the cross-section of the channel 48. The forms of the bottom 49 and the unbroken circum surface of the valve correspond at all points to each other so well that dead space between them has no practical significance.

In FIG. 6 the situation explained in the foregoing has been turned 90°. In that case the sealing circles explained belong to the working member, whence sealing lines A'-B' and C'-D' in the direction of the circumference of the working member are achieved. The virtual openings 27*a*, 27*b* and 27*c* thus achieved are parallel in the direction of $\phi_w$-axis, but in series in the direction of $\phi_v$-axis. Also now an opening of the valve at the position of each virtual opening may be started in expansion use immediately after the virtual opening has been shielded by the separating wall. In the case of FIG. 6 equality in size of the virtual openings requires that the axis of the valve situates symmetrically in relation to the opening in a direction of the rotation axis of the working member. In the example of FIGS. 2–4, where an alternative presented in FIG. 5 is used, the position of the valves is unsymmetrical so that the axes of the valves are located in the normal plane of the axis of the working member, which is approximately situating at the position of the outer side edge 12 of the working space. Accordingly, it is easier for the shaft 24 of the valve to pass the reacting member. Also a symmetrical situation would be possible, if the rotation of both valves would happen through the shaft 25 belonging to the latter valve, the shafts being connected with a double-joint.

FIGS. 2, 7 and 8 are illustrating a construction of rotating valve members 23. As to the general form they are bodies of revolution with the exception that from a certain sector material has been removed so that when this sector is turned towards the gas opening 26, a connection between the process space 6 and the corresponding conduit 18 is effected. As it is the purpose to open in expansion use virtual openings 27*a–c* in succession in time with their arrival at the position of the separating wall 21, opening times of the individual virtual openings are different from each other. To achieve this, the opening 28 in the valve is formed of three sections in the direction of the axis of the valve, said sections having individual opening angles $\beta_a$, $\beta_b$ and $\beta_c$ as seen from the axis of the valve. As the valves in expansion use rotate in direction 31, the individual edges 29$_{a-c}$ are acting as front edges, whereas the other edges 30 are all in the same line resulting in a simultaneous closing of all virtual openings in expansion use and correspondingly in a simultaneous opening in compression use. Simultaneous actions during said phases are advantageous in making the corresponding periods as short as possible for avoiding losses. The same point of view prefers a small visual angle $\alpha$ of the opening 26 in relation to the axis of the valve. In the example this is about 30°, whence losses during the periods mentioned are no more dominating. In the case of valves in accordance with the figures one revolution of the valve corresponds to one process cycle. In the example the valves have been provided with supporting parts 32 having the form of a body of revolution. It is possible to direct onto these parts a programmed pressure effect from cavities 33 for compensating the force induced by pressure difference between the process space 6 and the conduit 18. This can be accomplished in the same way as the compensation of forces effecting on the reacting member, which is discussed later. Alternatively, it is possible to conduct a pressure in the process space also to said cavities, in which case the area of the cavities must correspond to that of the opening 26. For making possible mounting of the valves the body of the machine may be provided in accordance with FIG. 7 with a loose part 34, which can be installed after the valve. If transverse forces are compensated, forces directed to bearings of shafts 24–25 are kept small. If desired, also considerably smaller axial unbalances may be compensated. On the other hand, it is clear that especially if the pressure level used is not high, no pressure compensation is necessary.

FIG. 7 also presents a possibility to use a shielding part 35 to reduce heat exchange between gas and the circum surface of the valve. Passage 36 of gas may take place e.g. in conformity with FIG. 8 past the valves along channels 37 in the body of the machine. The total cross-section area of those conduits is possible to dimension greater than the total area of gas openings 26, whence pressure losses in these conduits are not significant.

The scope of the invention also includes an alternative in which the reacting members and/or valve members are formed so that one revolution of said members corresponds to two process cycles. In that case the members have two gaps 77 and 28, respectively, symmetrically on the opposite sides of the member in question. The advantage achieved is geometrical symmetry in relation to the rotation axis, resulting in an inherent balancing of the member. The drawback involved is greater losses than in the embodiment presented. As to the reacting member, also a considerably smaller working space is resulting. The balancing of said members in the preferred case may be accomplished by planning the members so that on the sides opposite to gaps 77 or 28 some material is removed from suitable areas unessential from a functional point of view. Radially going gaps 102 in FIG. 7 serve the purpose mentioned.

The power shaft 2 may be composed of two parts, which are provided with a thicker portion 76 for mounting the shaft halves into the ends of the working member so that even a very great torque can be transmitted. A connection may be arranged e.g. by using round locking means 79, as indicated in FIG. 2.

Figure 9:
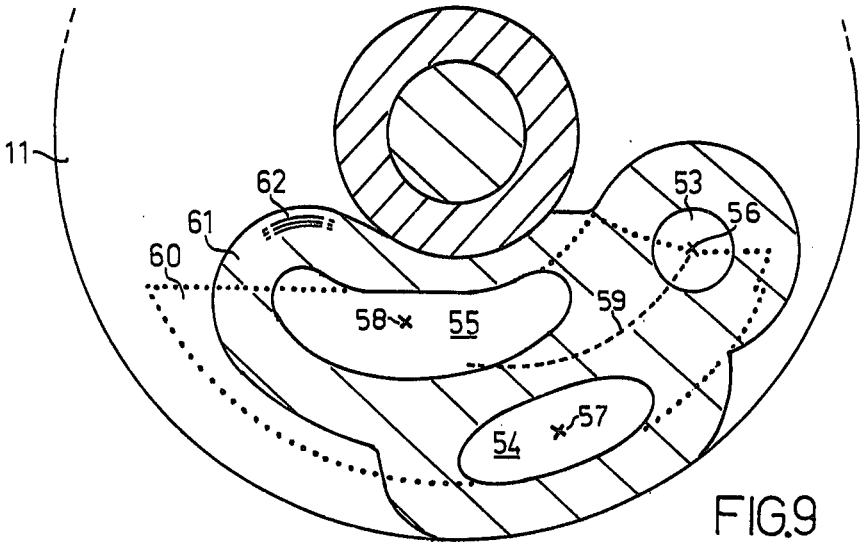
FIG. 9 is a cross-sectional view illustrating a counterforce part for arranging a pressure compensation onto the reacting member taken along the line and in the direction of the arrows 9—9 of FIG. 2.

The reacting members may be firm bodies as in FIG. 2 and capable to transmit even very great forces caused by a pressure difference between the process space and the transferring space outside the rotating space of the working member. Reacting forces may be compensated by a programmed pressure effect which is directed onto a counter-surface 11 in the reacting member, said surface being situated outside the rotation space 3. Bearings 67 and 68 may take forces due to incomplete pressure compensation. The bearings can be dimensioned to bear for a short period the whole reacting force during a possible failure in pressure compensation. Mounting of the reacting member may happen so that the shaft 9 is pushed through a separate ring-like part 64 and screwed into its place and locked in tangential direction by using a locking part 66. Axial forces on the bearing 67 are transmitted through the ring-like part 64, whereas axial forces to the bearing 68 are transmitted through the thread 65 and the shaft 9. In mounting a proper axial pre-stress may be used for avoiding an axial free play. For keeping this pre-stress within suitable limits, a thin flexible part between the bearing and a counter-part may be used or alternatively during running a control of temperatures. After mounting the reacting member the counterforce part 63 may be mounted into its place by pushing in circumferential direction. According to FIG. 9 this counterforce part is provided with three low cavities 53–55 for directing pressure forces onto the reacting member. In FIG. 9 the machine is looked in the direction of the shaft 9 and the location of the total cross-section area 60 of the working space is indicated by a dotted line. The resultant of counter-forces can be kept every moment at the same line parallel to the axis of the reacting member as a momentary centre of gravity of the partition wall 15. As the locus 59 of the centre of gravity remains inside a triangle determined by the gravity centres 56–58 of the cavities, it is possible to arrange the resultant of forces to follow said locus.

Figure 10:
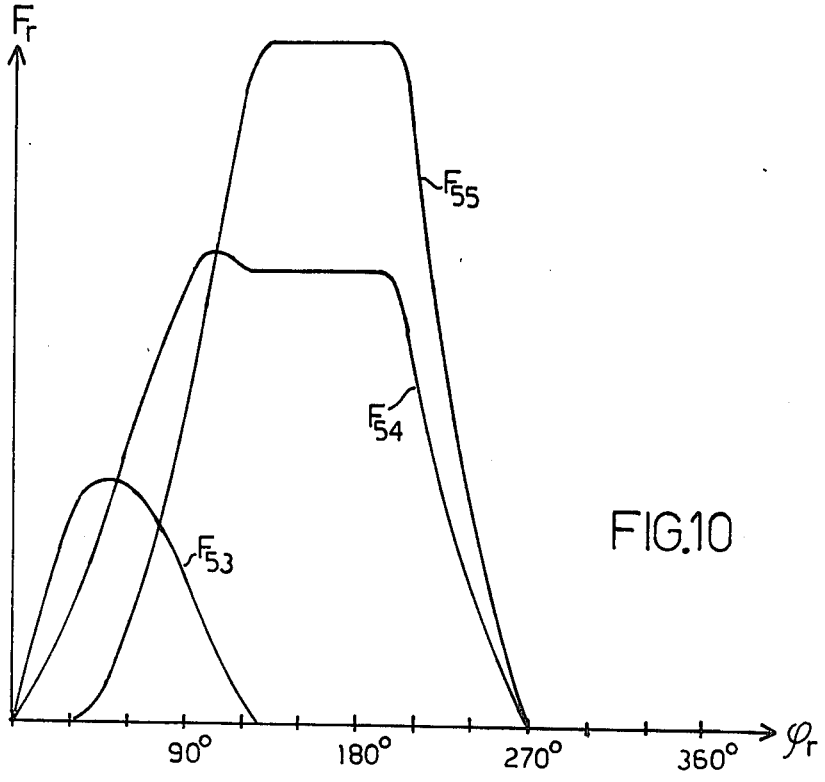
FIG. 10 is a diagram describing a time course of pressure forces needed for a proper compensation of the reacting member.

The cavities are surrounded by a broad seal margin 61 which may be provided with numerous grooves 62 forming a labyrinth seal for reducing the speed of gas leak. As the volume involved with the grooves is small, the pressure distribution within the seal is well corresponding the momentary pressure in each cavity. Due to a gradual lowering of pressure within the seal about half of the seal area is effectively included in the cavities. FIG. 10 is illustrating a time course of counterforces $F_{53}$–$F_{55}$ in corresponding cavities 53–55 in the case of FIG. 9 as a function of the rotation angle $\phi_r$ of the reacting member, the starting moment of an expansion cycle being at $\phi_r=0$. As to curves of forces $F_{54}$–$F_{55}$, they are of periodic form deviating from a sinusoidal one mainly so that they have flattened portions at both tops of the curves, whereas the curve for $F_{53}$ has one long flattened portion.

A periodic variation of pressure may be accomplished by a periodic variation of volume by using a suitable apparatus in connection with each cavity. Accomplishing a back-and-forth variation of volume does not in principle consume energy. If the volume of compensating cavities is of the order of 1% of the corresponding working volume of the machine, losses in actual compensating devices may be at the most some thousandth parts of the power of the machine.

Figure 11:
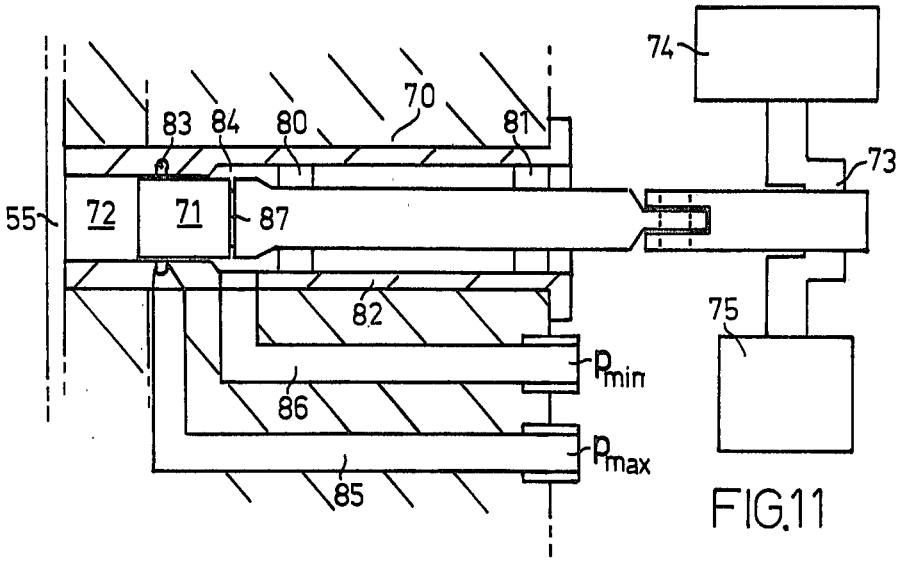
FIG. 11 is a cross-sectional view illustrating a device for altering periodically a pressure level in a pressure compensation cavity.
Figure 12:
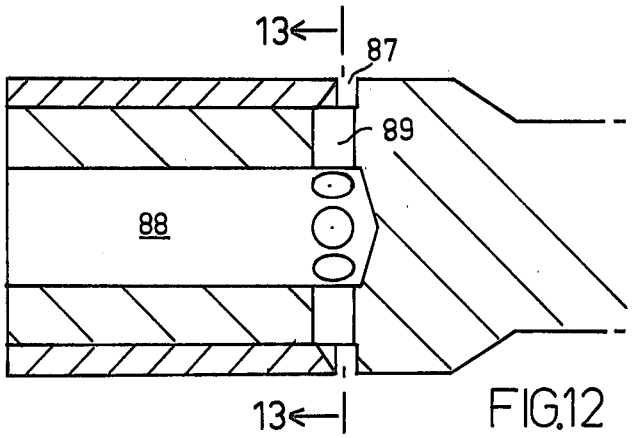
FIG. 12 is an enlarged cross-sectional view illustrating a piston part of FIG. 11.
Figure 13:
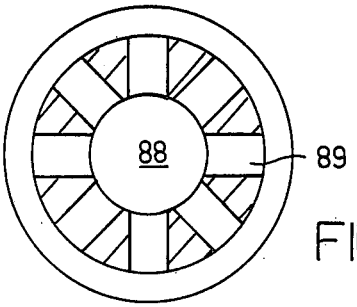
FIG. 13 is a cross-sectional view illustrating the piston taken along the line and in the direction of the arrows 13—13 of FIG. 12.

Taking into account wave forms presented in FIG. 10, a suitable apparatus to be used in connection with each cavity is shown in FIG. 11. The apparatus 70 includes a reciprocating piston 71 inside a tubular housing 82 and provided with support bearings 80, 81. The piston is moved by a conventional crankshaft 73 provided with a flywheel 74 and an electric motor 75. In front of the piston is a space 72 in connection with the corresponding cavity 55. The work done to the piston during expansion of the space 72 is stored into the flywheel and possibly also in electric form by using the electric machine 75 as a generator. Synchronization with other moving parts of the machine is possible to arrange by using an electronic control of the motor 75. Flattened portions of the curves may be accomplished so that the piston 71 is provided with a circumferential groove 87 leading through conduits 89 into the interior 88 of the piston, as described in detail in FIGS. 12–13. The inner surface of the body 82 is provided with circumferential spaces 83 and 84. As the piston during its reciprocation is situating so that the groove 87 is at the position of the space 83 or 84, a gas conduit is open from the space in question to the space 72 as well as to the corresponding cavity. Thus, if said spaces are connected through conduits 85 and 86 to spaces having pressures $p_{max}$ and $p_{min}$, the corresponding pressure exists also in the cavity during those parts of the process cycle when the groove 87 is not between the spaces 83 and 84. The ratio of volumes of the cavity and the space 72 can be dimensioned so that the desired pressure ratio $p_{max}/p_{min}$ results. Pressure $p_{min}$ is that existng in the conduit 19 corresponding to the transferring space. Pressure $p_{max}$ may be e.g. 1.3 $p_1$, where $p_1$ is the pressure in the conduit 18 corresponding to the process space. A suitable pressure may be produced by using a conventional compressor as an auxiliary device.

The apparatus described is suitable for achieving curve forms $F_{54}$ and $F_{55}$. For achieving curve $F_{53}$ the space 83 may be omitted and the space 84 dimensioned to cover a dominant part of the process cycle.

Figure 14:
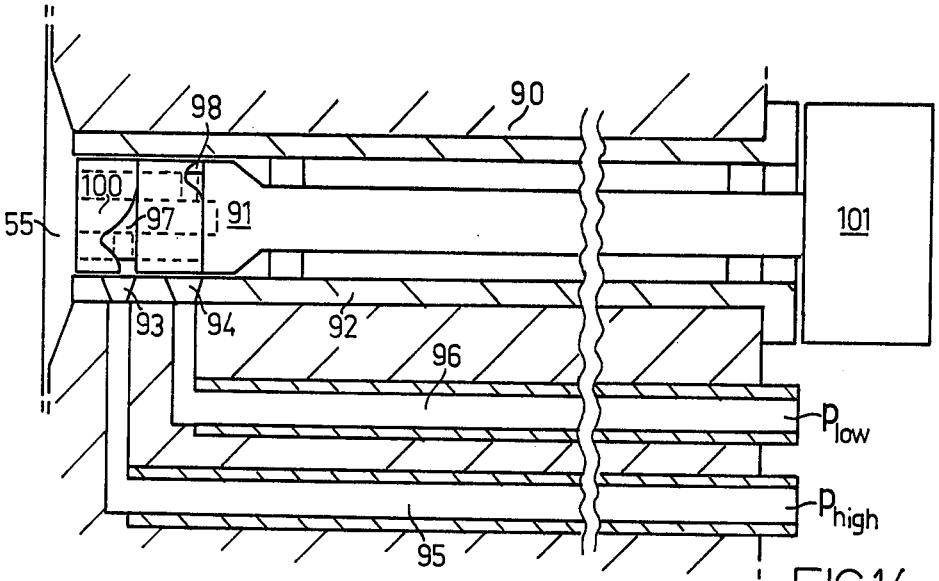
FIG. 14 is a cross-sectional view describing an auxiliary device used for accomplishing a pressure compensation of the reacting member.
Figure 15:
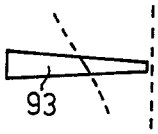
FIG. 15 is a fragmentary view illustrating a programmed shielding of a gas opening in the auxiliary device of FIG. 14.

Gas leak from counter-force cavities as well as remaining unbalances may be compensated by using an auxiliary device described in FIG. 14. The device 90 includes a rotating valve member 91 provided with circumferential slots 97 and 98 at the position of openings 93 and 94 in the wall 92 of the device. The slots are designed properly to result in a desired time course of the size of openings between the hollow interior 100 of the valve member and the corresponding conduits 95 and 96 having pressure $p_{high}$ and $p_{low}$. Said interior is in connection with the cavity 55 in question. The rotating valve member 91 shuts in course with time a variable portion of the openings as described in FIG. 15.

The rotation of the valve member 91 is synchronized with movements of other parts of the machine by controlling electronically the motor 101. The device described may be used so that more gas enters the cavity through the conduit 95 and the amount of gas is diminished through the conduit 96. Of course, the device can be used also so that there are several pressure levels available to minimize energy consumption.

Figure 16:
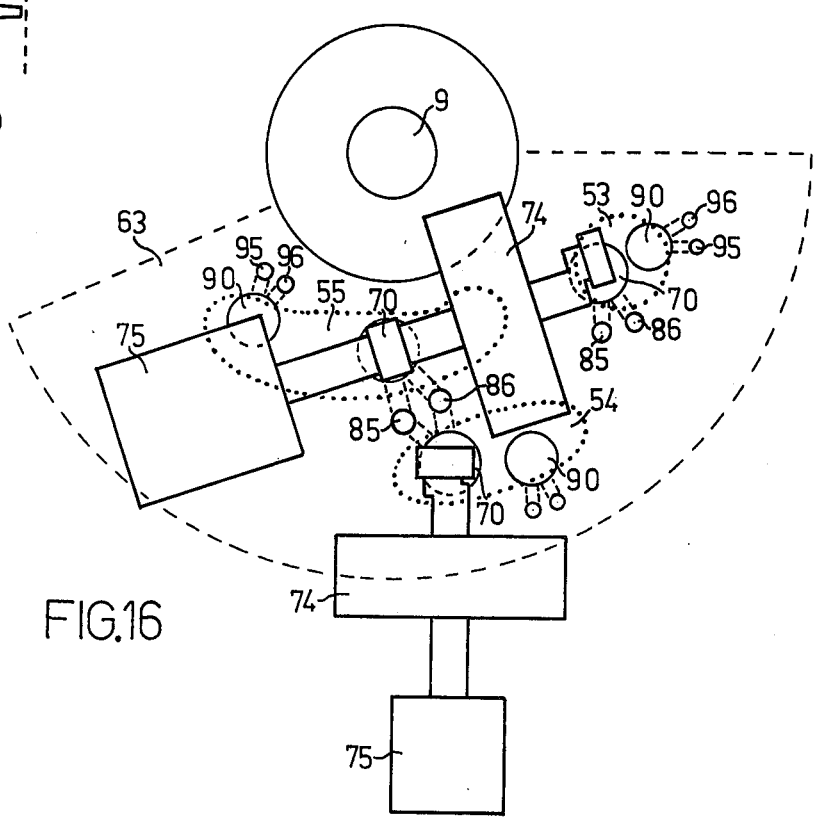
FIG. 16 is a schematic side view of the machine illustrating locations of pressure compensators in connection with one reacting member.

FIG. 16 is illustrating locations of compensating devices as seen from outside of the machine in the direction of the shaft 9 of the reacting member. Locations of the counter-force part 63 as well as of cavities 53–55 are indicated by broken and dotted lines, respectively. Reference signs are indicating positions of devices 70 and 90 described in FIGS. 11–15. Each cavity is provided with one main device 70 and one auxiliary device 90. Possibly remaining unbalanced forces load the bearings of the reacting member. These forces remain so small that even very great pressure levels may be used in a closed process. Mounting holes 69 for the main device 70 are shown in FIG. 2.

Figure 17:
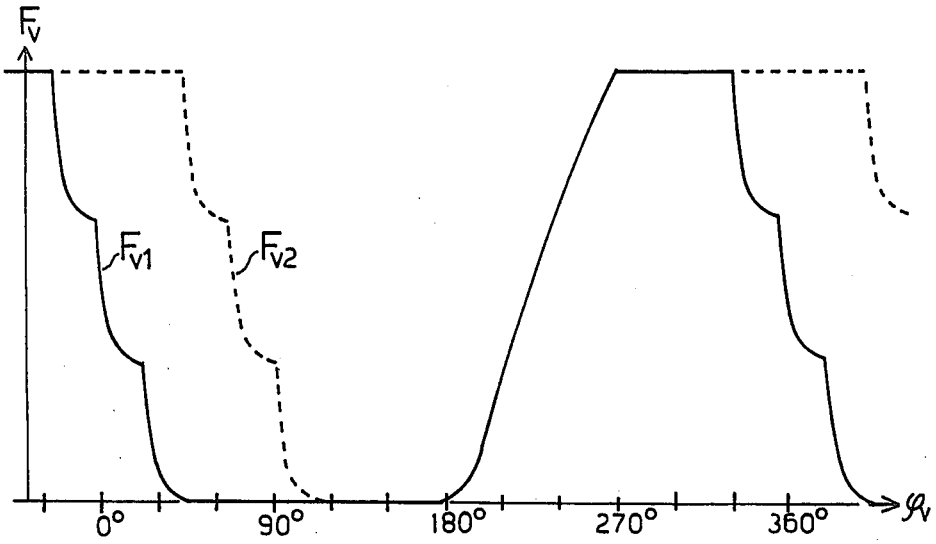
FIG. 17 is a diagram describing a time course of pressure forces needed for a proper compensation of a valve member.

FIG. 17 illustrates a time course of radial gas forces effecting valve members 23 of the machine in expansion use, due to pressure difference between the process space and the conduit 18, as a function of the rotation angle $\phi_v$ of the valves, when the starting moment of the expansion cycle is $\phi_v=0$. The curves are periodic having flattened portions at both tops. Thus, the forces may be approximately compensated by using devices 70 and 90 described above.

Figure 18:
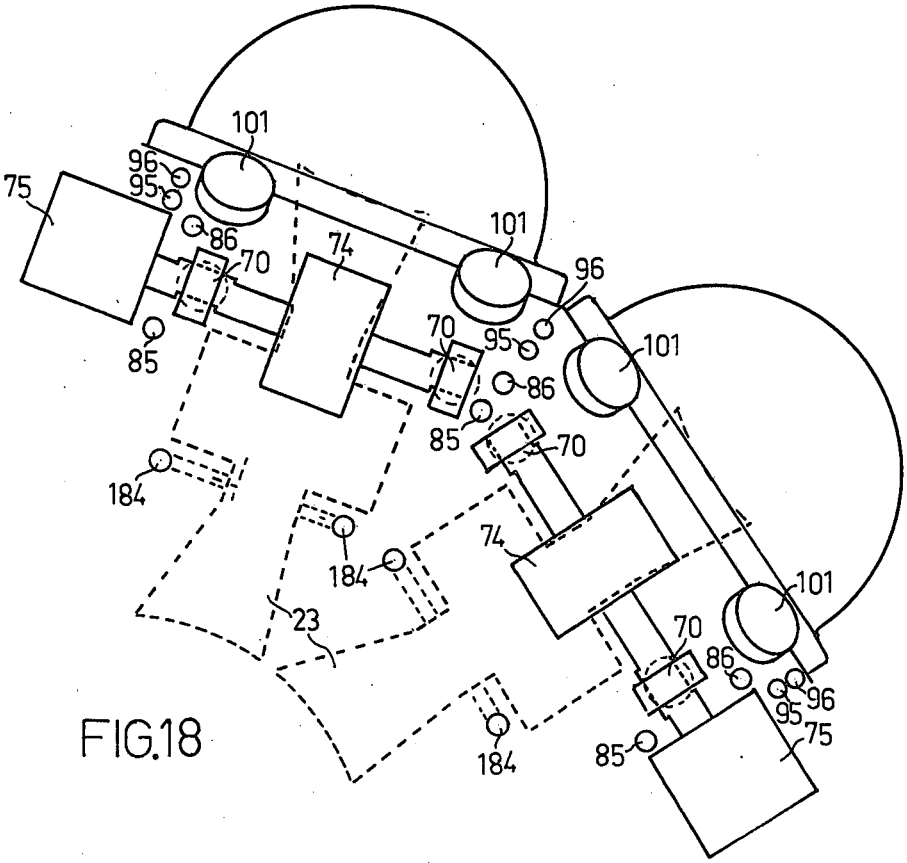
FIG. 18 is a schematic end view of the machine illustrating locations of pressure compensation in connection with valve members relating to one process space.

FIG. 18 indicates positions of compensating devices for the valve members as seen from outside the end side of the machine in the direction of the power shaft, the location of contours of valves 23 being indicated by dashed lines. Reference signs are those used in FIGS. 11–14. Compensating devices are mounted into corresponding holes 108 and 109 indicated in FIGS. 2 and 7.

FIGS. 19–21 illustrate a possibility to achieve for a leak path 14 corresponding to that segment of clearance between the working member and the reacting member which is independent of synchronization, so great length in the direction of leakage that speed of leak can be reduced. The best possibilities to accomplish this are present if the partition wall forming surface 10 is situated at the position of that normal plane of the axis of the reacting member which extends through the axis of the working member, whence a tangent of the bottom of the working space in circumferential direction is parallel to the axis of the reacting member. The forms of said bottom and the edge of the reacting member cannot correspond to each other perfectly in every place, but quite a satisfactory result is achieved, if the rim of the reacting member is formed to correspond to the form of the bottom of the working space in a situation where the rim point in question has turned about $\frac{1}{4}$ or $\frac{3}{4}$ of the total angle spent inside the rotation space of the working member. FIG. 20 illustrates the situation mentioned, whereas FIG. 19 presents the situation in the middle of the working space and FIG. 21 on the extreme sides of said space. Due to a considerable length of leak path a pressure drop in the clearance is correspondingly distributed over the whole length. In order to avoid radial reaction forces into the reacting member, the end surface 10 may be a somewhat conical surface of revolution as described in FIGS. 19–21 as well as in FIG. 2.

Provided the pressure level used is so high that a labyrinth seal results in a better reduction of speed of gas leak than the use of a continuous narrow clearance, the rim 45 of the reacting member may in accordance with FIG. 22 be provided with transverse grooves 62 forming a labyrinth seal structure 103. The grooves may be interrupted to avoid gas leak in the direction thereof. The general form of the rim may be that described in FIGS. 19–21.

FIGS. 23–24 describe one embodiment for providing the radial-like edge of the reacting member with a sealing member 110 forming the true edge 44. The sealing member may turn in some extent in relation to axles 112 which are at least approximately parallel to the edge 44. The sealing member may be mounted so that axles 112 are pushed in their holes 113 axially into their places after insertion of the sealing member. The turning movement of the sealing member is restricted by an extension part 114 located in a cavity 115 of the body 111 of the reacting member. In this embodiment the sealing member is constructed somewhat unsymmetrical so that a centrifugal force turns said member to its outmost position shown in the figure, whence the extreme edge 44 is situating at a surface 117 which is an extension of the partition wall forming surface 10 of the reacting member. During normal operation the sealing member is at the position described. When necessary, the member may be turned inwards by applying gas pressure against the extension part 114 through a conduit 116. This may be done during starting and stopping of the machine as well as during special disturbances. Especially, if the machine is provided with means for detecting coming disturbances, the clearance 13 between the edge 44 and the counter-surface 119 in the working member may be maintained quite small for a dominant part of time. For that purpose it may be used e.g. a method for measuring errors in synchronization between the working and reacting members, which is described later in FIGS. 35–43. If such an arrangement is used that the reacting member is usually rotating exactly at an unchanged speed and a minute variation of speed of the working member due to unidentical torques of the invented machine and a cooperating machine, a generator or motor, are taken into account by manufacturing the form of the counter-surface 119 properly, alterations in the clearance 13 are mainly caused by external disturbances through the co-operating machine. If the machine in question is a generator feeding a large number of consumers, rapid disturbances are small and the mode described might lead to quite a satisfactory result. Gas leak through a clearance 122 between the sealing member 110 and the body 111 of the reacting member is negligible, because the clearance is formed between surfaces 123 and 124, being surfaces of revolution, and the radius of the sealing member is small. According to 23 it is possible to use gas pressure to support the sealing member through cavities 120 during periods when the position of the sealing member is changed.

High pressure gas needed in conduits 116 and 121 may be supplied into the reaction member through the rotation axis as described in FIG. 25. Valves 125 and 126 controlling the gas flow may then be situated in connection with the stationary body of the machine. Opening and closing of valves may be timed so that gas support through cavities 120 is always effecting during turning of the sealing member. As presented in FIG. 25, the total edge 44 may be provided with two sealing members 110 one after another, corresponding to two straight portions of said edge. In connection with the embodiment of FIGS. 23–24 it is alternatively possible to use a continuous curved form of the edge 44, the form being selected to correspond to the cross-section of the projection part of the separating wall in the working member. In that case the radius of the sealing member is selected to be different in different positions along the direction of the axle 112 so that the desired form is resulting at an intersection of the circum surface 123 and the surface 117.

Figure 26:
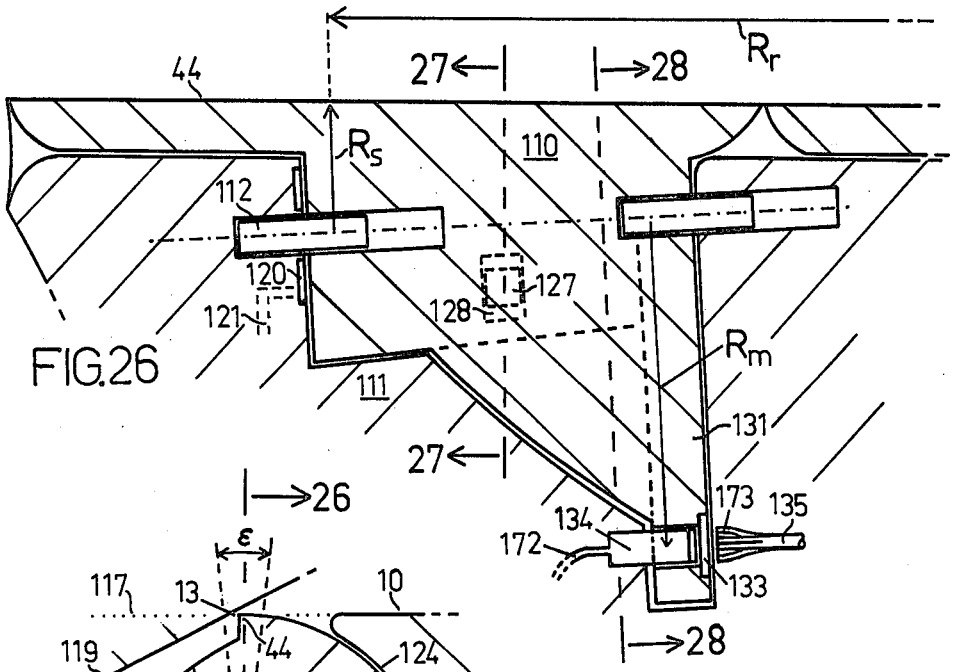
FIG. 26 is a sectional side view of a continuously controllable sealing member taken along the line and in the direction of the arrows 26—26 of FIG. 27 as well as of FIG. 28.
Figure 27:
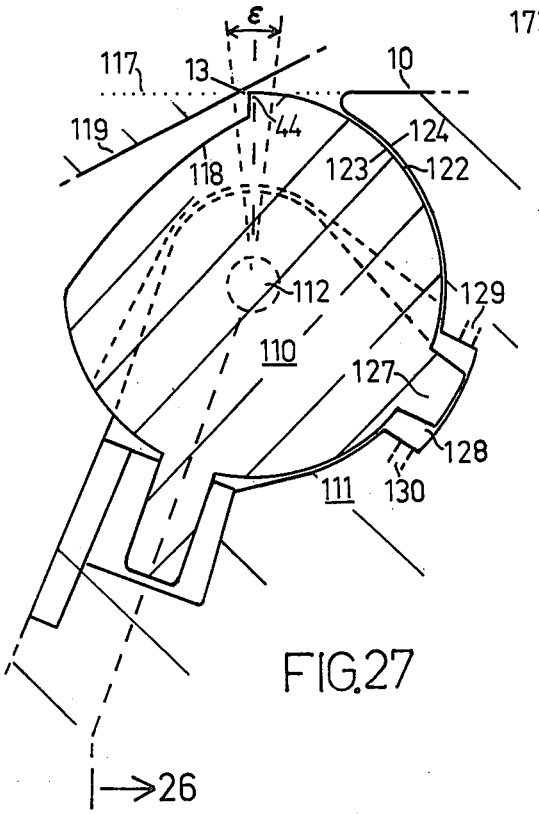
FIG. 27 is a cross-sectional view of the sealing member taken along the line and in the direction of the arrows 27—27 of FIG. 26.
Figure 28:
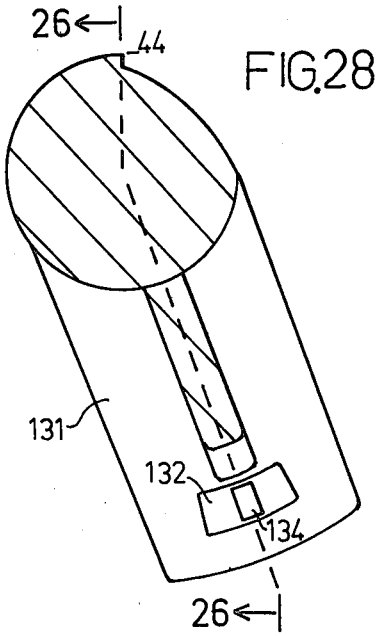
FIG. 28 is a cross-sectional view of the sealing member taken along the line and in the direction of the arrows 28—28 of FIG. 26.

An alternative embodiment of the sealing member 110 is described in FIGS. 26–28. FIG. 26 shows a sealing member corresponding to one straight portion of the edge 44. Now it is possible to use a continuous control of the clearance 13 by turning the sealing member in relation to axles 112 so that errors in synchronization between the working and reacting members are compensated. For this purpose the direction of axles 112 differs slightly from the direction of the sealing edge 44 so that the circum surface 123 of the sealing member is a cone-like surface of revolution in relation to the axle 112, said surface is a tangent surface to a surface 117 imagined as an extension of the partition wall forming surface 10 of the reacting member. The sealing line 44 as well as the clearance 13 between the sealing member 110 and the counter-surface 119 are formed approximately at the point of the mentioned tangent line, because the sealing member is formed thinner on the side being outwards from the reacting member so that the surface 118 beginning from the sealing edge is situating nearer the axle 112 than the cone surface 123. The degree of conical form is such that the distance $R_s$ of each point of the sealing line from the axis of the sealing member is proportional to the distance $R_r$ of the point in question from the rotation axis of the reacting member. If the turning angle $\epsilon$ of the sealing member remains small, the movement of the sealing edge 44 caused by the turning of the sealing member is identical to that achieved by a rotation of the whole reacting member. As forms of the cone surface 123 and the countersurface 124 are identical, gas leak through a narrow and long clearance can be kept negligible.

The sealing member may be formed symmetrical so that its centre of gravity is located exactly at the axis of rotation, whence a centrifugal force does not cause a torque to said member, even if the direction of axles 112 is different from the radial direction of the reacting member. Alternatively the centre of gravity may be located slightly unsymmetrical so that the sealing member has a tendency to turn to the middle position described in FIG. 27.

The turning of the sealing member may be achieved by using a projection part 127 serving as a piston and a cavity 128 serving as a cylinder. In the example the cavity is on the side of the body 111 of the reacting member. The ends of the cavity are provided with gas conduits 129 and 130, through which high pressure gas is effecting the piston and leaking away through clearances of the piston-cylinder construction. For accomplishing a control system to regulate movements of the sealing member, a knowledge about the momentary position of said member is needed. For this purpose the sealing member is provided with a measuring projection 131 having a measuring hole 132 provided with a plate 133 having properly designed openings for arranging an optical position determination in digital form. As the distance $R_m$ of the measuring hole from the turning axis 112 is considerably greater than the distance $R_s$, a good resolution is achieved. Inside the hole 132 is a receiving unit 134 attached to the body 111 of the reacting member. A cable 172 connected to said unit may be an optic cable receiving light through the plate 133 and transmitting it to a detector situated near the axis of the reacting member, or the cable mentioned may be an electric cable leading to local photo-detectors within the receiving unit 134. An optic cable 135 is supplying light to the measuring point from a distant light source, which may be situated outside the rotating reacting member, as described later. The cable may consist of several fibres 173 arranged at the end of the cable properly for the purpose. FIG. 29 is illustrating one opening arrangement of the plate 133. In the example a momentary position of the sealing member is defined by using two digits. The less significant one is revealed by using round openings 136 and the more significant by using elongated openings 137. Correspondingly, the receiving unit 134 according to FIG. 30 is provided with receiving openings 138*a–c* for the less significant digit and openings 139*a–d* for the more significant digit. Members 140 behind the openings 138–139 may be the ends of optic cables or local photo-detectors. The dimensioning of openings being such that light is going at each moment through one or two openings 136 into the corresponding receiving means, a resolution of 41 positions is achieved. In the case of FIG. 29 light is going through openings 138*a*, 138*b*, 139*b* and 139*c*.

FIG. 31 is a block diagram illustrating a regulation of movements of the sealing member. High pressure gas in the conduit 141 is distributed properly into the conduits 129 and 130 by using a valve member 142 controlled by an electronic control unit 143. Information about the momentary position of the sealing member is received from the measuring unit 144 described above in connection with FIGS. 26–30. The unit 145 indicates a momentary error in synchronization between the working and reacting members, as described later in connection with FIGS. 35–43.

FIGS. 32–34 describe one possible construction for the valve 142. The valve 142 is connected through an electric cable 175 to a central control unit and mounted into a space 146 in the body of the reacting member near the piston-cylinder combination 127–128. The valve includes a moving part 147 capable to turn in some extent in relation to the axis 148, which is parallel to the direction 150 of a centrifugal force. The direction 149 of entering high pressure gas from the conduit 141 is opposite to the centrifugal force and may be used for compensation of forces. Gas coming into a hollow interior 151 has an access through slots 152*a–d* in the circumferential wall 155 of the moving part 147 into conduits 129 and 130 through suitably formed openings 153*a–d* in the body 154 of the valve. Openings 153*a* and 153*c* situated at opposite sides are connected to the conduit 130 and correspondingly openings 153*b* and 153*d* to the conduit 129. The openings have triangular formes described in FIG. 34. Triangles belonging to opposite conduits 129 or 130 are in opposite positions. Thus, as the member 147 is turned, an effective opening determined by the position of the slot 152 in relation to the corresponding triangular opening 153 leading to conduits 129 and 130 alters in opposite directions. Thus a distribution of gas flow through conduits can be controlled by turning the moving member 147 by any conventional electro-magnetic construction involved in the valve 142. As the slots 152 are narrow, the effect of torque caused by gas forces is minimized. The use of two slots on the opposite sides results in a symmetrical construction for avoiding transversal forces.

A precise and immediate determination of error in synchronization between working and reacting members may be based on the fact that a certain point in the constantradius-edge 45 of the reacting member follows a certain track on the bottom of the working space. Thus it is possible to define the error optically by using co-operating members situated at said edge 45 and at some point in the working member along said track. In FIGS. 35–36 it is illustrated how by using an active measuring member 156 at the circumference of the reacting member it is arranged two measurements for each process cycle by using two co-operating members 157 being situated at the same distance from the axis of the working member. By using another measuring member 156 on the opposite side of the edge 45 it would be possible to achieve e.g. four measurements for each rotation of the reacting member. In the example it is suggested that the cooperating member is a passive one which reflects back light coming from the member 156. The active member has effectively a multiplicity of light source-light detector pairs. The passive member is provided with a slit 158 which does not reflect light back to the active member 156. Thus it is possible to define which light source-detector pair is going on the position of said slit. The direction of the slit has an angle of $\theta$ in relation to $\phi_w$ expressing the direction of the circumferential movement of the member 157. Correspondingly, the member 156 moves in direction $\phi_r$. The angle $\theta$ is selected so that the relationship $tg\phi = v_r/v_w$ is valid, where $v_w$ and $v_r$ are corresponding circum speeds. Thus the same source-detector pair remains on the point of the slit all the time the co-operating members cross each other. As the slit is formed to have a considerable length, the time of light pulse is long enough to ensure a response in other detectors in spite of great circum speeds and small dimensions of detectors. A precision corresponding to a fraction of a space between adjacent measuring points can be achieved if also relative light intensities are measured in each detector. A precision of 20–30% in intensity measurement would already mean an essential improvement. In the example it is suggested that true light sources or detectors are not in the measuring member 156 itself, but light enters and leaves said member through optic cables 161 and 162. A real light source may be situated outside the reacting member, as explained later in connection with FIG. 43. The location of the detector unit may be near the rotation axis of the reacting member. FIGS. 38–41 illustrate a structure of the measuring member 156. The ends of light cables 161 and 162 are mounted at positions of holes 159 and 160. As it is seen from FIG. 39, light entering the slit 158 is practically absorbed. The width of the slit may be made very small if the reflecting member 157 is manufactured of two pieces attached together. As it is seen from FIGS. 40–41, the measuring member may have a collar part 164, by means of which centrifugal forces are transmitted into the body of the reacting member. The measuring member may be mounted through an opening 163 in the partition wall forming surface 10. After mounting said opening is closed by a corresponding cover. Light cables 161–162 are extending in a cavity inside the reacting member to a vicinity of the axis of the reacting member, where the corresponding light detectors 165 may be situated, as described in FIG. 42. According to FIG. 43 a light source unit 167 may be situated in connection with the stationary body of the machine and light is transmitted through a cable 166, the other end of which is situating coaxially at the end of the shaft 9 of the reacting member. It is also presented how, by using three sliders 168 and a corresponding electric cable 169, it is possible to arrange an electric supply to devices inside the reacting member and further to transmit control orders and other information between the rotating member and the stationary body. By utilizing known electric methods three sliders are sufficient for purposes mentioned, although a transmission of a multichannel information is concerned.

In FIG. 44 is shown how through an axial conduit 174 high pressure gas from the stationary body may be supplied into conduits 121 and 141 for purposes of sealing members 110. Light from an optic main cable 166 may be distributed into cables 135 and 161 presented in FIG. 26 and FIG. 38, respectively. It is also presented, how electronic circuits needed may be concernated into an electronic unit 170 situating near the rotation axis of the reacting member. The unit 170 may be mounted into its place through a channel 171 situated radially in the body of the reacting member. If the wall of the gas conduit 19 is provided with a small door (not shown), the mounting may happen handy. Electric connections to cables 169 and 175 may be arranged by using suitable contact plugs. Optic detectors relating to light cables 162 and 172 may also be situated in the electronic unit 170.

Temperature control of members of the invented machine would ensure maintaining of minimal clearances. Because heat exchange takes place through surfaces of members, at least a considerable part of heat exchange conduits for circulating cooling or heating gas would be situated near the surfaces of the members. In FIG. 3 is shown, how the working member is provided with a network 176 for circulating heat exchange gas. The circulation takes place through a conduit 177 leading to the end space 178 and a conduit 179 connected to the space 180 at the circumference of the working member. The mounting channel 51 may be closed after mounting of the working member by a suitable part 181. In FIG. 3 is also shown, how by using conduits 182 as well as spaces 183, a heat exchange circulation through the reacting member may be arranged, the end surface 10 of said member being provided with several holes, which are situated at certain intervals at a constant distance from the axis of the reacting member. As gas pressure in the temperature control circuit is maintained the same as that in the working gas surrounding the reacting member, gas leak can be kept small. Spaces 183 in the wall of the stationary body of the machine may be surrounded by local labyrinth seal. An arrangement of heat exchange circulation into valve members is illustrated in FIGS. 3 and 18. The pressure level in conduits 184 may be the same as that of working gas in the valve space, whence gas leak can be kept small.

Main conduits leading to each member are distributed into several branches. By careful planning a distribution of heat exchange may be made proper for resulting in a sufficiently uniform temperature within the body of each member. Temperature level may then be controlled e.g. by regulating total mass flow circulating through each member. The regulation may be based on temperature measurements with electric sensors located within the member in question. From a rotating member measurement information may be transmitted into a stationary control unit e.g. as described in connection with FIG. 43.

The state of the art in electronics and control technics further permits even providing each member with several branches which are individually controlled. This has been illustrated schematically in FIG. 45. Parts being situated inside a rectangle 185 are within a rotating member. In the stationary part of the machinery is located a pump 186 for gas circulation as well as a heat exchanger 187. The flow conduit 188 is divided inside the rotating body into branches 189. The amount of average gas flow is controlled by valve means 190. A circuit connected to each valve consists of at least one temperature sensor 191 and an electronic control circuit 192. The state of the art permits a use of small and unexpensive control components, whence even numerous control circuits may be used in each part of the machine. Neither a high temperature of structures would be a hindrance, because in that case the control unit may be situated inside a thermally insulated casing, inside which a part of cooling circulation is conducted.

Besides, the structures may be kept at a low temperature level even if hot working gas is used, as discussed later.

Supplying energy into a rotating member may be arranged also otherwise than by feeding along the corresponding shaft. It is possible to use a winding inside a rotating member, which is passing through a magnetic field created by means being situated in the stationary body of the machine. It is also possible to use circulating heat exchange gas for rotating a small generator. For transmitting information also wireless methods may be used, e.g. optical technics.

A total dimensioning of the machine may be such that during running the temperatures of the rotating members are maintained somewhat higher than that of the stationary body of the machine. Thus during running smaller clearances appear than in an isothermal case.

Figure 46:
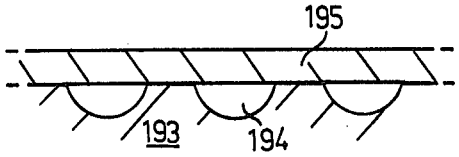
FIG. 46 is a sectional view illustrating an arrangement for achieving heat exchange conduits near a surface of a member to be thermo-regulated.

The heat exchange network needed in each member may be arranged e.g. in connection with casting procedure. If the member in question is composed of several parts united by welding technics, the conduits needed can be easily arranged. If it is desired to use conduits going very near the surface, an arrangement described in FIG. 46 may be used. The surface of a body 193 of a member in question is provided with grooves 194 forming a heat exchange network. The grooved surface is covered by a thin plate 195, which may be fastened here and there by screws or by welding. If the pressure in the temperature control circuit is kept somewhat lower than that of the working gas, a compression against the body results, even though applied to the rotating member.

As stated earlier, the possibility of reducing the speed of gas leak is one important advantage of the invented machine. As the pressure level is high, the use of a labyrinth seal is advantageous, because then the speed of gas leak is depending on the pressure ratio over an individual throttle line and not on an absolute pressure difference. A straight labyrinth seal may be arranged by using numerous grooves at least in another surface forming the clearance in question. The grooves are transversal in relation to the direction of gas leak and they may be interrupted here and there in cases where there is a possibility for leak also in the direction of the grooves. Especially in compressor use it is advantageous to use grooves at the circum surface of the edge 45, as described in FIG. 22. Similarly, the circum surface of the working member may be provided with a seal structure 104 extending through the separating wall 21 and thus surrounding the process space, as described in FIG. 4. In expansion use it may be more desirable to use a seal structure at the bottom of the working space and at the inner surface of the stationary body of the machine. In expansion use namely, a gas leak takes place in the direction of the movement of the partition wall in relation to the working space and correspondigly in the direction of the movement of the separating wall 21 in relation to the stationary body. Because the speed of gas leak is reduced to some value in relation to the labyrinth seal structure, the effective speed is now a difference between the gas speed and the speed of the wall in question both taken in relation to the seal structure. Thus, by using an effecient seal structure and a sufficiently high wall speed, gas leak would be in principle even totally prevented, provided that the volume involved with grooves is negligible as compared with the volume of the working space.

FIGS. 2–3 are indicating other surfaces to be provided with a straight labyrinth seal, namely in the stationary body of the machine the surface 105 opposite to the end surface 10 of the reacting member as well as surfaces 106 and 107 surrounding the valve openings 26. In addition, a labyrinth seal is used in connection with pressure compensations, as indicated in FIG. 9 as to the compensation with the reacting member. In connection with a compensation of valves, the grooves may be partly arranged at the bottom of the mounting piece 34 presented in FIG. 7.

Figure 47:
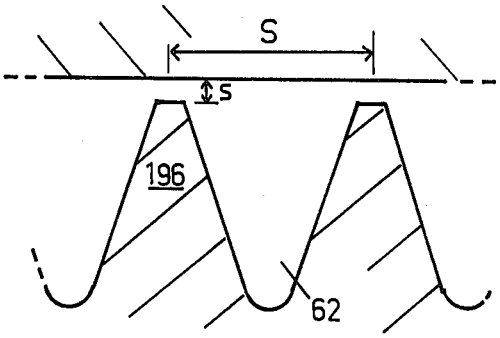
FIG. 47 is a sectional view illustrating a structure of a straight labyrinth seal.
Figure 48:
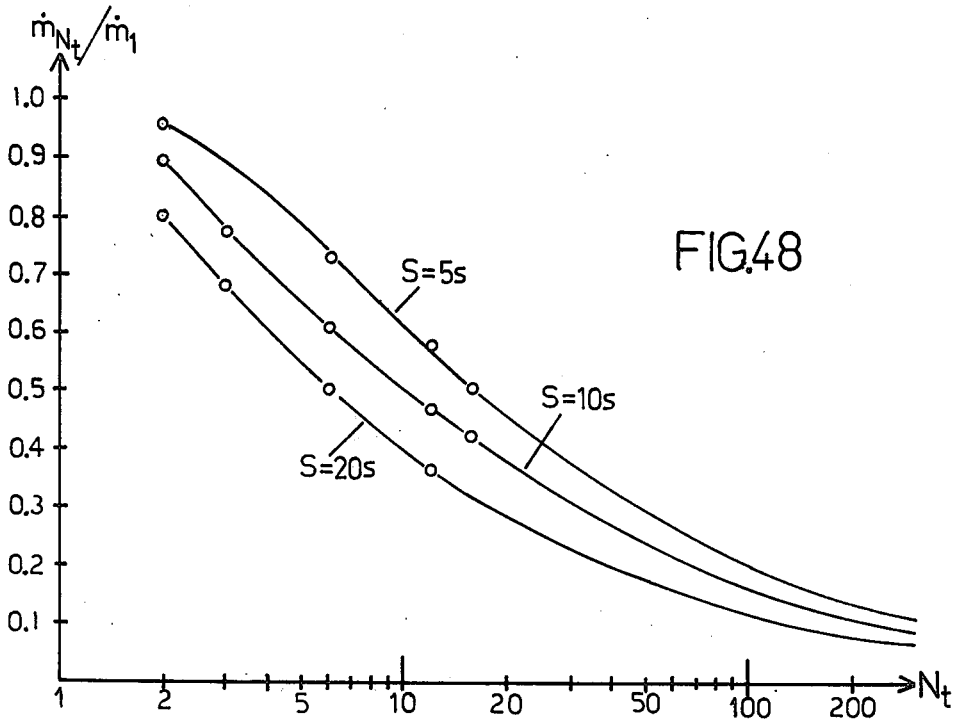
FIG. 48 is a diagram illustrating a decrease of gas leak as a function of a number of labyrinth grooves one after another.

The profile of a labyrinth seal may e.g. that presented in FIG. 47. The profile is formed by grooves 62 between ridges 196. Tooth spacing S may be **5*a*–10*s*, where s=clearance. If a clearance of 0.1–0.2 mm is maintained, a tooth spacing S=1 mm might be suitable. FIG. 48 is presenting a relative reduction of gas leak $\dot{m}_{N_t}/\dot{m}_1$ as a function of the number $N_t$ of throttle lines one after another. Curves for tooth spacings S=5s, S=10s and S=20s are achieved by a theoretical extrapolation based on an experimental study of air indicated by circles. It is concluded that if the tooth spacing were 1 mm or less, a reduction factor 0.1–0.2 is possible to achieve as to major part of clearances occuring in the machine. As to the clearance 14**, a reduction factor of 0.3–0.5 is well achievable.

A heat exchange of working gas with inner surfaces of the machine may be reduced by using an internal heat insulation. Surfaces, into which it is easy to arrange an insulation layer, include stationary surfaces of the valve spaces, side surfaces of the valves, stationary surfaces surrounding the reacting member, the circum surface of the reacting member as well as the bottom surface of the working space in the position of the end portion 22. The surfaces mentioned are characterized in that no precise dimensioning is required. In addition, the temperature of working gas near the surfaces remains unchanged during each process cycle. The surfaces mentioned may be shielded in accordance with FIG. 49 with an insulation layer 198 between a base structure 197 and a covering metal plate 199, which may settle down to a temperature near that of working gas. The heat insulation layer may be composed of some sheets 200 in series. The said sheets may be separated from each other by supports 201 of wire type. Supports next to each other may go crosswise whence the structure may bear pressing forces of some magnitude. A pressure level in the insulation space may be maintained as the same as the pressure of the working gas or somewhat smaller. In the latter case the structure may be used also at surfaces of rotating members, because the centrifugal force is overcome by the pressure difference. Because the insulation layer is thin, only a small pressure difference is needed. A suitable pressure level may be arranged by connecting the insulation spaces into a temperature control circuit of the member in question. A possibility for thermal expansion or contraction of the covering plate 199 may be arranged by using foldings 202 in both directions at suitable intervals. A basic fastening into the base structure may be secured by fastening elements 203. The effeciency of the insulation structure presented in FIG. 49 may be based on several surfaces in series. The lack of forced convection would result in a poor heat exchange coefficient at each surface and thus in a sufficient insulation. Besides, sheets in series would serve as a shield against radiant losses.

It is to be noted that requirements as to heat insulation are quite low. If the thickness of insulation is d, k is the effective conductivity in insulation layer and $\Delta T$ is the temperature difference, a heat flow density $\dot{q}=k\ \Delta T/d$ is resulting. If $k=0.1$ W/m°C., $\Delta T=400°$ C. and $d=2$ mm, then $\dot{q}=20$ kW/m$^2$, which is so a low value that the quantative heat loss is insignificant as compared with the useful work done by the machine.

Surfaces surrounding the process space are characterized in that a precise demensioning is required. When the machine is applied as an engine in a heat power process, said surfaces need not to be at a higher temperature than that of working gas after expansion. It might be still more advantageous to manage with a further lower temperature. Therefore in the following a calculation is made concerning the heat loss which might then result. If surfaces not requiring a precise dimensioning are insulated as illustrated above, the total area exposed to the hot working gas for each process space would be about $A_w=2D^2$ in one process space. The heat loss during one process cycle may be calculated from the equation $$Q_w=h\,A_w\,t_c\,\{T_2-T_w+0.25\,T_1\,[1-(p_1/p_2)^{-R/cp}]\},$$

where $T_w$=temperature of wall, $T_2$=temperature of gas after expansion, $T_1$=temperature of gas before expansion, $p_1$=gas pressure before expansion, $p_2$=gas pressure after expansion, R=universal gas constant, $c_p$=heat capacity of working gas in constant pressure, h=heat exchange coefficient, $A_w$=area of heat exchange surface and $t_c$=time of process cycle. In the equation a reducing coefficient 0.25 is used for a part exceeding temperature $T_2$, because a higher temperature occurs only for a part of time. Into the equation may be inserted area $A_w=2D^2$ as well as cycle time $t_c=\pi D/2v_R$, where D=the diameter of the working member and $v_R$=the circum speed of the working member. Most uncertainty is relating to the heat exchange coefficient h. As working gas is supposed to be helium, in the following is used a formula $h=20(\mu v_g)^{0.8}/D^{0.2}$ (W/M$^2$°C.), as $[\rho v_g]$=kgm$^2$s and [D]=m, in which gas speed is $v_g=0.5v_R$. It is to be noted that about a half of the walls of the process space are stationary, whereas the other half is moving in the direction of gas flow. Additionally, a typical circumferential speed of the centre of area of the partition wall is $v_g=0.8v_R$. As the Reynolds number is very high, the entrance section effect is probably quite small. Density $\rho$ is calculated at the mean temperature of the boundary layer. Heat loss is compared with the work done by gas during one process cycle, namely $$W_0=(c_p/R)\,p_1\,V_1\,[1-(p_1/p_2)^{-R/cp}],$$

where $V_1=0.1D^3$ is the maximum volume of one process space before expansion. By using numerical values D=0.75 m, $V_R=120$ m/s, $p_1=50$ bar and $p_2\delta 25$ bar the ratios $Q_w/W_0$ as well as heat flow densities $\dot{q}$ presented in the following table are obtained with various wall temperatures $T_w$, as expansion of gas is thought to happen within the temperature range 850K-650K (577° C.-377° C.):

| $T_w$ | 100 $Q_w/W_0$ | $\dot{q}$ |
|---|---|---|
| 350K (77° C.) | 4% | 400kW/m$^2$ |
| 500K (227° C.) | 2% | 200kW/m$^2$ |
| 650K (377° C.) | 0.5% | 50kW/m$^2$ |

According to the calculation the walls may be even near the ambient temperature without resulting in a great relative heat loss. Neither is the heat flow density too great as far as thermal stresses are concerned, if a cooling circulation is arranged near the surfaces in question. Consequently, in connection with the invented machine even very high gas temperatures may be used and still essential parts of the machine be maintained at moderate temperatures. It may be concluded from the formulae presented that the significance of working gas as well as the size of the machine to the relative heat loss is of minor importance.

FIGS. 50-51 present a heat insulation structure which may be used even to shield surfaces surrounding the process space. If the shield were used at least to a remarkable portion of said surfaces, the heat loss would then be reduced correspondigly. The most suitable surfaces appear to be the stationary surfaces of the body, especially the cylinderic portion, and the bottom portion of the surface in the working member. According to FIGS. 50-51 the surface in question would be covered by plates 204, which are fastened into a base structure 197 centrally so that thermal expansion or contraction takes place symmetrically in all directions, the middle line O of each plate remaining fixed. The plates 204 are supported by a series of co-axial cyliners 205 made of thin material. Said cylinders are installed into corresponding grooves 206 and 207 in the base structure and the covering plate. The idea involved is that a cylinder-symmetrical structure with thin walls may undergo a thermal expansion or contraction due to a temperature gradient in the direction of the central line O without excessive thermal stresses in the material being induced. The plates 204 are warmed or cooled isothermally and a temperature change appears at the supports 205, which thus becomes somewhat conical. The use of cyliner-symmetrical supporting structures would result in an essentially greater rigidness against force components transversal to the line O than the use of many separate thin supports. The supports 205 may be fastened into the base structure 197 e.g. by welding. Also fastening to the plates may be done by welding at the position of projection portions 208 extending through the plate in holes made therein. Thus, the structure may resist also pulling stresses and is thus suitable to be used in rotating members. Certainly, if the pressure level used is high, forces caused by pressure difference are considerably greater than the centrifugal force effecting a relatively thin plate, whence a pulling stress may be avoided. Alternatively, the fastening of the plates into the base structure may be effected by using bolts, which would preferably be in thermal contact with the supports 205.

If the total cross-section area of the supports were 10% of the area of the plate, the pressure in the underlying space 211 were the minimum pressure of working gas, and if the pressure range used would be as high as 100 bar−50 bar, then a maximum stress of 5 kN/cm$^2$ would effect on the supports. If the supports were of iron material with a thermal conductivity of 50 W/m°C., the free hight of the supports were 2 cm and the temperature difference 400° C., then a mean heat flow density of 100 kW/m$^2$ would result. As compared with the table presented above, this would correspond to a relative loss of 1%.

A sufficient seal between the process space and the underlying space 211 may be arranged by using a seal 209 with a round cross-section permitting a slight movement in direction of a thermal expansion or contraction. When used in a machine using hot working gas the plates can be dimensioned so that at a high running temperature the slots between the plates are reduced to zero. In a machine using cold working gas this is not possible. In that case an arrangement described in FIG. 52 is possible for preventing gas leak through remaining slots 213. The example is thought to refer to the covering of the surface of the working member. To prevent gas leak under the circumferential edge 45 of the reacting member, those sides of the plate not parallel to said edge are formed to be of zik-zak character having portions 212 and 213. The slot 212 does not change during cooling of the plates, whereas the slot 213 grows. Because the slots 213 are so short that they do not extend over the edge 45, a continuous gas leak is prevented. The gas volume involved with the slots remains negligible as compared with the volume of the working space.

If an expansion machine is concerned, the surface of the plates may be provided with a labyrinth seal structure 210, as sketched in FIG. 51.

The use of an internal heat insulation as described above makes it possible in connection with every application of the invented machine to maintain the temperature of the stationary body as well as of the essential parts of moving members near the ambient temperature. Thus, favourable conditions for using precise roller bearings in every application are guaranteed. Bearings with a negligible free play offer a good basis for utilizing temperature regulation for maintaining clearances of the machine at a minimum. Alternatively, the use of gas bearings would permit a free selection of the bearing temperature.

In FIG. 53 an alternative total construction of the machine is sketched. In contrast to FIG. 1 the body 4 of the machine is of one piece, whereas one machine unit consists of two working members 1*a* and 1*b* mounted on a uniform power shaft 2. End walls 214 mounted after the working members increase the rigidness of the body.

Figure 54:
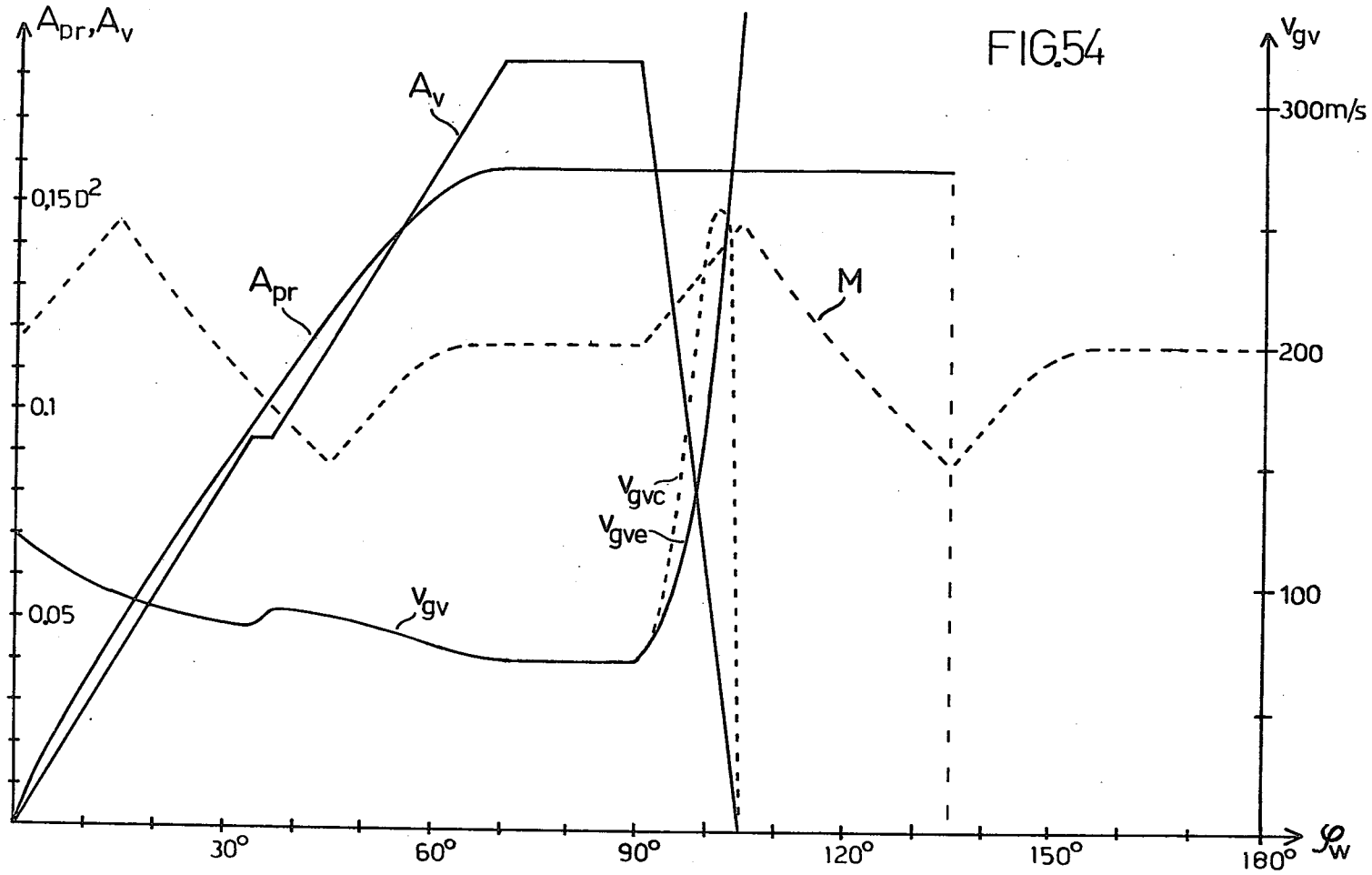
FIG. 54 is a graphical diagram illustrating a time course of various quantities in the invented machine during one process cycle.

FIG. 54 presents graphically various quantities associated with the machine in accordance with FIGS. 2–3 as a function of rotation angle $\phi_w$ of the working member, the origin of $\phi_w$-axis corresponding to the situation, where the extreme end of the process space is at the position of the partition wall, corresponding to the starting moment of an expansion cycle. Curves presented include a time course of the total area $A_v$ of the valve opening as well as the area $A_{pr}$ of the partition wall reduced to a distance D/2 (FIG. 3) of the circumference of the working member. As the centre of gravity of said reduced area is thought to be located at the distance mentioned, true values for the working volume as well as for the torque may be calculated by using this constant distance D/2. In expansion use the process proceeds in the direction of the positive $\phi_w$-axis. Areas $A_v$ and $A_{pr}$ grow quite equally in time from the very beginning of the cycle. In the example closing of the valves starts at $\phi_w=90°$ and ends at $\phi_w=105°$. During the closing period the reacting members as well as valve members rotate an angle of 30°. Expansion ends at $\phi_w=135°$. In the figure is also presented the time course of gas speed $v_{gv}$ in the opening of the valve, provided that the circum speed of the working member is 80 m/s, the working gas being helium at a temperature of 370° K. (97° C.) before expansion. Within $\phi_w=0$–90°, where areas $A_v$ and $A_{pr}$ are of the same order, the gas speed is fairly proportional to the ratio $A_{pr}/A_v$. During the closing period the sizes of the valve opening and the effective piston area do not correspond to each other, whence a rise of gas speed results. The quantitative significance of losses induced during the closing period is not dominating, however, being partly due to that closing is happening rapidly because of a small visual angle $\alpha$ (FIG. 7) of the valve opening, partly to that in consequence of the low pressure ratio used, the volume of the process space at the moment of the beginning of the closing period is great, resulting in a relatively small change of volume ratio during the short closing period, whence also a formation of pressure ratio between opposite sides of the valve opening is remaining small, said pressure ratio being a necessary presupposition for a rise of gas speed. Accordingly, gas speed $v_{gve}$ in expansion use during the closing period is rising remarkably more slowly than ratio $A_{pr}/A_v$.

In compression use the process proceeds in the direction of the negative $\phi_w$-axis. If the opening of the valves is started at $\phi_w=105°$, it may result in a course of gas speed $v_{gvc}$ presented in the figure during the opening period. However, in compression use it is possible to manage with smaller losses, if a small advance in the opening of valves is used, resulting in that gas is first flowing backwards.

In the example in accordance with FIG. 54 the kinetic energy of the amount of helium gas flowing through the valve opening of one working space during one expansion cycle may be calculated from the equation $$W_{gv} = 0.5 \int_0^{\pi D/2 v_R} \rho_1 A_v(t)\,[v_{gv}(t)]^3 dt,$$

and correspondingly the work done by the same gas amount during one expansion cycle from the equation $$W_0=(c_p/R)p_1V_1[1-(p_1/p_2)^{-R/cp}].$$

where subscript 1 is referring to the state of gas before expansion and subscript 2 to the state after expansion, $v_R$=circum speed of the working member, D=diameter of the working member, $V_1$=maximum volume of working space before expansion and $p_1$=gas pressure before espansion. By using pressure ratio $p_1/p_2=1.80$ and the relationship $V_1=0.1D^3$, which is approximately valid in the example, it may be concluded that the kinetic energy $W_{gv}$ is about 1% of the work $W_0$ done. The kinetic energy is corresponding to a constant gas speed $\overline{v}_{gv}\simeq 90$ m/s. As by using this mean velocity the relative pressure drop in the valve opening is calculated from the formula $0.5\,\rho_1\,v^2_{gv/P1}$, a numerical value of 0.006 is obtained in the case of helium at the temperature presupposed above.

The calculation presented may roughly indicate pressure losses in the machine, because the working space corresponds to quite a short and wide flow conduit with low friction losses, taking also into account that one side wall is stationary and the other is moving in the direction of gas flow and that a typical circumferential speed of the centre of gravity of the partition wall is about $0.8v_R$. In addition, all kinetic energy calculated above does not necessarily mean loss.

In FIG. 54 it is still presented a course of torque M, as it is supposed that two functional basic units are used in opposite phases in accordance with FIG. 1. Fluctuations in the torque curve are of so high frequency that the inertia of rotating masses is sufficient to maintain the speed of rotation practically constant even at high pressures. In FIG. 30 a timing of different phases is certainly such that it would be possible to use on the same shaft three complete machine units in accordance with FIG. 1 at a phase shift of $\phi_w=30°$, whence a practically ideal torque could be gained.

The moment of the valve action presented in FIG. 54 results in a pressure ratio of the order of 1.8:1, if one-atomic gas is used. By selecting the time interval of valve action otherwise it is yet possible to reach different pressure ratios. If the closing of valves were started in expansion use already at $\phi_w=70°$, it would be possible to achieve even with two-atomic gas pressure ratios more than 2.5:1. The structure of the invented machine makes it possible to regulate at least to some extent the pressure ratio by altering the phase angle of the rotation of valves. Then it would be advantageous to have an additional width in the separating wall 21 so that opening of each virtual valve in expansion use and correspondingly closing in compression use would happen totally in the shield of said separating wall within the whole regulating range.

At the best operating point of the machine the best compromise is achieved between pressure losses and gas leak. To illustrate quantitatively the order of minimal losses, also a relative gas leak is evaluated by using the example of FIG. 54, where working gas is halium at the temperature of 370° K. (97° C.) before expansion, circum speed of the working member being $v_R=80$ m/s. Leaking clearances of the machine may be classified as follows: (1) clearance 13, corresponding to edge 44, (2) clearance 14, corresponding to rim 45, (3) other clearances associated with the process space, including clearances surrounding the valve openings, and (4) clearances associated with pressure compensations. When as a characteristic measure of the machine is used the diameter D of the working member, then as reduced lengths of leaking clearances for one working space may be used values $l_1=0.1D$, $l_2=0.5D$, $l_3=2D$ and $l_4=1D$. These reduced lengths give a correct gas leak as it is thought that leakage takes place during the whole process cycle and a maximal pressure ratio is present over each clearance. The volume leakage during one cycle is reduced to a state of maximum pressure, because it is then readily comparable with the maximal volume of the process space before expansion. Said maximal volume is in the example about $V_1=0.1D^3$, which is the volume of one process space when the partition wall is at $\phi_w=90°$. Gas leak through clearance 13 is supposed to happen with a velocity of sound. As this velocity is reduced to the maximum pressure state, the relationship $$v_1=\frac{\rho_L}{\rho_1}\cdot\left(\frac{c_p}{c_v}\ \frac{T_L}{T_1}\right)^{0.5}\cdot\left(\frac{RT_1}{M}\right)^{0.5}$$

is obtained, subscript 1 referring to the maximum pressure state and L to the Laval state. As numerical values $c_p/c_v=1.67$, $\rho_L/\rho_1=0.650$ and $T_L/T_1=0.750$ of one-atomic gas and molecular weight M=4 kg/kmol of helium are inserted, a numerical value $v_1=0.726(RT_1/M)^{0.5}=0.726(8314\times3700/4)^{0.5}=640$ m/s is obtained. The relative gas leak can be obtained from the equation $$V_1/V_1=(\pi D/2v_R)(0.1D\ \bar{s}_1\ v_1+0.5D\ \bar{s}_2\ v_2+2D\ \bar{s}_3\ v_3+1D\ \bar{s}_4\ v_4)/0.1D^3,$$

where clearances have been divided into four groups listed above. In the following table numerical values of relative gas leak have been presented in cases 1–4, in which various values for mean clearances $\bar{s}_1$–$\bar{s}_4$ as well as reduced speeds $v_1$–$v_4$ have been presumed.

| | case 1 | case 2 | case 3 | case 4 |
|---|---|---|---|---|
| $\bar{s}_1$ | 0.25 mm | 0.25 mm | 0.5 mm | 0.5 mm |
| $\bar{s}_2$ | 0.05 mm | 0.1 mm | 0.2 mm | 0.3 mm |
| $\bar{s}_3$ | 0.05 mm | 0.1 mm | 0.2 mm | 0.3 mm |
| $\bar{s}_4$ | 0.05 mm | 0.1 mm | 0.1 mm | 0.2 mm |
| $v_1$ | 640 m/s | 640 m/s | 640 m/s | 640 m/s |
| $v_2$ | 180 m/s | 250 m/s | 350 m/s | 430 m/s |
| $v_3$ | 75 m/s | 100 m/s | 150 m/s | 200 m/s |
| $v_4$ | 75 m/s | 100 m/s | 100 m/s | 150 m/s |
| relationship for gas leak | $\frac{0.006}{D}$ | $\frac{0.012}{D}$ | $\frac{0.028}{D}$ | $\frac{0.05}{D}$ |
| gas leak, if D = 1 m | 0.6% | 1.2% | 2.8% | 5% |

The clearances supposed are mean values, e.g. clearance $s_1$ may vary within $0$–$2\bar{s}_1$ in ordinary use. It is found on the basis of the calculation that a relative gas leak of 0.5–5% is possible to reach at an operating point where pressure losses are of the order of 1%. As proved earlier, the temperature level or the quality of gas does not effect on the result. If air were used insted of helium, an optimal speed $v_R$ at T=370° K. (97° C.) might be under 30 m/s.

Figure 55:
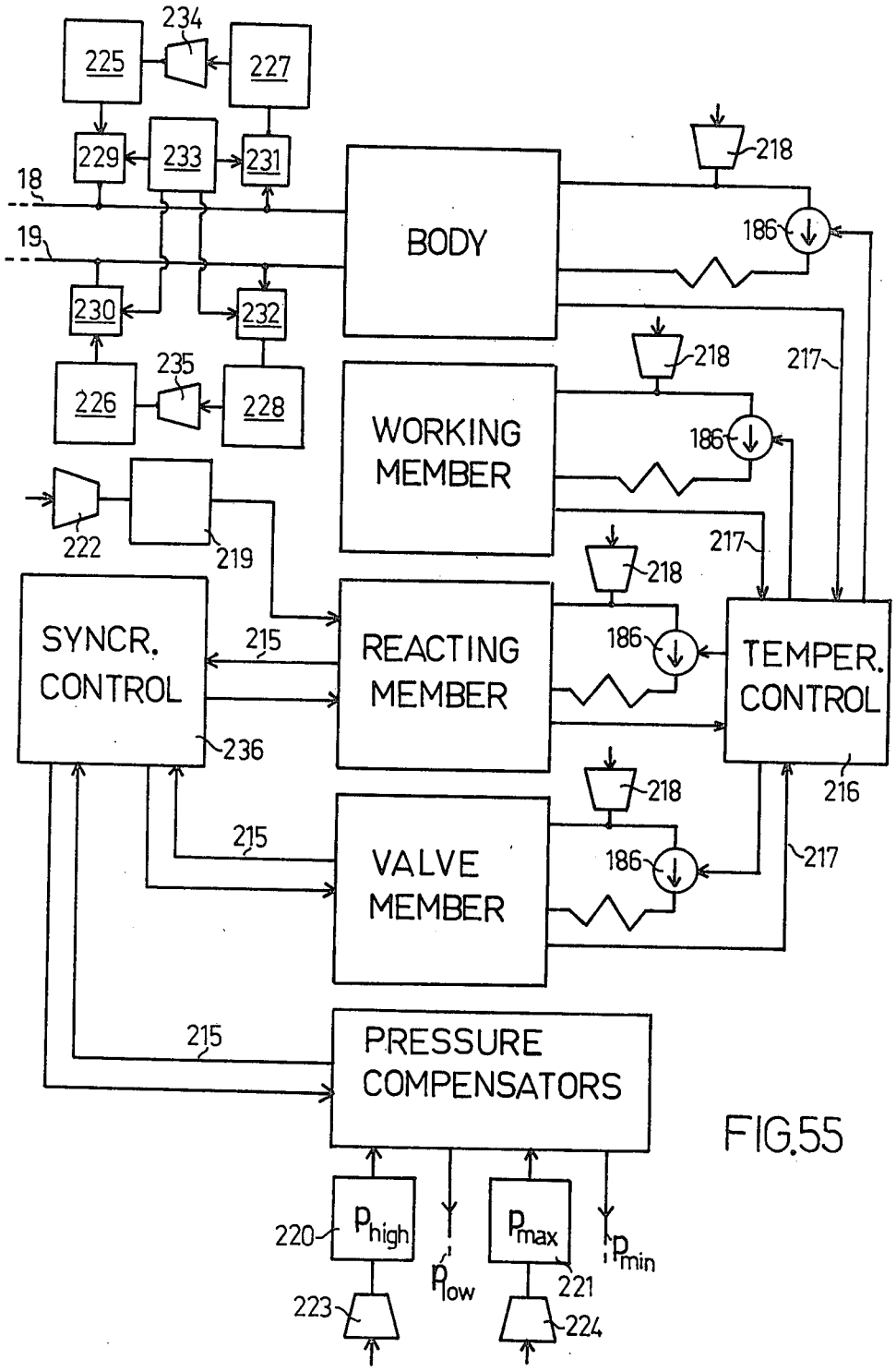
FIG. 55 is a block diagram indicating auxiliary devices associated with one machine unit.

FIG. 55 is presenting a total block diagram including main parts of the invented machine as well as external devices needed for accomplishing control functions presented earlier. External devices include a synchronization control unit 236 for synchronization of the other members with the rotation of the working member. A synchronization sensor circuit 215 may utilize some conventional method, e.g. an optical one. FIGS. 35–43 are presenting one way as to the reacting member. Precision requirements are considerably lower in the case of the valve members as well as pressure compensators. A temperature control unit 216 regulates mass flow through pumps 186 on the basis of temperature measurements with temperature sensor circuits 217. The pressure level in each thermostat circuit is maintained suitable by means of compressors 218. The diagram includes chambers 219–221 for high pressure gas to be supplied to the sealing members in the reacting members and to pressure compensators presented in FIGS. 11 and 14. Pressures needed are produced by compressors 222–224. Conduits for $p_{low}$ and $p_{min}$ may be connected directly to the conduit 19, if the temperature of the working gas is near the ambient temperature. In the case of an expansion machine of a heat power process, a connection may be made into the corresponding conduit 19 of the compressor of the Brayton-cycle. Also is presented means for controlling pressures in the conduits 18 and 19 when a closed process is used. Said means consists of chambers 225–228, valves 229–232, a control unit 233 for regulating said valves so that, when needed, either more gas is entering the process circuit from high pressure chambers 225–226 or part of the gas is removed from the process circuit into low pressure chambers 227–228. Compressors 234–235 are pumping gas from low pressure chambers back into the corresponding high pressure chamber.

The presentation of the embodiment according to FIGS. 1–55 is so detailed that a person skilled in the art can understand as well as accomplish the invented machine. Auxiliary devices presented in FIG. 55 are conventional. As to the two alternatives concerning the sealing member, a selection between them depends on the application in question. If an emphasis is put on structural simplicity and if disturbances caused by a machine connected to the invented machine are small, the former alternative presented in FIGS. 23–24 is adequate.

Figure 56:
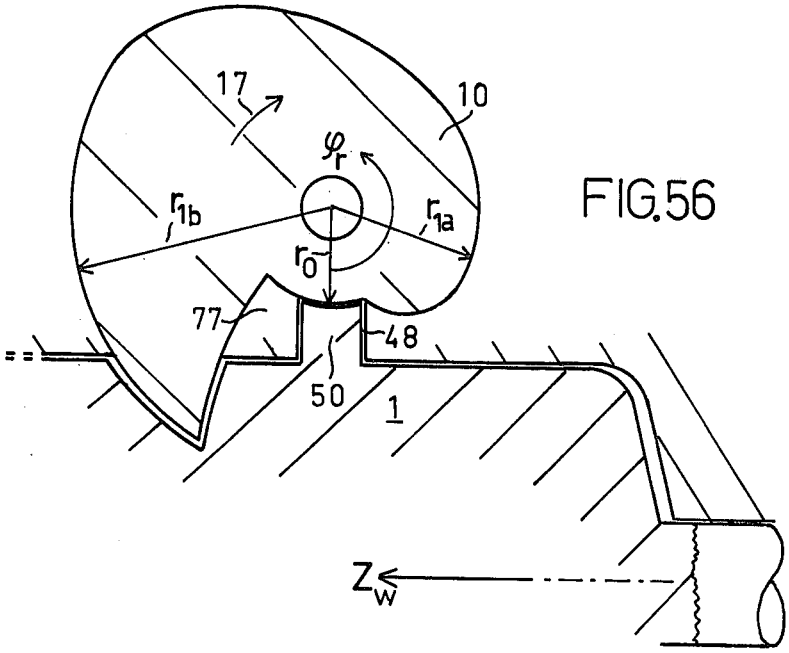
FIG. 56 is a partial sectional side view of one alternative embodiment of the invented machine.
Figure 57:
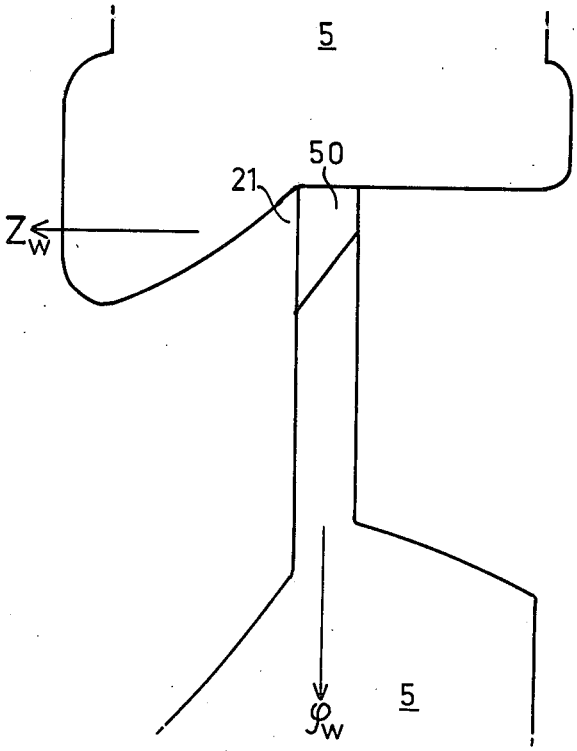
FIG. 57 is illustrating the circumference of the working member in the embodiment of FIG. 56 analogously to FIG. 4.

FIGS. 56–57 illustrate another kind of modification of the invented machine. By this modification it can be achieved in principle an arbitrarily great pressure ratio, which in addition may be regulative. FIG. 56 presents the machine at the section corresponding to FIG. 3, whereas FIG. 57 corresponds to FIG. 4. The rotation space of the working member includes an extension part 48 surrounding the cylindrical main part, the separating wall 21 of the working member being provided with a projection part 50 corresponding to the cross-section of the channel 48 in the body of the machine. The partition wall forming part 10 is provided with one transition sector 77. The edge line of the partition wall forming part 10 is now of such general form that when the angle co-ordinate $\phi_r$ varies starting from the sector, which is turned towards the working member when process cycle changes and the separating wall 21 between working spaces 5 is correspondingly turned towards the reacting member, to a direction corresponding to the order of arrival of various points of said edge line in expansion use into the rotation space of the working member, the radial co-ordinate increases from the minimum value $r_0$ at first to an intermediate value $r_{1a}$, whence the reacting member is extending into the mentioned projection part 48, but not yet into the main part of the rotation space of the working member, and in the second phase to the maximum value $r_{1b}$, whence the reacting member now extends also into the main part of the rotation space, and at last said co-ordinate decreases to the starting value $r_0$ near the completion of the whole circle. The form of the working space corresponds to said form of the reacting member. A process phase corresponding to an open valve is restricted to the projection part 48 resulting in a small cross-section of the partition wall, whereas during the process phase corresponding to the closed valve also the main part of the rotation space is in use, resulting in a great cross-section area of the corresponding partition wall. Consequently, a great volume ratio can be achieved. The valve of the machine may be of the same kind as was presented in connection with the preferred embodiment of the invention. Because the cross-section area of the projection part is small, it is possible to manage with one true value member, by means of which three virtual openings may be formed as presented earlier. If the projection part 48 is located symmetrically in relation to the reacting member, it is possible to interconnect the shafts of said members by means of a universal joint, whence the rotation of the valve member may happen through the reacting member.

However, by using an independent mechanism for rotating the valve member, it would be possible to use a greater valve member and thus achieve a faster closing or opening. Additionally, it would then be possible to regulate the pressure ratio by altering the phase angle of the valve in relation to the other rotating parts. It would thereby be advantageous to have an additional width in the separating wall in such extent that closing of the valve in compression use as well as opening in expansion use would happen completely in the shield of said separating wall within the whole regulating range.

FIGS. 58–59 illustrate still another modification of the invented machine. In this modification no true valves are needed. FIG. 58 is corresponding to FIG. 3 and FIG. 59 to FIG. 4. Again, the partition wall forming part 10 has one transition sector 77. The edge line of the partition wall forming part 10 of the reacting member has now such general form that as the angle co-ordinate $\phi_r$ is varying starting from the sector, which is turned towards the working member, when the process cycle changes and the separating wall 21 between working spaces 5 is turned correspondingly towards the reacting member, to a direction corresponding to the order of arrival of various points of said edge line in expansion use into the rotation space of the working member, the radial co-ordinate is increasing from the minimum value $r_0$ to the maximum value $r_1$, decreasing after this to an intermediate value $r_2$, and finally to the starting value $r_0$ near the completion of the whole circle. FIG. 59 is presenting the form of the working space 5 as a function of the rotation angle $\phi_w$ of the working member and of the co-ordinate z in the direction of the rotation axis of the working member. It is characteristic of the working space that a section 237 at the process space end, corresponding to the maximum radius $r_1$ of the reacting member, is extending further sidewise in direction of the rotation axis of the working member than any other part of the working space. When the gas opening 26 may be located in the body of the machine so that in direction of the circumference of the working member it is located on the process space side of the partition wall 15 and extends close by said wall so far in direction of the rotation axis of the working member that only the mentioned section 237 extends to the position of said opening. Accordingly, the valve operation may be based on the rotation of the working member. The opening 26 is closed by the unbroken part 238 of the circum surface of the working member. Thus in expansion use the valve starts to open, when the process space end of the working space and thus also the section 237 is passing the position of the partition wall 15, and the valve is closing as the section 237 has proceeded over the opening 26.

FIG. 60 illustrates a possibility to combine two functional units 40 in parallel so that reacting forces induced are compensating each other. It would be easiest to utilize this possibility in connection with the embodiment in accordance with FIGS. 58–59, because then the valves are not in the way. To the reacting member 8*a* situated between working members 1 a compressive stress is induced, whereas to the shaft 9 between reacting members 8*b* a tensile stress. By using a force pair F—F it would be possible to arrange a compensating moment whence a bending moment to the shaft 9 can be avoided.

INDUSTRIAL APPLICABILITY

In order to illustrate possibilities of applying the invented machine in a heat power process it is examined in the following a two-stage Brayton cycle according to FIG. 61 including two expansion machines $M_e$ one after another with corresponding heat exchangers $E_h$ in front of each machine, and correspondingly two compression machines $M_c$ one after another with corresponding heat exchangers $E_l$ in front of each machine. In addition, the process includes heat exchanger $E_r$ between hot and cold sides. Incoming heat flow $\dot{Q}_{in}$ is transformed partly into mechanical work. Engines $M_e$ deliver power $P_e$, whereas compressors $M_c$ consume power $P_c$. As is well known, an ideal Brayton cycle consists of isentropic phases in engines as well as in compressors and isobaric phases in heat exchangers. In order to analyse the cycle mathematically each real expansion machine is replaced by a substitute model in accordance with FIG. 62, and correspondingly the compressors are replaced by a substitute model in accordance with FIG. 63. The substitute models have an ideal expansion or compression machine $M_e^*$ or $M_c^*$ with a parallel block 239 denoting relative gas leak a, and a serial block 240 denoting relative pressure change b especially in the valve opening.

If the pressure ratio in the real expansion machine is $p_3/p_4$, appears the pressure ratio $(1-b)p_3/p_4$ over the ideal expansion machine, resulting in a temperature fall of working gas $$T_3-T_4^*=\{1-[(1-b)(p_3/p_4)]^{-R/cp}\}T_3$$

in isentropic expansion, temperature notations being those expressed in FIGS. 61–63. As gas leak is supposed to happen isothermally for a dominating part (after transformation of kinetic energy of leaking gas into heat), temperature fall of gas in the real expansion machine is $$T_3T_4=(1-a)\{1-[(1-b)(p_3/p_4)]^{-R/cp}\}T_3.$$
$$=f_E(a,b,p_3/p_4)T_3.$$

correspondingly, over the ideal compression machine appears the pressure ratio $(1+c)(1+b)(p_3/p_4)$, where term c is taking into account pressure losses in the heat exchangers of the process circuit. Thus, it is obtained for the rise of working gas temperature in the ideal compression machine the equation $$T_1-T_0^*=\{[(1+c)(1+b)(p_3/p_4)]^{R/cp}-1\}T_0^*$$

in isentropic compression. If the dominating gas leak takes place isothermally, then by applying the realtionship $T_0=(1+a)T_0^*-aT_1$ obtainable from the joint point 241 for a temperature rise in the real compression machine is obtained the equation $$T_1-T_0=\frac{(1+a)\{[(1+c)(1+b)(p_3/p_4)]^{R/cp}\}-1}{1-a\{[(1+c)(1+b)(p_3/p_4)]^{R/cp}\}-1}T_0=$$
$$g_C(a,b,c,p_3/p_4)\,T_0.$$

In the equations presented there have been at the same time defined functions f and g for expressing generally the size of temperature change in isentropic expansion or compression, as f-function is multiplied by the maximum temperature of the temperature range in question and correspondingly g-function by the minimum temperature, subscript E denoting expansion and subscript C compression.

For process effeciency or the ratio of the difference of powers of expansion and compression machines to the heat flow coming into the process is then obtained equations $$\eta=\frac{P_e-P_c}{\dot{Q}_{in}}=\eta_1\frac{(T_3-T_4)-(T_1-T_0)}{(T_3-T_4)+(T_4-T_2)/N}=$$
$$\eta_1\frac{f_E\,T_3-g_C\,T_0}{f_E\,T_3+(1-e)(T_4-T_1)/N},$$

where N=the number of stages one after another (in FIG. 61 N=2), $e=(T_2-T_1)/(T_4-T_1)$ is the temperature effeciency of the heat exchanger $E_r$, and coefficient $\eta_1$ is taking into account heat losses into walls of hot spaces.

Figure 64:
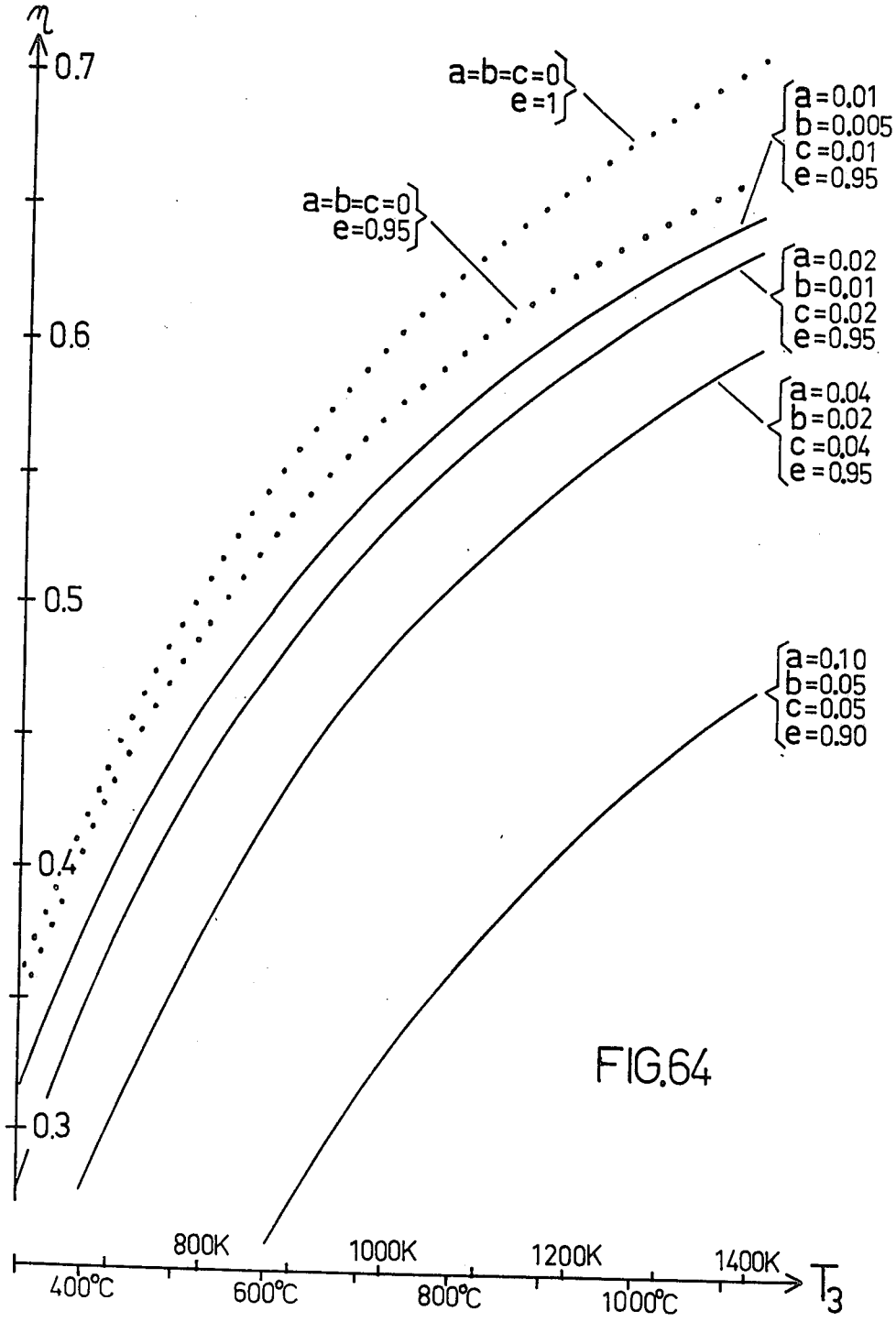
FIG. 64 is a graphical diagram illustrating the process efficiency of the process according to FIG. 61 as a function of the maximum gas temperature as various loss parameters have certain numerical values.

FIG. 64 presents graphically the process efficiency $\eta$ as a function of the maximum temperature $T_3$ of gas with various values of loss parameters a,b,c and e, when the minimum temperature of gas is $T_0=300°$ K. (27° C.), working gas is one-atomic, e.g. helium, the pressure ratio $P_3/P_4=1.80:1$, number of stages N=2 and $\eta_1=0.97$. Dotted curves present theoretical upper limits of the effeciency. It is noted that, for example, in case of the combination a=0.02, b=0.01, c=0.02 and e=0.95, the effect of losses is quite small. When a closed high-pressure process with helium as working gas is used, the temperature efficiency e=0.95 used in calculations is fully realistic.

As it was stated earlier, losses within the machine in principle do not depend on the working gas used. Therefore, also the use of air as working gas may come into question. As then the speed of rotation would be lower, it would be possible to use a smaller machine with an electric generator producing the frequency of a general electric network.

As it may be concluded from FIG. 61, waste heat flow $\dot{Q}_{out}$ can be removed from the process in a profitable form from the secondary side $E_{ls}$ of the counter-current heat exchanger $E_l$. If the pressure ratio in the machines of the process were of the order 1.8:1, a rise of temperature in the compressor and also on the secondary side of the heat exchanger would be of the order of 80° C. By selecting the pressure ratio properly the process may be planned for various uses of waste heat.

In evaluating the over-all electric effeciency of a power plant also losses of electric generators and in fuel-fired power plants also in a burning process must naturally be taken into account.

To prove that the specific power of the inverted machine is high enough, it is presented in the following table the quantity $P_{out}$, which is the difference of powers of the expansion machine $M_e$ and the compressor $M_c$ as well as the quantity $(m_e+m_c)/P_{out}$, which is the sum of weights of the both machines divided by $P_{out}$, as a function of the diameter D of the working member of the expansion machine and of pressure $p_1$ before expansion:

| | $p_1$ = 25bar | | $p_1$ = 50bar | | $p_1$ = 100bar | |
|---|---|---|---|---|---|---|
| | $P_{out}$ | $(m_e+m_c)/P_{out}$ | $P_{out}$ | $(m_e+m_c)/P_{out}$ | $P_{out}$ | $(m_e+m_c)/P_{out}$ |
| D = 0.25m | 1.3MW | 2kg/kW | 2.5MW | 1kg/kW | 5MW | 0.5kg/kW |
| D = 0.5m | 5MW | 4kg/kW | 10MW | 2kg/kW | 20MW | 1kg/kW |
| D = 1.0m | 20MW | 8kg/kW | 40MW | 4kg/kW | 80MW | 2kg/kW |

Each expansion and compression machine has been thought to comprise two functional units in accordance with FIG. 1. Working gas is supposed to be helium and the circum speed of the working member of the expansion machine $v_R=120$ m/s. The maximum temperature of working gas is supposed to be about 800° K. (about 530° C.). If air were used as working gas instead of helium, power attainable would be about half of that indicated in the table due to a lower speed of rotation. Most of weight is in the stationary body of the machine, which may be lightened somewhat e.g. by radially extending cavities, whence individual material thicknesses are not so great thinking about manufacturing e.g. by using casting technique. If the body is composed of several parts by using welding technique, possibilities for a considerable lightening are good.

As a typical weight of a condensing turbine is about 5–10 kg/kW, the invented machine should be fully competitive. It can also be proved that weights of heat exchangers needed in the Brayton-process are only of moderate order, when a closed high pressure process is used, especially with a light-weighted working gas. Besides, heat exchangers are needed also in a Rankine-cycle. Weights of non-condensing turbines may be of the order of 1 kg/kW, but the effeciency as to mechanical or electric energy is essentially lower. One interesting reference would be slowly running dieselengines, e.g. in large ships or for power plant use, which may have a weight of 40 kg/kW, for example. In addition to the high weight of the engine drawbacks include that only expensive oil can be utilized as energy source and that life time is not the best possible.

In the use of the invented machine for energy storing said machines are used as components performing expansion and compression in a reversible storing process.

Figure 65:
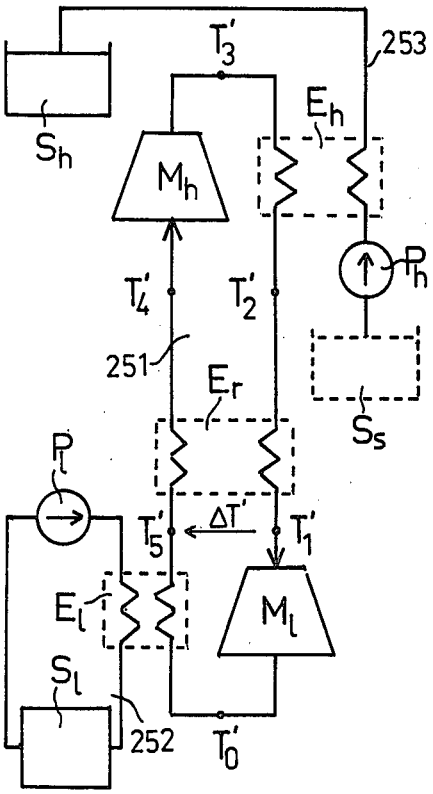
FIG. 65 is a process diagram illustrating a charging period of an energy storing process, in which the invented machine is used as a component.
Figure 66:
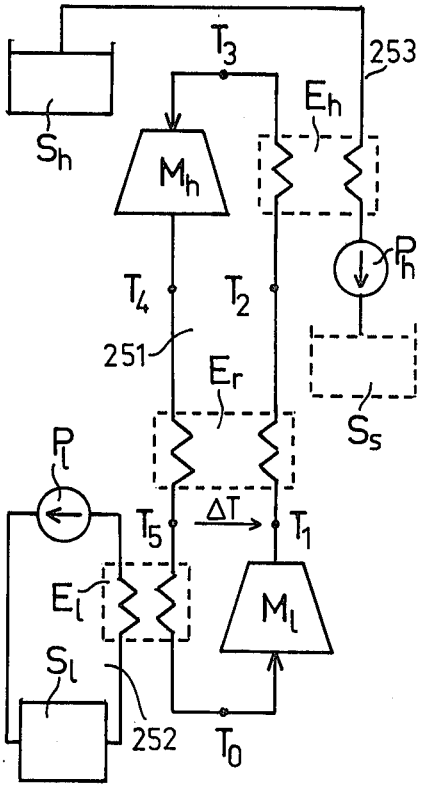
FIG. 66 is a process diagram illustrating a discharging period of an energy storing process, in which the invented machine is used as a component.

FIGS. 65–66 present process diagrams of the energy storing process especially when a solid cold store is used, FIG. 65 corresponding to a charging period and FIG. 66 to a discharging period. The process cycle 251 is a Brayton-cycle provided with a heat exchanger $E_r$ between warm and cold parts of the circuit. The cycle includes a machine $M_h$ working near or above the ambient temperature and a machine $M_l$ working below the ambient temperature. During a charging period the machine $M_h$ functions as a compressor, whereas the machine $M_l$ operating on a lower temperature level functions as an expansion machine. Consequently, mechanical work must be fed to the process during the charging period. During said period the working gas is warmed in the compressor $M_h$ from temperature $T_4'$ to temperature $T_3'$. Then the gas is cooled in a counter-current heat exchanger $E_h$ to temperature $T_2'$, in other words approximately to the temperature before compression. Water taken from a cold water store $S_s$ or from an open water supply is circulated by means of a pump $P_h$ in the circuit 253 so that the temperature of the water rises in the heat exchanger $E_h$ e.g. to 90°–100° C., whereafter the water is stored in a hot water store $S_h$. Then the working gas is further cooled in the heat exchanger $E_r$ to temperature $T_1'$ and after that in the expansion machine $M_1$ to temperature $T_0'$. The gas is then warmed up in the counter-current heat exchanger $E_l$ to temperature $T_5'$, thus making it possible to remove heat from the cold store $S_l$. Then the working gas is heated in the heat exchanger $E_r$ to the temperature $T_4'$ mentioned earlier, at which the process cycle has become completed.

The maximum temperature $T_3'$ of the gas may naturally be permitted to exceed +100° C. by an amount corresponding to a temperature difference needed in the heat exchanger $E_h$. Additionally, the minimum temperature of water may be even under 0° C., if salty water is used.

In the cold store circuit 252 some fluid, e.g. air is circulated with the aid of pump means $P_l$. The cold store $S_1$ being of solid material it may be provided with a multiplicity of parallel flow conduits, so that the store may be used as a regenerator having a very great time constant. Thus, during a charging period the temperature of the cold store decreases slowly. To achieve as reversible operation as possible, a temperature gradient is permitted to be created in the storing material in the direction of conduits so that the temperature difference between the ends of the store is of the same order as the change of gas temperature in the machine $M_1$ working at a lower temperature level.

During a discharging period the process is used in the opposite direction. Then the machine $M_h$ working at a higher temperature level is used as an expansion machine, whereas the machine $M_l$ working at a lower level is used as a compressor. Consequently, the process is capable of producing mechanical work. From the store $S_h$ is taken hot water, which is cooled down in the process before going into the cold water store $S_s$ or to the open surroundings. As working gas is cooled in the heat exchanger $E_l$ from temperature $T_5$ to temperature $T_0$, the corresponding heat amount is got into the cold store $S_l$, the temperature of which thus slowly rises.

In practice the process may include both on the warm and cold sides several machine heat exchanger pairs ($M_h-E_h$, $M_l-E_l$) in series, resulting in smaller losses caused by the heat exchanger $E_r$ having a certain temperature efficiency.

The process diagram presented may be modified so that the cold store $S_l$ is directly a part of the circuit 251, whereby working gas would circulate through the cold store, the heat exchanger $E_l$ as well as the pump means $P_l$ being omitted. On the other hand, an additional liquid-form circuit between the cold store $S_l$ and the process circuit 251 may be used for transmitting the cold capacity over a considerable distance.

The change of water temperature in the storing process may be of the order of 40°–100° C., whereby the corresponding change of gas temperature in the cold machine $M_l$ may be 10°–60° C., depending partly on the temperature level at which the cold machine functions at each moment.

Figure 67:
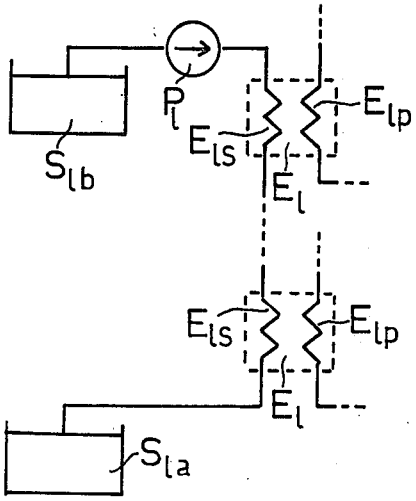
FIG. 67 is a process diagram illustrating a cold store part of the energy storing process, if liquid cold store material is used.
Figure 68:
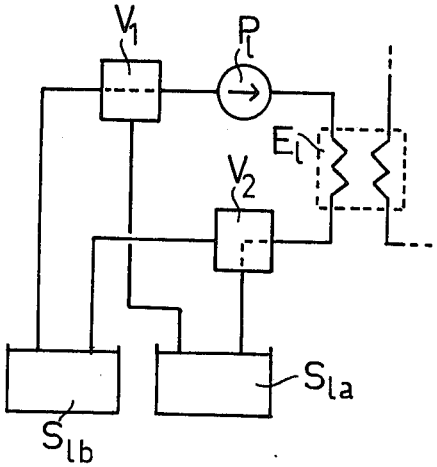
FIG. 68 is a process diagram illustrating an alternative cold store part of the energy storing process, as liquid cold store material is used.

FIGS. 67–68 present partial process diagrams for a charging period, when liquid material is used in the cold store. If the material is in a liquid form over a wide temperature range, e.g. between −40° C.−−180° C., the whole range may not be utilized in one process stage. Then it is possible to use arrangements according to FIGS. 67–68. In the both cases two cold store units are used, the store unit $S_{1a}$ containing colder liquid and the unit $S_{lb}$ warmer liquid. In FIG. 67 the temperature of liquid in the store $S_{lb}$ is at an upper limit of the temperature range used and during a charging period liquid taken from the said store unit is circulated by the pump $P_1$ through several heat exchangers $E_1$, the cold store sides of which are connected in series and being thus cooled down to the lower limit of the total temperature range used before transferring into the store unit $S_{1a}$, which thus receives liquid having a minimum temperature. The opposite sides $E_{1p}$ of corresponding heat exchangers are each connected to corresponding process cycles, which are in parallel, but the lower temperatures of which are stepped so that temperature ranges in cold machines of the various circuits together cover the temperature range used for cold liquid. The parallel circuits mentioned may be wholly separate, or they may have the machine $M_h$ and the heat exchanger $E_h$ in common. In FIG. 68 only one process cycle is needed. Cold liquid is transferred by the pump $P_l$ during charging period from a warmer store unit into a colder one, until the first-mentioned store is empty. Then the direction of circulation is reversed by using valve means $V_1$ and $V_2$ so that liquid is transferred from the full store into the empty one and is still cooled because direction of circulation remains unchanged regarding the heat exchanger $E_l$. After each reversion of curculation the working temperature level of the cold machine $M_l$ is lowered. The described manner of proceeding may be repeated until the whole temperature range has been utilized.

The cold store side of the process may be also based on liquefying of air. Because air cannot be stored in a gas form in great quantities, during the charging period air taken from the atmosphere must be cooled at least to the boiling point of air in addition to liquefying. Then the process machinery needed may be more complicated than in the case of a store having material continuously in a solid or liquid form. On the other hand, specific capacity is increased if also the capacity involved in cooling and heating of air is utilized. One difficulty associating with the use of air is that the invented machine fits well with a Brayton-cycle having isentropic work phases, whereas in utilizing heat involved in liquefying and boiling, isothermal work phases would be natural for achieving a reversible process. In the process diagram presented in FIG. 69 the problem mentioned has been solved. Moreover, moisture of air can be separated. In said process a major part of the energy is going through the circuit 251 connected as a Brayton-cycle, and being analogous to that in FIGS. 65–66. By means of said circuit it is possible to remove from air a heat amount released during liquefying and to pump said heat into the warm reservoir $S_h$. The cold machine $M_l$ operates e.g. within a temperature range of 20°–25° C., in the case of the example so that the normal boiling point of air (about 80° K. or −193° C.) constitutes a lower limit. Liquefying during charging period as well as boiling during discharging period has been distributed evenly over the whole temperature range of the cold machine so that air passes through the heat exchanger $E_l$ in several parallel conduits $C_1$–$C_n$, the pressures in various conduits being stepped gradually so that the boiling points are distributed over the whole temperature range of the cold machine. During the discharging period liquid air taken from the cold store $S_l$ is pumped by machines $P_{l1}$–$P_{ln}$ to pressures needed in each flow conduit. Thus, the operation of the heat exchanger $E_l$ can be arranged to be wholly reversible in principle.

Since the partial pressure of oxygen is about 20% of the total pressure of air, the boiling points of oxygen and nitrogen in air are quite near each other, whence boiling of air takes place within quite a narrow temperature range, which as a rough approximation can be called the boiling point of air in the total pressure in question. The temperature of air at each joining point $i_1$–$i_n$ of the corresponding flow conduit $C_1$–$C_n$ to the heat exchanger $E_l$ is arranged to correspond to the boiling point or strictly speaking to the upper limite of the boiling range at the pressure in question. In a charging period combinations of pressure and temperature corresponding to the vapour pressure curve are arranged in the following way. Adapting of pressure is accomplished so that in each flow branch $C_1$–$C_{n-1}$ expansion machines are used $M_{r1}$–$M_{r(n-1)}$ having an individual pressure ratio selected to result in the wanted pressure after expansion. Adapting of temperature as a correct one is accomplished so that air passes through the heat exchanger $E_{rl}'$, which is cooling air during the charging period. The air side of said exchanger is provided with joining points $j_1$–$j_n$ for parallel air conduits $C_1$–$C_n$, the joining points being situated so that the temperature of air at each joining point is suitable for the conduit in question.

During charging the input point 256 of air leads to a chain of machines $M_1$–$M_k$ functioning as compressors for compressing air into a high pressure. The chain includes heat exchangers $E_1$–$E_k$ for cooling air warmed up to about 100° C. back near the temperature of cold water. Thus, on the opposite sides of the heat exchangers water going into the warm water store $S_h$ can be heated. During isobaric cooling of air in said heat exchangers the moisture of air is condensed and can be separated. From the last machine $M_k$ of the chain the high pressure air during charging period goes into the expansion machine $M_{r0}$, in which air is cooled considerably due to expansion, e.g. to a temperature of the order of 150 K. (about −120° C.), after which the air goes to the input $j_0$ of the heat exchanger $E_{rl}'$.

Figure 69:
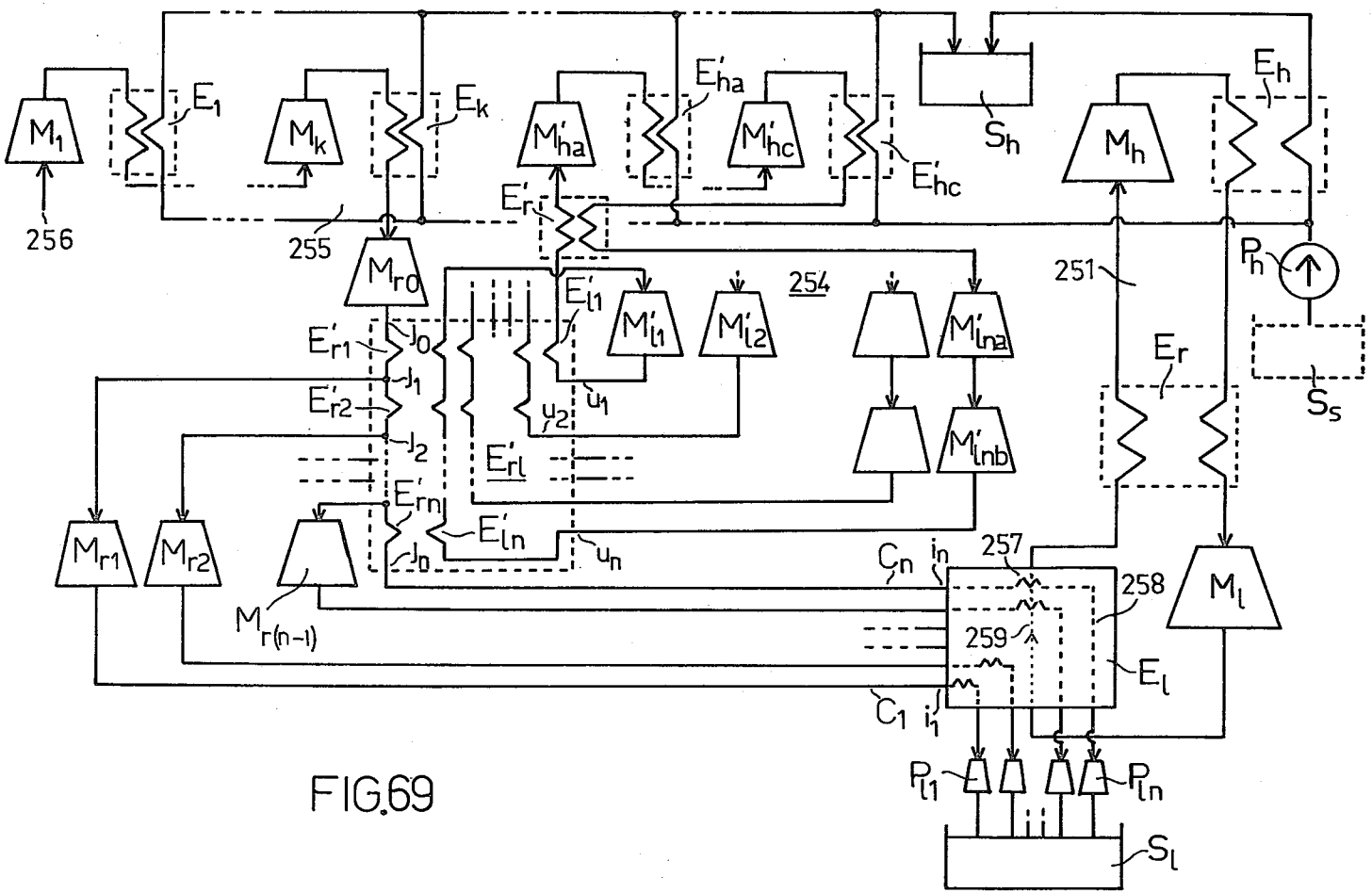
FIG. 69 is a process diagram of the energy storing process, if the cold store side of the process is based on liquefying air.

In the process diagram of FIG. 69 parallel air streams arrive during charging period to the cold side heat exchanger of Brayton-cycle at individual points $i_1$–$i_n$ in the direction of the flow of working gas so that the temperature of working gas at each point approximately corresponds to the boiling point of air at a pressure corresponding to each flow conduit $C_1$–$C_n$ so that in each flow circuit is firstly accomplished liquefying of air within the section 257 of the flow conduit which is transversal in relation to the flow direction 259 of working gas, and subsequently cooling of liquid within the section 258, in which the direction of flow is opposite to that of working gas, at least to the normal boiling point of air. Alternatively, it is possible to join all parallel branches to the heat exchanger at the maximum temperature end, whence air ought to be cooled in a gaseous state at first. Temperatures at input points of various branches would be the same, whence a need for compensating temperature falls occuring in expansion machines $M_{r1}M_{r(n-1)}$ would be greater than in FIG. 69.

For removing heat from the cooling air in the heat exchanger $E_{rl}'$ working gas of Brayton-cycle flows on the opposite side of said exchanger. Due to branching of air flow the heat capacity of the flow is also different at various points of the exchanger. To achieve a reversible operation, the working gas flow must be made to vary correspondingly by using in the exchanger $E_{rl}'$ several working gas circuits $E_{l1}'$–$E_{rn}'$ situated geometrically in parallel, the lower temperature ends $u_1$–$u_n$ of which being drawn away from the exchanger at points corresponding to joining points $j_1$–$j_n$ of the air flow. Each working gas circuit $E_{l1}'$–$E_{1n}'$ functions as a cold side heat exchanger of a Brayton-cycle with a corresponding cold machine $M_{l1}'$–$M_{ln}'$. The temperature change on the air side of $E_{rl}'$ within the section $E_{r1}'$ adjacent to the machine $M_{r0}$ may be of the order of 10°–20° C., whence a moderately great temperature variation results in the first cold machine $M_{l1}'$. On the other hand, within other sections $E_{r2}'$–$E_{rn}'$ temperature ranges may be small, the size of the temperature range growing gradually from one cold machine to another. If the number of parallel branches $C_1$–$C_n$ is very great, it is possible without essential losses to use a more rough division on the working gas side so that one working gas circuit corresponds to two or several branches for air flow.

Branches consisting of heat exchange circuits $E_{l1}'$--$E_{ln}'$ and cold machines $M_{l1}'$-$M_{ln}'$ can be joined to form cold side circuits of parallel Brayton-cycles having approximately the same pressure ratio, so that the sum of temperature ranges of cold machines in each process is approximately the same, and the total pressure ratio is divided on the warm side of the process over several compression machines in series so that the temperature rise of working gas during charging period is suitable for warming up water going into the warm store $S_h$. In FIG. 69 it has been presented how components $E_{l1}'$ and $M_{l1}'$ of the first circuit have been combined with corresponding components $E_{l1}'$, $M_{lna}'$ and $M_{lnb}'$ of the last circuit. The Brayton-cycle thus formed includes on the warm side machines $M_{ha}'$-$M_{hc}'$ and heat exchangers $E_{ha}'$-$E_{hc}'$ and between the warm and the cold side the heat exchanger $E_r'$. As presented in FIG. 69, in circuits extending near the lower temperature end of the heat exchanger $E_{rl}'$ there may be used two machines ($M_{lna}'$, $M_{lnb}'$) in series to cover the temperature range needed. By using circuits presented in FIG. 69, it is possible to achieve in principle a fully reversible operation of heat exchanger $E_{rl}'$ as well as on the cold sides of Brayton-cycles. Possible unfitnesses of quantitative dimensioning may be shifted to the warmer side, whence only a slight lowering of efficiency of use of waste heat of the process is resulting.

In the process presented hot water going into the warm store may be produced in three parallel circuits, namely in the phase change circuit 251, in the temperature change circuit 254 and in the pressure change circuit 255. The two circuits mentioned first are closed Brayton-cycle circuits, in which helium or hydrogen may be used as working gas. The third circuit is an open air circuit, which includes machines $M_1$-$M_k$ working above or near the ambient temperature as well as machines $M_{r0}$-$M_{r(n-1)}$ working under the ambient temperature. During discharging period the process is run in an opposite direction. Liquid air is then taken from the cold store $S_1$, and gaseous air is released into the atmosphere from the point 256. Hot water taken from the the warm store $S_h$ is cooled and transferred into the cold water store $S_s$ or to the surroundings The total process is reversible in principle, whence possibilities to a good efficiency are existing. Most of energy goes through the circuit 251, which is analogous to the circuits in FIGS. 65-66. As in the heat exchanger $E_l$ liquefying and boiling of air take place the heat exchange coefficient is good during charging as well as discharging periods. Although a pressure of 1 bar is used at the low temperature end of $E_l$, the temperature at the low temperature end of $E_r$ would be about 100 K. (−170° C.) or more, whence in case of helium as a working gas the pressure dependancy of the specific heat of the working gas would yet be so small that conditions for a theoretically ideal heat exchanger $E_r$ between the warm and cold sides of the Brayton-cycle still exist.

The process diagram presented may be modified e.g. so that the temperature range of the heat exchanger $E_l$ is shifted to a higher temperature level, e.g. within a range 100° K.-120° K. (−170° C.--150° C.) and to a correspondingly higher pressure range. Then below $E_1$ would be situated one heat exchanger connected to the corresponding Brayton-cycle for reversibly altering the temperature of liquefied air.

Most of the machines presented in FIG. 69 possess such a pressure ratio that the preferred embodiment of the invented machine is well suitable. Machine $M_{r0}$ may have quite a high pressure ratio, but a use of 2-3 machines in series would result in the proper ratio. Alternatively, the embodiment presented in FIGS. 56-57 may be used. At the low pressure end of the chain $M_1$-$M_k$ some turbo-machines may be used without a considerable increase of losses of the process.

Figure 70:
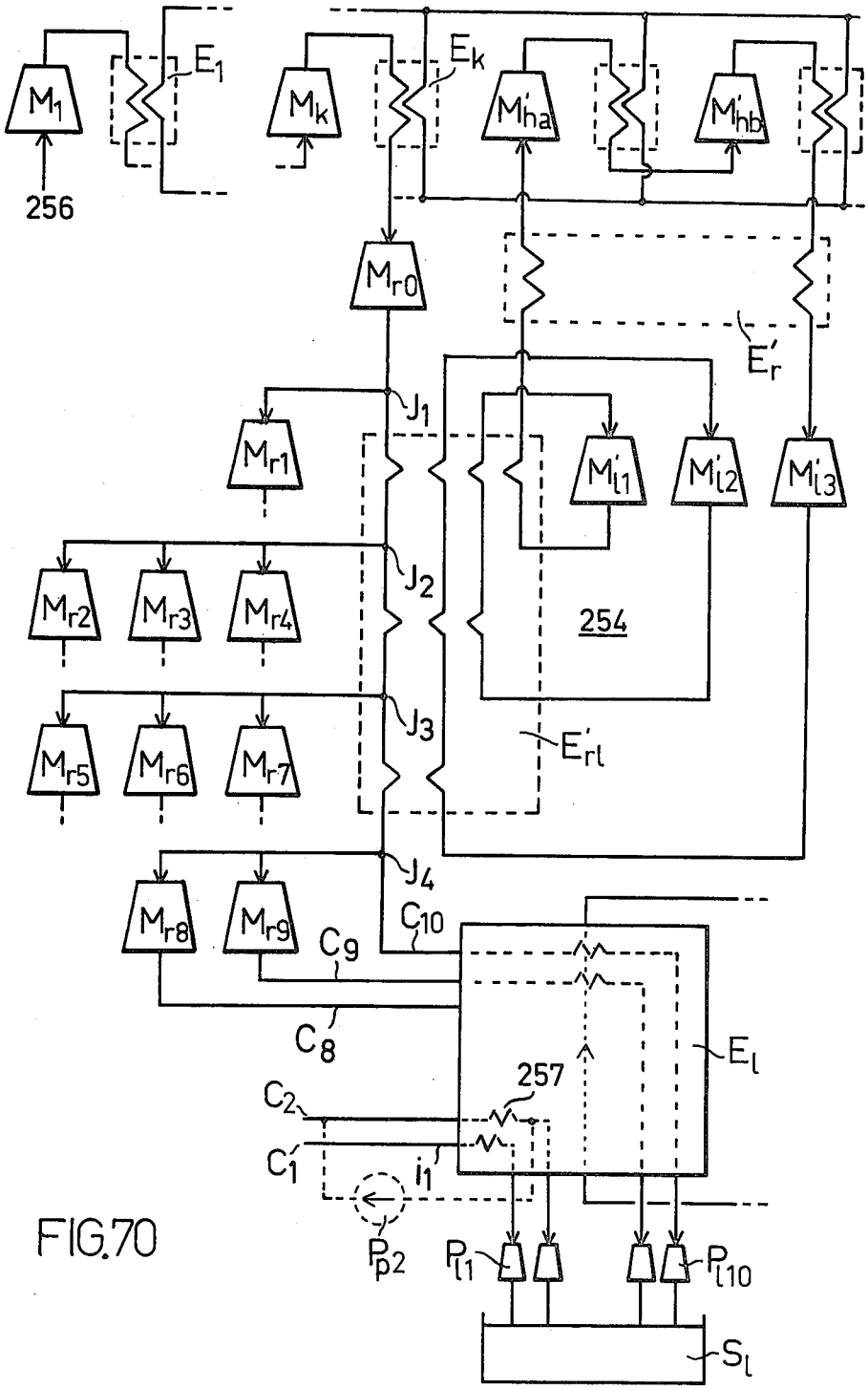
FIG. 70 a partial process diagram illustrating a modification of the process shown in FIG. 69.

FIG. 70 presents a partial process diagram relating to that presented in FIG. 69. The modification of FIG. 70 aims at simplfying the temperature change circuit 254 of FIG. 69. Now, suitable combinations of pressure and temperature for parallel flow conduits $C_1$-$C_n$ of the heat exchanger $E_l$ are achieved by permitting, during the charging period, a small fraction of cooling air liquefy in some expansion machines $M_{r1}$-$M_{r(n-1)}$, whence an amount of heat needed for keeping the temperature of air at the boiling point at the pressure in question is released. In FIG. 70 a numerical value n=10 has been presumed, whence machines $M_{r1}$-$M_{r9}$ are needed. Said machines are divided into four groups, each of which includes 1-3 machines. Pressure ratios in machines $M_{r1}$, $M_{r4}$ and $M_{r7}$ are designed to result in a suitable combination of pressure and temperature at the corresponding input points $i_1$ etc., whereas in the other machines a few percents of air is liquefied for reaching the proper combination. In the heat exchanger $E_{rl}'$ only four branching points $j_1$-$j_4$ are needed. Consequently, cooling of air may be accomplished by using only one Brayton-cycle circuit 254 having in the example three cold machines $M_{l1}'$-$M_{l3}'$ in series. During discharing period a certain fraction of liquid air is conducted by pump means ($P_{p2}$ etc.) past the boiling sections 257 of the conduits 2, 3, 5, 6, 8 and 9. Said liquid may be sprayed into gaseous air stream, whence it is boiling during the compression process in the corresponding machines $M_{r2}$, $M_{r3}$, $M_{r5}$, $M_{r6}$, $M_{r8}$ and $M_{r9}$. Thus, also this modification is a reversible process. In other respects the diagram would be the same as in FIG. 69.

Diagrams presented in FIGS. 69-70 are additionally serving as an example when using the invented machine generally for liquefying air or other gases with a good efficiency.

Figure 71:
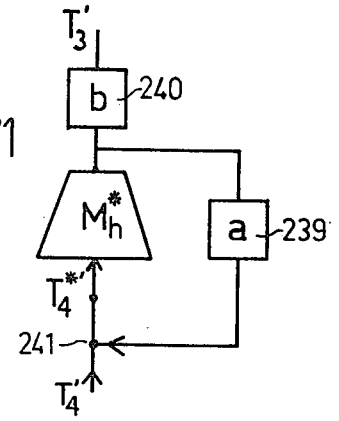
FIG. 71 is a block diagram of a substitute model corresponding to a real ambient temperature machine in FIG. 65.
Figure 72:
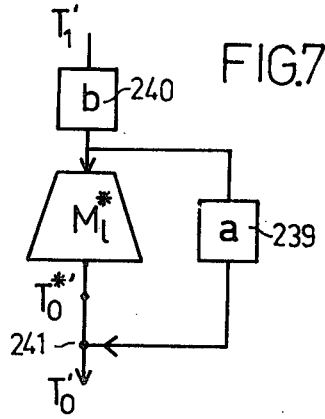
FIG. 72 is a block diagram of a substitute model corresponding to a real low temperature machine in FIG. 65.

In order to give evidence of utility of the storing process in the following is derived a formula for the efficiency of the process in question. The derivation is performed onthe basis of FIGS. 65-66. To accomplish this, the machines of the process are replace by substitute models, FIGS. 71-72 describing them in case of a charging period. Each substitute model includes an ideal machine $M_H$* or $M_L$*, a parallel block 239 denoting relative gas leak a and a serial block 249 denoting relative pressure change b especially in the valve opening. As working gas is considered to be ideal gas, the temperature fall of the working gas in the ideal expansion machine may be expressed by the equation $$T_1'-T_0^{*\prime}=\{1-[(1-b)\pi']^{-R/cp}\}T_1'=\{[(1-b)\pi']^{R/c_p}-1\}T_0^{*\prime}$$

in isentropic expansion, where $\pi'$ is denoting pressure ratio in the real expansion machine, temperature notations being those indicated in FIG. 72. By using the relationship $T_0'=a\ T_1'+(1-a)\ T_0^{*\prime}$ obtainable from joint point 241 of FIG. 72, as gas leak is though to happen dominantly isothermally (transformation of kinetic energy of leaking gas into heat beng taken into account), the temperature fall in the real expansion machine may be expressed in forms $$T_1' - T_0' = (1-a)(T_1' - T_0^{*\prime}) = (1-a)\{1-[(1-b)\pi']^{-R/cp}\}T_1' = f_E(a, b, \pi')T_1',$$

$$T_1' - T_0' = (1-a)(T_1' - T_0^{*\prime}) = \frac{(1-a)\{[(1-b)\pi']^{R/cp}-1\}}{1+a\{[(1-b)\pi']^{R/cp}-1\}}T_0' = g_E(a, b, \pi')T_0'.$$

Correspondingly, the temperature rise of working gas in the ideal compression machine may be expressed in the form $$T_3' - T_{44}^{*\prime} = \{1-[(1+c)(1+b)\pi']^{-R/c_p}\}T_3' = \{[(1+c)(1+b)\pi']^{R/c_p}-1\}T_4^{*\prime}$$

in isentropic compression, where $\pi'$ is denoting pressure ratio in the real expansion machine of the process and c is denoting relative pressure losses in heat exchangers of the process circuit. Supposing that gas leak takes place dominantly isothermally, it may be obtained the relationship $T_4^{*\prime}=[1/(1+a)]T_4'+[a/(1+a)]T_3'$ from joint point 241 of FIG. 71. Then the temperature rise of working gas in the real compression machine may be expressed in forms $$T_3' - T_4' = (1+a)(T_3' - T_4^{*\prime}) = (1+a)\{1-[(1+c)(1+b)\pi']^{-R/cp}\}T_3' = f_C(a, b, c, \pi')T_3',$$

$$T_3' - T_4' = (1+a)(T_3' - T_4^{*\prime}) = \frac{(1+a)\{[(1+c)(1+b)\pi']^{R/cp}-1\}}{1-a\{[(1+c)(1+b)\pi']^{R/cp}-1\}}T_4' = g_C(a, b, c, \pi')T_4'.$$

In the equations presented there have been at the same time defined functions f and g for expressing generally the size of temperature change in isentropic expansion or compression, as f-function is multiplied by the maximum temperature of the temperature range in question and correspondingly g-function by the minimum temperature, subscript E denoting expansion and subscript C compression.

In the storing process a heat balance in the cold store must be fulfilled, in other words, during the discharing period heat can be delivered into the cold store at the most up to the amount, which has been removed from it during the charging period. The quality of heat amounts results in the relationship $m'N(T_1'-T_0')-m'\Delta T'=N(T_1-T_0)+m\Delta T$, where N=number of stages one after another in the process (in FIGS. 65–66 N=1), masses m' and m of working gas denoting integral quantities $$m'=\int_0^{t'}\dot{m}'dt,\quad m=\int_0^{t}\dot{m}\,dt,$$

where t'=charging time and t=discharging time. Temperature notations used are the same as in FIGS. 65–66. Especially temperature differencies $\Delta T'$ and $\Delta T$ are denoting differences between the opposite sides of the heat exchanger $E_r$ due to an imperfect temperature efficiency of said exchanger. If the cold store had a perfect heat insulation, for the ratio of integrated working gas masses during discharging and charging periods is obtained the relationships $$\left(\frac{m}{m'}\right)_i = \frac{(T_1'-T_0')-\Delta T/N}{(T_1-T_0)+\Delta T/N} = \frac{g_E(\pi')T_0' - (1-e)(T_2'-T_5')/N}{g_C(\pi')T_0 + (1-e)(T_4-T_1)/N}.$$

In the latter form the loss caused by the exchanger $E_r$ has been expressed by means of temperature efficiency e of said exchanger, defined by relationships $T_2'-T_1'=e(T_2'-T_5')$, or $T_4-T_5=e(T_4-T_1)$.

For the process efficiency defined as the ratio of the amount of mechanical energy produced during the discharging period to the amount of mechanical energy consumed during the charging period can be obtained the equations $$\eta = \frac{W_{out}}{W_{in}} = \eta_1\left(\frac{m}{m'}\right)_i \cdot \frac{(T_3-T_4)-(T_1-T_0)}{(T_3'-T_4')-(T_1'-T_0')} = \eta_1 \cdot \frac{g_E(\pi')T_0' - (1-e)(T_2'-T_5')/N}{g_C(\pi)T_0 + (1-e)(T_4-T_1)/N} \cdot \frac{f_E(\pi)T_3 - g_C(\pi)T_0}{f_C(\pi')T_3' - g_E(\pi')T_0'},$$

where factor $\eta_1$ is taking into account additional losses such as thermal leakage from the surroundings into the cold store.

Figure 73:
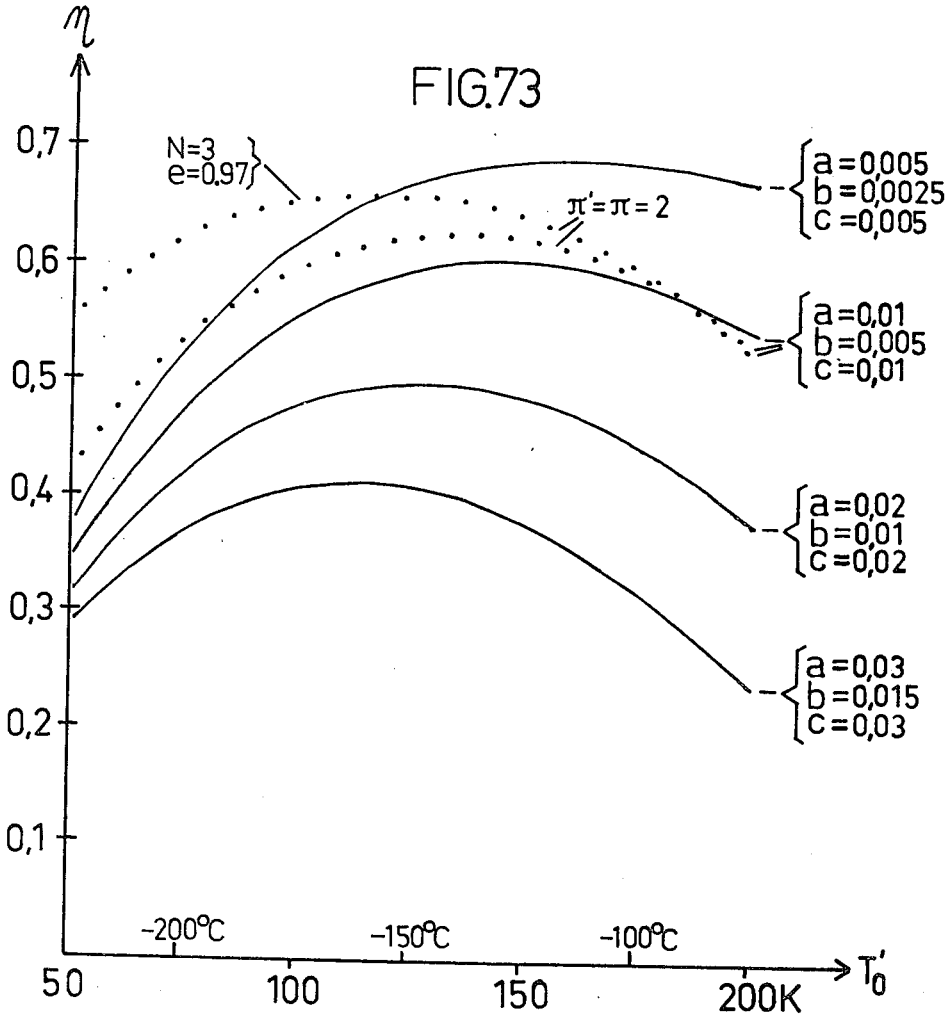
FIG. 73 is a graphical diagram illustrating the process efficiency of the storing process of FIGS. 65 and 66 as a function of a momentary cold store temperature, as various loss parameters have certain numerical values.

FIG. 73 presents graphically the calculated efficiency $\eta$ as a function of the minimum temperature $T_0'$ of working gas in the charging process at some values of loss parameters, a, b and c. Working gas is supposed to be helium ($c_p/R=2.5$) and pressure ratio $\pi=\pi'-1.80:1$. Besides, numerical values $T_3'=375$ K., $T_3365$ K., $T_0=T_0'+5$ K., $\eta_1=0.95$, e=0.96 and N=2 have been used. Temperature differencies $T_4-T_1$ and $T_2'-T_5'$ have been calculated from relationships $T_4-T_1=(T_3-T_0)-(T_3-T_4)-(T_1-T_0)$ and $T_2'-T_5'=[(T_3'-T_0')-(T_3'-T_4')-(T_1'-T_0')]/(2e-1)$. For example, the temperature $T_0'-130°$ K. (−143° C.) and loss parameters a=0.02, b=0.01 and c=0.02 are resulting in efficiency $$\eta = 0.95\,\frac{33.0-2.8}{38.6+2.3}\;\frac{74.6-38.6}{83.6-33.0} \simeq 0.50.$$

The range of water temperature would be then about 80° C. The two dotted curves in FIG. 73 correspond to pressure ratio $\pi=\pi'=2:1$. As to the upper curve, in addition exceptional values N=3 and e=0.97 have been used. Pressure ratio 2 is corresponding to a water temperature range of over 90° C. By using a closed water circuit the mentioned range is well applicable.

If the energy to be stored is originated from the sun, the efficiency of 50% may already be considered quite satisfactory, because part of the energy may be transmitted directly to consumers without storing. Additionally, the characteristic of the invented storing process is that the part of stored energy, which is not reversible to mechanical energy, remains in form of heat in the hot water store and, thus, in a form profitable for low temperature purposes. As seen from FIG. 73, theoretical possibilities even for a considerably higher efficiency exist. The best efficiency may be achieved in short-term storage and by using liquid as a cold store material. Then temperature differences $T_3'-T_3$ and $T_0-T_0'$ would be at the minimum as well as thermal leakage into the cold store. The equation derived may also be applied to circuits 251 and 254 in FIGS. 69–70. The efficiency of the circuit 255, in which the store air is directly flowing, is expected to be high.

The efficiency of the process may be altered in some extent by using different pressure ratios during charging and discharging periods. A moderate control range of pressure ratio is easy to arrange in the invented machine.

If a solid cold store or a store with a material being continuously in liquid form is used, then on the basis of FIG. 73 the total range of the temporal temperature variation may be about 70°-80° C. without the mean efficiency being remarkably lower than the maximum one. Then if a solid store were used, the temperature range of the colder end of the store might be within 100° K.-180° K. (about −170° C.−−90° C.), for example. When to this is added 50° C.$\simeq T_1 - T_0$ at the warmer end of the store, the store temperatures would be approximately within 100° K.-230° K. (about −170° C.−−40° C.), in which both temporal and local variations have been taken into account.

FIG. 73 reveals, how strongly the efficiency of the storing process is decreased by losses of machines. Thus, it is clear that turbo-machines are not competitive in this application, neither other known machines.

What is claimed is:

1. A machine for the expansion or compression of elastic fluids in closing spaces, the volumes of which vary periodically, comprising a body structure defining at least one rotation space therein;

a working member rotatably mounted within said rotation space one portion of the working member facing the surrounding body forming, together with the surrounding body, at least one working space moving with the working member circumferentially, and another portion of the working member being provided with at least one separating wall extending close to the wall of the rotation space;

within one functional basic unit of the machine n rotating reaction members equally distributed around the periphery of the rotation space in such a way that each reacting member is rotatable around its own axis which is essentially perpendicular to the rotation axis of the working member and preferably situated totally outside the rotation space of the working member, the number of aforesaid working spaces situated one after another in circumferential direction being equal to the number of said reacting members or to an integral multiple thereof, and each reacting member extending partially into the rotation space of the working member and having a part, which forms a transversal partition wall dividing the working space in question into two parts, a process space and a transferring space, respectively, the volumes of which vary periodically according to rotation of the working member, said partition wall forming part being shaped to have one, at the most two transition sectors, in which the distance of the outer edge line to the rotation axis of the reacting member has a minimum value;

flow conduits in the body structure of the machine for the inlet and outlet of elastic fluid;

at least one first opening in the body part surrounding the rotation space on the process space side of the partition wall, for providing connection between the process space and the corresponding flow conduit;

at least one second opening positioned in said body part on the transferring space side of the partition wall for providing connection between the transferring space and the corresponding flow conduit;

a rotating valve member for periodical closing of the openings between the process space and the corresponding flow conduit, said valve member being mounted into the body of the machine in front of the opening in question, the rotation axis of the valve member being situated in a normal plane of the rotation axis of the working member, said normal plane being situated outside the normal plane which includes the rotation axis of the reaction member and preferably in the vicinity of that side edge of the working space which constitutes to the extreme end of the process space, and the plane of rotation of the valve member being at least approximately directed towards the rotation axis of the working member; and synchronizing means interconnecting said working member, reacting members and valve member so that the connection between the process space and the corresponding flow conduit is established during such a part of the process cycle, during which the working space moves circumferentially over a certain distance, at the end of which the partition wall is in the process space end of the working space, and that once for each process cycle a passage of one separating wall of the working member through one transition sector in the partition wall forming part of the reacting member is established.

2. A machine for the expansion or compression of elastic fluids in closing spaces, the volumes of which vary periodically, comprising a body structure defining at least one rotation space therein;

a working member rotatably mounted within said rotation space, one portion of the working member facing the surrounding body forming, together with the surrounding body, at least one working space moving with the working member circumferentially, and another portion of the working member being provided with at least one separating wall extending close to the wall of the rotation space;

within one functional basic unit of the machine n rotating reacting members equally distributed around the periphery of the rotation space in such a way that each reacting member is rotatable around its own axis which is essentially perpendicular to the rotation axis of the working member and preferably situated totally outside the rotation space of the working member, the number of aforesaid working spaces situated one after another in circumferential direction being equal to the number of said reacting members or to an integral multiple thereof, and each reacting member extending partially into the rotation space of the working member and having a part, which forms a transversal partition wall dividing the working space in question into two parts, a process space and a transferring space, respectively, the volumes of which vary periodically according to rotation of the working member, said partition wall forming part being shaped to have one, at the most two transition sectors, in which the distance of the outer edge line to the rotation axis of the reacting member has a minimum value;

flow conduits in the body structure of the machine for the inlet and outlet of elastic fluid;

at least one first opening in the body part surrounding the rotation space on the process space side of the partition wall, for providing connection between the process space and the corresponding flow conduit;

at least one second opening positioned in said body part on the transferring space side of the partition wall for providing connection between the transferring space and the corresponding flow conduit;

a rotating valve member for the periodical closing of the openings between the process space and the corresponding flow conduit, said valve member being mounted into the body of the machine in front of the opening in question, the rotation axis of the valve member being situated in a normal plane of the rotation axis of the working member, and the plane of rotation of the valve member being at least approximately directed towards the rotation axis of the working member;

the rotation space of the working member being at the position of the working spaces of cylindrical form except for the position of the openings of the process space, where the rotation space has a projection part outside the cylindrical main part, formed by a channel in the body of the machine, and the bottom surface of said channel corresponding as well as possible to the form of an unbroken circum surface of the valve member, this unbroken circum surface being tangential to the bottom surface of the projection channel along two lines A-B and C-D, which are at intersections of, on one hand, said bottom surface and, on the other hand, two parallel fictive planes situated symmetrically on the opposite sides of that normal plane of the rotation axis of the valve member, which extends through the rotation axis of the working member, the positions of said lines A-B and C-D forming sealing lines between said unbroken circum surface and a projection part of the separating wall, which projection part corresponds to the cross-section form of said channel, the true opening of the process space becoming thus divided into three parts one after another, which parts act as virtual openings, whereby the corresponding opening operation in expansion use for part of each virtual opening can be started as soon as the separating wall has shielded the virtual opening in question; and synchronizing means interconnecting said working member, reacting members and closing means so that the connection between the process space and the corresponding flow conduit is established during such a part of the process cycle, during which the working space moves circumferentially over a certain distance, at the end of which the partition wall is in the process space end of the working space, and that once for each process cycle a passage of one separating wall of the working member through one transition sector in the partition wall forming part of the reacting member is established.

3. The machine as defined in claim 2, wherein the process space has been provided with two true openings situated one after another in the direction of the circumference of the working member, each opening being provided with a true valve member, whence six virtual openings one after another are formed in the direction of the circumference of the working member.

4. The machine as defined in claim 2, wherein the circum part of the valve member has been provided with a gap extending over a certain rotation sector $\beta_a$, $\beta_b$, $\beta_c$ individual to each virtual opening, a connection between the process space and the corresponding flow conduit being created when said gap is turned towards the opening of the process space, the other edges of the gap in the valve being at equal positions, whence closing the valve in expansion use as well as opening in compression use takes place at the same time for part of each virtual opening, whereas the other edges are at individual positions, so that the starting moment of opening of each virtual opening in expansion use as well as the ending moment of closing of each virtual openings in compression use is timed so that at that moment the virtual opening in question is in the shield of the separating wall of the working member.

5. The machine as defined in claim 2, wherein the middle part of said three parts constituting the process space is further subdivided transversally along a sealing line K-L situated in that normal plane of the working member which includes the axis of the valve member.

6. A machine for the expansion or compression of elastic fluids in closing spaces, the volumes of which vary periodically, comprising a body structure defining at least one rotation space therein;

a working member rotatably mounted within said rotation space, one portion of the working member facing the surrounding body forming, together with the surrounding body, at least one working space moving with the working member circumferentially, and another portion of the working member being provided with at least one separating wall extending close to the wall of the rotation space;

within one functional basic unit of the machine n rotating reacting members equally distributed around the periphery of the rotation space in such a way that each reacting member is rotatable around its own axis which is essentially perpendicular to the rotation axis of the working member and preferably situated totally outside the rotation space of the working member, the number of aforesaid working spaces situated one after another in circumferential direction being equal to the number of said reacting members or to an integral multiple thereof, and each reacting member extending partially into the rotation space of the working member and having a part, which forms a transversal partition wall dividing the working space in question into two parts, a process space and a transferring space, respectively, the volumes of which vary periodically according to rotation of the working member, said partition wall forming part being shaped to have one, at the most two transition sectors, in which the distance of the outer edge line to the rotation axis of the reacting member has a minimum value;

flow conduits in the body structure of the machine for the inlet and outlet of elastic fluid;

at least one first opening in the body part surrounding the rotation space on the process space side of the partition wall, for providing connection between the process space and the corresponding flow conduit;

at least one second opening positioned in said body part on the transferring space side of the partition wall for providing connection between the transferring space and the corresponding flow conduit;

a rotating valve member for the periodical closing of the openings between the process space and the corresponding flow conduit, said valve member being mounted into the body of the machine in front of the opening in question, the rotation axis of the valve member being situated in a normal plane of the rotation of the valve member being at least approximately directed towards the rotation axis of the working member;

the rotation space of the working member is at the position of the working spaces of cylindrical form except for the position of the openings of the process space, where the rotation space has a projection part outside the cylindrical main part, formed by a channel in the body of the machine, and the bottom surface of said channel corresponding as well as possible to the form of an unbroken circum surface of the valve member, this unbroken circum surface of the valve member being tangential to the bottom surface of the projecting channel along two lines A'-B' and C'-D', which are at intersections of, on one hand, the unbroken circum surface of the valve member and, on the other hand, two parallel fictive planes situated symmetrically on the opposite sides of that normal plane of the rotation axis of the working member, which extends through the rotation axis of the valve member, the positions of said lines forming sealing lines between said unbroken circum surface and a projection part of the separating wall, which projection part corresponds to the cross-section form of said channel, the true opening of the process space being thus divided into three parts one after another in the direction of the circumference of the valve member, said parts acting as virtual openings, whereby the corresponding opening operation in expansion use can be started as soon as the separating wall has shielded the virtual opening in question; and synchronizing means interconnecting said working member, reacting members and closing means so that the connection between the process space and the corresponding flow conduit is established during such a part of the process cycle, during which the working space moves circumferentially over a certain distance, at the end of which the partition wall is in the process space end of the working space, and that once for each process cycle a passage of one separating wall of the working member through one transition sector in the partition wall forming part of the reacting member is established.

7. The machine as defined in claim 6, wherein the process space has been provided with two true openings situated one after another in the direction of the circumference of the working member, each opening being provided with a true valve member, by means of which are achieved six virtual openings forming two groups in the direction of the working member, each group having three virtual openings in the direction of the circumference of the valve member.

8. The machine defined in claim 6 wherein the middle part of said three parts constituting the process space is further subdivided transversely along a sealing line situated in that normal plane of the valve member which includes the axis of the working member.

* * * * *